US012607414B2

(12) United States Patent
Xu et al.

(10) Patent No.: US 12,607,414 B2
(45) **Date of Patent: *Apr. 21, 2026**

(54) HEAT TRANSFER APPARATUS AND METHOD

(71) Applicant: Baltimore Aircoil Company, Inc., Jessup, MD (US)

(72) Inventors: Jian Xu, Ellicott City, MD (US); Yohann Lilian Rousselet, Baltimore, MD (US); Ellie M. Litwack, Columbia, MD (US); Preston Blay, Silver Spring, MD (US); Iuliu Iosifescu, Phoenix, AZ (US); Philip Hollander, Silver Spring, MD (US); Nikhin Herbert Mascarenhas, Woodstock, MD (US)

(73) Assignee: Baltimore Aircoil Company, Inc., Jessup, MD (US)

( * ) Notice: Subject to any disclaimer, the term of this patent is extended or adjusted under 35 U.S.C. 154(b) by 217 days.

This patent is subject to a terminal disclaimer.

(21) Appl. No.: 18/213,696

(22) Filed: Jun. 23, 2023

(65) Prior Publication Data

US 2023/0417494 A1 Dec. 28, 2023

Related U.S. Application Data

(60) Provisional application No. 63/427,326, filed on Nov. 22, 2022, provisional application No. 63/407,630, (Continued)

(51) Int. Cl.
*F28D 20/00* (2006.01)

(52) U.S. Cl.
CPC .. *F28D 20/0034* (2013.01); *F28D 2020/0069* (2013.01)

(58) Field of Classification Search
CPC .. F28D 20/0034; F28D 20/02; F25B 2400/24; F25B 2339/047; F28C 1/14
(Continued)

(56) References Cited

U.S. PATENT DOCUMENTS 3,367,413 A 2/1968 Forster
3,754,738 A 8/1973 Blazer
(Continued)

FOREIGN PATENT DOCUMENTS

CA 2808810 A1 9/2013
CN 107044710 A 8/2017
(Continued)

OTHER PUBLICATIONS

B.A.C.® Ice Chiller® Chiller brochure from Baltimore Aircoil Company, Inc.; S10M-8/90; 12 pages.
(Continued)

*Primary Examiner* — Steve S Tanenbaum
(74) *Attorney, Agent, or Firm* — Fitch, Even, Tabin & Flannery LLP

(57) ABSTRACT

In one aspect, a heat transfer apparatus for an industrial process that requires process fluid at a process fluid set temperature. The heat transfer apparatus includes a process fluid heat exchange circuit having a heat exchanger, an airflow generator, and a thermal energy storage. The controller is configured to operate the process fluid heat exchange circuit in a second mode wherein the thermal energy storage transfers heat between the process fluid and the thermal energy storage and the heat exchanger transfers heat between the process fluid and the air based at least in part upon a parameter of the air and a determination of the process fluid heat exchange circuit in a first mode, wherein
(Continued)

Approach 1 – Example 1 the process fluid bypasses the thermal energy storage, being unable to provide the process fluid at the process fluid set temperature.

26 Claims, 82 Drawing Sheets

Related U.S. Application Data filed on Sep. 17, 2022, provisional application No. 63/355,449, filed on Jun. 24, 2022.

(58) Field of Classification Search
USPC ..... 165/10
See application file for complete search history.

(56) References Cited

U.S. PATENT DOCUMENTS 3,923,935 A 12/1975 Cates
3,998,394 A 12/1976 Ovard
4,028,440 A 6/1977 Engalitcheff, Jr.
4,076,771 A 2/1978 Houx, Jr.
4,418,023 A 11/1983 Dolan
4,637,225 A 1/1987 Marshall
4,662,902 A 5/1987 Meyer-Pittroff
4,831,831 A 5/1989 Carter
4,951,739 A 8/1990 Cates
4,964,279 A 10/1990 Osborne
5,180,528 A 1/1993 Kaplan
5,226,285 A 7/1993 Dankowski
5,273,687 A 12/1993 Osborne
5,383,339 A 1/1995 Mccloskey
5,386,709 A 2/1995 Aaron
5,431,858 A 7/1995 Harrison, Jr.
5,435,382 A 7/1995 Carter
5,449,036 A 9/1995 Genge
5,585,047 A 12/1996 Mortensen
5,724,828 A 3/1998 Korenic
5,775,409 A 7/1998 Goto
5,816,315 A 10/1998 Stark
5,816,318 A 10/1998 Carter
5,944,094 A 8/1999 Kinney, Jr.
5,994,094 A 11/1999 Hoetten
6,047,555 A 4/2000 Weng
6,138,746 A 10/2000 Livolsi
6,142,219 A 11/2000 Korenic
6,213,200 B1 4/2001 Carter
6,216,486 B1 4/2001 Aaron
6,260,830 B1 7/2001 Harrison
6,298,676 B1 10/2001 Osborne
6,324,860 B1 12/2001 Maeda
6,415,615 B1 7/2002 Osborne
6,427,461 B1 8/2002 Whinery
6,446,941 B1 9/2002 Maheshwari
6,564,864 B2 5/2003 Carter
6,574,980 B1 6/2003 Morrison
6,663,694 B2 12/2003 Hubbard
6,684,943 B2 2/2004 Dobbs
7,107,782 B2 9/2006 Carter
7,128,310 B2 10/2006 Mockry
7,310,958 B2 12/2007 Carter
7,328,886 B2 2/2008 Mockry
7,484,718 B2 2/2009 Facius
7,603,774 B2 10/2009 Facius
7,802,774 B2 9/2010 Facius
8,412,357 B2 4/2013 Seem
8,434,746 B2 5/2013 Carter
8,483,883 B1 7/2013 Watson
8,676,385 B2 3/2014 Myers
8,833,741 B2 9/2014 Mockry
9,004,463 B2 4/2015 Carter
9,057,563 B2 6/2015 Carter
9,057,564 B2 6/2015 Carter
9,182,753 B2 11/2015 Benosman
9,243,847 B2 1/2016 Benz
9,255,739 B2 2/2016 Aaron
9,279,619 B2 3/2016 Aaron
9,587,885 B2 3/2017 Aaron
9,995,533 B2 6/2018 Aaron
10,132,577 B2 11/2018 Martell
10,180,261 B1 1/2019 Ross
10,222,146 B2 3/2019 Mockry
10,288,351 B2 5/2019 Aaron
10,365,001 B2 7/2019 Salsbury
10,401,843 B2 9/2019 House
10,415,902 B2 9/2019 Shin
10,619,953 B2 4/2020 Blay
10,627,176 B2 4/2020 Shin
10,677,543 B2 6/2020 Auth
10,718,551 B2 7/2020 Edwards
10,948,223 B2 * 3/2021 Tolouei Asbforoushani ..... F25B 39/022
11,029,093 B2 6/2021 Shin
11,092,394 B2 8/2021 Blay
11,240,937 B2 2/2022 Marchetti
11,287,191 B2 3/2022 Aaron
11,732,967 B2 8/2023 Rousselet
12,044,478 B2 7/2024 Rousselet
2003/0070547 A1 4/2003 Hubbard
2003/0071373 A1 4/2003 Hubbard
2004/0080060 A1 4/2004 Mockry
2004/0196631 A1 10/2004 Ueda
2004/0231824 A1 11/2004 Paolillo
2005/0012230 A1 1/2005 Kammerzell
2005/0077637 A1 4/2005 Mockry
2005/0279115 A1 12/2005 Lee
2007/0101746 A1 5/2007 Schlom
2007/0187851 A1 8/2007 Facius
2008/0018001 A1 * 1/2008 Kammerzell ..... F24F 6/043 62/304
2008/0041087 A1 2/2008 Muller
2008/0115921 A1 5/2008 Hall
2010/0010681 A1 1/2010 Zugibe
2010/0042453 A1 2/2010 Scaramellino
2010/0116465 A1 5/2010 Jainek
2010/0154448 A1 6/2010 Hay
2010/0181062 A1 7/2010 Mccann
2010/0281896 A1 11/2010 Al Watban
2010/0315770 A1 12/2010 Tipley
2010/0326091 A1 12/2010 Enayati
2011/0100593 A1 5/2011 Benz
2011/0113798 A1 5/2011 Pichai
2011/0168354 A1 7/2011 De Jong
2011/0227236 A1 9/2011 Vouche
2011/0289951 A1 12/2011 Furlong
2012/0067546 A1 3/2012 Bugler, III
2012/0273158 A1 11/2012 Cui
2012/0297821 A1 11/2012 Baxter
2013/0113127 A1 5/2013 Yang
2013/0228941 A1 9/2013 Bogh
2014/0209279 A1 7/2014 Aaron
2014/0216688 A1 8/2014 Shelnutt
2014/0229146 A1 8/2014 Gonzalez
2015/0068708 A1 3/2015 Mockry
2015/0069643 A1 3/2015 Mockry
2015/0363690 A1 12/2015 Modha
2016/0018125 A1 1/2016 Hamstra
2016/0161155 A1 6/2016 Guichard
2016/0178262 A1 6/2016 Rocha
2016/0313751 A1 10/2016 Risbeck
2016/0363388 A1 12/2016 Egolf
2017/0003078 A1 1/2017 Vadder
2017/0023309 A1 1/2017 Vadder
2017/0227263 A1 8/2017 Kopko
2017/0284742 A1 10/2017 Aaron
2018/0073753 A1 * 3/2018 LePoudre ..... F24F 12/002
2018/0100700 A1 4/2018 Beaver
2018/0100701 A1 4/2018 Beaver
2018/0100703 A1 4/2018 Beaver
2018/0202710 A1 7/2018 Miller
2018/0224174 A1 * 8/2018 Hollander ..... F24F 1/0007
2019/0145721 A1 * 5/2019 Blay ..... F28F 27/003 165/227

(56) References Cited

U.S. PATENT DOCUMENTS

| | | | |
|---|---|---|---|
| 2019/0195524 | A1 | 6/2019 | Carter |
| 2019/0212075 | A1 | 7/2019 | Shin |
| 2020/0284464 | A1 | 9/2020 | Abdel-Salam |
| 2020/0300553 | A1 | 9/2020 | Aaron |
| 2020/0363103 | A1 | 11/2020 | Kozlov |
| 2021/0180891 | A1 | 6/2021 | Rousselet |
| 2021/0364208 | A1 | 11/2021 | Taras |
| 2022/0003437 | A1 | 1/2022 | Lepoudre |
| 2022/0178619 | A1 | 6/2022 | Rousselet |
| 2024/0401884 | A1 | 12/2024 | Rousselet |

FOREIGN PATENT DOCUMENTS

| | | | |
|---|---|---|---|
| CN | 108489013 | A | 9/2018 |
| DE | 3030439 | A1 | 3/1982 |
| EP | 0172403 | B1 | 3/1988 |
| EP | 0264316 | A1 | 4/1988 |
| EP | 0365815 | B2 | 8/1999 |
| EP | 1698847 | A1 | 9/2006 |
| EP | 3306247 | A1 | 4/2018 |
| JP | 2006275323 | A | 10/2006 |
| JP | 2007285620 | A | 11/2007 |
| JP | 2020183816 | A | 11/2020 |
| KR | 101663258 | B1 | 10/2016 |
| KR | 20180138371 | A | 12/2018 |
| WO | 2005005905 | A1 | 1/2005 |
| WO | 2007015281 | A2 | 2/2007 |
| WO | 2010020160 | | 2/2010 |
| WO | 2010037164 | A1 | 4/2010 |
| WO | 2012114134 | A1 | 8/2012 |
| WO | 2015059038 | A1 | 4/2015 |
| WO | 2016154464 | | 9/2016 |
| WO | 2018004464 | | 1/2018 |
| WO | 2018069506 | | 4/2018 |
| WO | 2019149783 | | 8/2019 |
| WO | 2021023680 | | 2/2021 |
| WO | 2021219667 | | 11/2021 |

OTHER PUBLICATIONS

Cong, Daoyong et al.; Colossal Elastocaloric Effect in Ferroelastic Ni—Mn—Ti Alloys; Physical Review Letters 122, 255703 (2019); 17 pages.

Goetzler, William et al.; Alternatives to Vapor-Compression HVAC Technology; ASHRAE Journal, Oct. 2014; p. 12-23.

Goetzler, William et al.; Energy Savings Potential and RD&D Opportunities for Commerical Building HVAC Systems; Prepared for U.S. Department of Energy, Office of Energy Efficiency and Renewable Energy; Dec. 2017; 172 pages.

Hou, Huilong et al.; Fatigue-Resistant Hight-Performance Elastocaloric Materials Made by Additive Manufacturing; Science 366, 1116-1221 (2019); 30 pages.

Hsu, Ting-Heng et al.; Thermal Hysteresis in phase-change materials: Encapsulated metal alloy core-shell microparticles; ScienceDirect vol. 51, Sep. 2018, pp. 563-570.

Invitation to Pay Additional Fees from related International Application No. PCT/US2023/026148 dated Aug. 14, 2023; 3 pages.

Kirsch, Susanne-Marie et al.; Development of a Shape Memory Based Air Conditioning System; 59th Ilmenau Scientific Colloquium, Technische Universität Ilmenau, Sep. 11-15, 2017; 9 pages.

Li, Yang et al.; Energy-Efficient Elastocaloric Cooling by Flexibly and Reversibly Transferring Interface in Magnetic Shape Memory Alloys; ACS Applied Materials and Interfaces; vol. 10 (2018) 30, 25438-25445.

Lloveras, P. et al.; Colossal Barocaloric Effects Near Room Temperature in Plastic Crystals of Neopentylglycol; Nature Communication 10, 1803 (2019); https://doi.org/10.1038/s41467-019-09730-9, 7 pages.

3C Condenser Heat Rejection Systems—SH09 Series Microchannel, Installation, Operation & Maintenance Manual; Muller Industries; publicly available before Jan. 20, 2014; 30 pages.

Arteaga, Johnathan A.F. et al.; Prediction Method for the Performance of a Chiller Following a Cooling Load Profile; CONEM 2010 VI National Congress of Mechanical Engineering, Aug. 18-21, 2010 Campina Grande, Paraiba, Brazil; 10 pages.

Baltimore Aircoil Company; Chapter 15: Plume Abatement; pp. 87-88; publicly available before Mar. 19, 2019; 2 pages.

Baltimore Aircoil Company; product overview of HXC: Principle of Operation from https://www.baltimoreaircoil.eu/en/products/HXC-principle-of-operation; publicly available before Mar. 19, 2019; 1 page.

Baltimore Aircoil International nv; Product Report: BAC's Expertise from plume prediction to solution brochure; publicly available before Mar. 19, 2019; 2 pages.

Bonneville Power Administration; Electric Ideas Clearinghouse—Bulletin Board—Technology Update: Optimizing Cooling Tower Performance; Nov. 1991; 4 pages.

Carrier Corporation; Carrier® Chiller System Profiles—A Guide for Chilled Water Plant Operation; brochure; Copyright 1998; 4 pages.

Chilled Water System Analysis Tool (CWSAT), Version 2.1—User's Manual; Oct. 2005; The University of Massachusetts College of Engineering Department of Mechanical & Industrial Engineering, Amherst, MA; 34 pages.

Conserve it PTY LTD; PlantPRO® brochure from https://www.conserveitiot.com/plantpro; publicly available before Dec. 11, 2019; 13 pages.

CoolTools™ Chilled Water Plant Design Guide; Energy Design Resources; Dec. 2009; 281 pages.

DeepMind AI Reduces Google Data Centre Cooling Bill by 40%; Blog Post from https://deepmind.com/blog/article/deepmind-ai-reduces-google-data-centre-cooling-bill-40; Jul. 20, 2016; 6 pages.

Dempster, Ian; Machine Learning and Chiller System Optimization; brochure from https://www.districtenergy.org/HigherLogic/System/DownloadDocumentFile.ashx?DocumentFileKey=455e8aa2-5764-d402-ecda-89078853ddc7; Feb. 2015; 13 pages.

Deru, Michael et al.; U.S. Department of Energy Commercial Reference Building Models of the National Building Stock; Technical Report NREL/TP-5500-46861; National Renewable Energy Laboratory; Feb. 2011; 118 pages.

Energy Center of Wisconsin; Fact Sheet: Evaporative Condenser Control—Techniques to Cut Energy Waste in Large Refrigeration Systems; Copyright 2001; 2 pages.

Fan, Guo-Feng et al.; Application of the Weighted K-Nearest Neighbor Algorithm for Short-Term Load Forecasting; Energies 2019, 12, 916; doi:10.3390/en12050916; 19 pages; published Mar. 9, 2019.

Furlong, James W. et al; Optimization of Water—Cooled Chiller—Cooling Tower Combinations; CTI Journal, vol. 26, No. 1; p. 12-19; 2005; 8 pages.

García Cutillas, Clemente et al.; Optimum Design and Operation of an HVAC Cooling Tower for Energy and Water Conservation; Energies 2017, 10, 299; doi: 10.3390/en10030299; 27 pages; published Mar. 3, 2017.

Geister, W. Ryan et al.; A Closer Look at Chiller Ratings; ASHRAE Journal; Dec. 2009, p. 22-32; 8 pages.

GNV GL; Impact Evaluation of 2012 National Grid-Rhode Island Prescriptive Chiller Program; report prepared by KEMA, Inc.; Jul. 22, 2016; 35 pages.

Goel, S. et al.; Enhancements to ASHRAE Standard 90.1 Prototype Building Models; Prepared for the U.S. Department of Energy under Contract DE-AC05-76RL01830 by Pacific Northwest National Laboratory, Richland WA 99352; Apr. 2014; 59 pages.

Green Koncepts Pte Ltd; Chiller Plant Optimisation—Ultra Low Energy Management with IoT & Machine Learning Controls; brochure from http://greenbuildingreview.com/wp-content/uploads/2017/10/Track-1.3-Smart-Building-Roy-Arindam.pdf; publicly available before Dec. 11, 2019; 12 pages.

Hattori, Yuki et al.; The Relationship Between Heat Load Profile and Energy Efficiency in District heating and Cooling Plant; Proceedings of Building Simulation 2011: 12th Conference of International Building Performance Simulation Association, Sydney, Nov. 14-16; p. 1926-1933; 8 pages.

(56) References Cited

OTHER PUBLICATIONS

Ho, Simon; Trane® High Performance Chilled Water Systems; presentation; EarthWise HVAC Chiller—Tower Systems; Ingersoll Rand, Inc.; Sep. 2012; 18 pages.
Hydeman, Mark et al.; PG&E's CoolTools™ Project: A Toolkit to Improve Evaluation and Operation of Chilled Water Plants; Pacific Gas and Electric Company; Sep. 1997; 24 pages.
Hydronic and Heat Pump Control features from https://www.75f.io/solutions/equipment-type/hydronic-heat-pump-control; publicly available before Dec. 11, 2019; 8 pages.
Ingersoll Rand, Inc.; Trane® New myPLV Tool Provides Quick, Simple Option for Chiller Economic Comparisons; brochure; Feb. 26, 2014; 4 pages.
Jekel, Todd B. et al.; Energy Efficiency Improvements; Industrial Refrigeration Consortium at the University of Wisconsin Madison, WI; Reta National Conference 2017; 78 pages.
Jekel, Todd; Condenser Controls & Control Strategies; presentation at IRC Research & Technology Forum, Madison, WI; May 10-11, 2017; 35 pages.
Johnson Controls; Applying Artifical Intelligence to Built Environments through Machine Learning; brochure from https://www.johnsoncontrols.com/-/media/jci/insights/2019/bts/ bts_jci-661_dv_ai_learning_white_paper_020819_4p_f3.pdf; publicly available before Dec. 11, 2019; 4 pages.
Johnson Controls; HVAC&R Engineering Update: Use Only NPLV to Specify Chiller Efficieny; brochure from www.johnsoncontrols.com; Copyright 2009; 4 pages.
Jourdan, Greg; Knowing When Your Chiller Isn't Energy Smart; presentation Energy/Facilities Connections Washington State University; May 6, 2015; 132 pages.
Kim, Jee-Heon et al.; Modeling and Optimizing a Chiller System Using a Machine Learing Algorithm; Energies 2019, 12, 2860; doi:10.3390/en12152860; 13 pages; published Jul. 25, 2019.
Klawunder, Shawn Eric; Thesis: Modeling and Analysis of Chilled Water Systems; Requirement for the Degree Master of Science in Mechanical Engineering at Georgia Institute of Technology, Apr. 2000; 158 pages.
Lee, W.L. et al.; Developing a Simplified Model for Evaluating Chiller-System Configurations; Applied Energy 84 (2007) 290-306; 17 pages.
Lei, Zhao et al.; Dynamic Simulation and Analysis of a Water Chiller Refrigeration System; Applied Thermal Engineering 25 (2005) 2258-2271; 14 pages.
Li, Xiao et al.; Self-Optimizing Control of Cooling Tower for Efficient Operation of Chilled Water Systems; Purdue University School of Mechanical Engineering, International High Performance Buildings Conference 2012; Paper 62; http://docs.lib.purdue.edu/ihpbc/62; 11 pages.
Lindahl, Jr., Paul; Jameson, Randall W.; Plume Abatement and Water Conversation with the Wet/Dry Cooling Tower; Presented at the 1993 Cooling Tower Institute Annual Meeting, Technical Paper No. TP93-01; Feb. 1993; 33 pages.
Navitas Captial; Whitepaper: Artificial Intelligence (AI) for the Built World; Jun. 2019; 34 pages.
PCT Search Report and Written Opinion from related International Patent Application No. PCT/US2020/064459; dated Mar. 10, 2021; 39 pages.
Peesel, Ron-Hendrik et al.; Optimization of Cooling Utility System with Continuous Self-Learning Performance Models; Energies 2019, 12, 1926; doi:10.3390/en12101926; 17 pages; published May 20, 2019.
Pugh, Michael D.; Benefits of Water-Cooled Systems vs Air-Cooled Systems for Air-Conditioning Applications; presentation from Cooling Technology Institute (www.cti.org); publicly available before Dec. 11, 2019; 102 pages.
Schwedler, Mick et al.; Tower Water Temperature . . . Control It How ??!; Engineers Newsletter, vol. 24, No. 1, 1995; The Trane Company; 5 pages.
Schwedler, Mick; Condenser Water System Savings—Optimizing Flow Rates and Control; Engineers Newsletter, vol. 41, No. 3; Trane® a business of Ingersoll Rand; Sep. 2012; 8 pages.
SPX Cooling Technologies, Inc.; Marley® Improving Energy Efficiency in Cooling Tower Design; presentation; publicly available before Dec. 11, 2019; 24 pages.
Stocki, Michael et al.; Benchmarking an Energy Evaluation Tool for Chilled Water Systems; published by The American Counsil for an Energy-Efficient Economy (ACEEE); 2001; p. 429-440; 12 pages.
Sullivan, Brian; Chiller Selection Made Easier with myPLV™; Engineers Newsletter, vol. 44, No. 4; Trane® a business of Ingersoll Rand; Dec. 2015; 12 pages.
Taylor, Steven T.; Optimizing Design & Control of Chilled Water Plants—Part 5: Optimized Control Sequences; ASHRAE Journal; Jun. 2012; p. 56-74; 20 pages.
Tiessen, Alex et al.; Chapter 14: Chiller Evaluation Protocol—The Uniform Methods Project: Methods for Determining Energy Efficiency Savings for Specific Measures; Subcontract Report NREL/SR-7A40-62431; National Renewable Energy Laboratory; Sep. 2014; 24 pages.
TrilliumSeries™ Condenser—Rigging, Operation & Maintenance Manual; Baltimore Aircoil Company; M450/I-E; 2013; 20 pages.
TrilliumSeries™ Condenser; brochure from Baltimore Aircoil Company; S410/I-C; 2013; 12 pages.
U.S. Department of Energy—Hospital Energy Alliance; Fact Sheet: Hospitals Benefit by Improving Inefficient Chiller Systems; Aug. 2011; 2 pages.
U.S. Appl. No. 18/221,499, filed Jul. 13, 2023, entitled Heat Exchanger System with Machine-Learning Based Optimization; 81 pages.
Vallabhaneni, Kavita A.; Benefits of Water-Cooled Systems vs. Air-Cooled Systems for Air-Conditioning Applications; presentation from Cooling Technology Institute (www.cti.org); publicly available before Dec. 11, 2019; 88 pages.
International Search Report and Written Opinion from related International Application No. PCT/US2023/026148, dated Nov. 9, 2023; 30 pages.
U.S. Appl. No. 18/949,835, filed Nov. 15, 2024, entitled Heat Transfer Apparatus and Method; 289 pages.
Extended European Search Report from related European Patent Application No. 23827910.3 dated Mar. 13, 2026; 9 pages.

* cited by examiner

Approach 1

Approach 1 – Example 1

Approach 1 – Example 1
Water Saving Sequence of Operation
PCM Discharge 4A 4B

| 174 Chiller Status | 176 Closed-Loop Pump Status | 178 Process Fluid Flow through Chiller Condenser | 180 Process Fluid Flow through Chiller Evaporator | 182 Process Fluid Flow through PCM Tank | 184 PCM Tank Charge | 186 PCM Tank Mode |
|---|---|---|---|---|---|---|
| Off | Off | No | No | No | ≥0% | n/a |
| Off | Off | No | No | Yes (partial) 194 | >0% | Discharge 196 |
| On 206 | Off | Yes (partial) 202 | Yes (partial) 204 | No 208 | 0% | n/a |
| On 218 | Off | Yes (partial) 214 | Yes (partial) 216 | Yes (partial) 220 | >0% | Discharge 222 |
| Off 230 | Off | No 232 | No 234 | Yes (partial) 236 | >0% | Discharge 238 |
| On 244 | Off | Yes (partial) 246 | Yes (partial) 248 | No 250 | 0% | n/a |
| On 256 | Off | Yes (partial) 258 | Yes (partial) 260 | Yes (partial) 262 | >0% | Discharge 264 |

Approach 1 – Example 1
Water Saving Sequence of Operation
PCM Discharge

FIG. 4B 4A 4B

Approach 1 – Example 1
Energy Saving Sequence of Operation
PCM Discharge 5A 5B

| Chiller Status | Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| Off | Off | No | No | No | ≥0% | n/a |
| Off | Off | No | No | Yes (partial) | >0% | Discharge |
| On | Off | Yes (partial) | Yes (partial) | No | 0% | n/a |
| On | Off | Yes (partial) | Yes (partial) | Yes (partial) | >0% | Discharge |

Approach 1 – Example 1
Energy Saving Sequence of Operation
PCM Discharge

FIG. 5B

5A 5B

Approach 1 – Example 1
Water Saving Sequence of Operation
PCM Charge 6A 6B

306

| Chiller Status | Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| Off | Off | No | No | Yes (partial) | <100% | Charge |
| On | Off | Yes (partial) | Yes (partial) 311 | Yes (partial) 313 | <100% | Charge |
| On | On 316 | Yes (partial) | No (closed-loop) 312 | No (closed-loop) 314 | <100% | Charge |
| Off | Off | No | No | Yes (partial) 319 | <100% | Charge |
| On | Off | Yes (partial) | Yes (partial) | Yes (partial) 323 | <100% | Charge |
| On | On | Yes (partial) | No (closed-loop) 318 | No (closed-loop) 320 | <100% | Charge |

Approach 1 – Example 1
Water Saving Sequence of Operation
PCM Charge

FIG. 6B

6A 6B

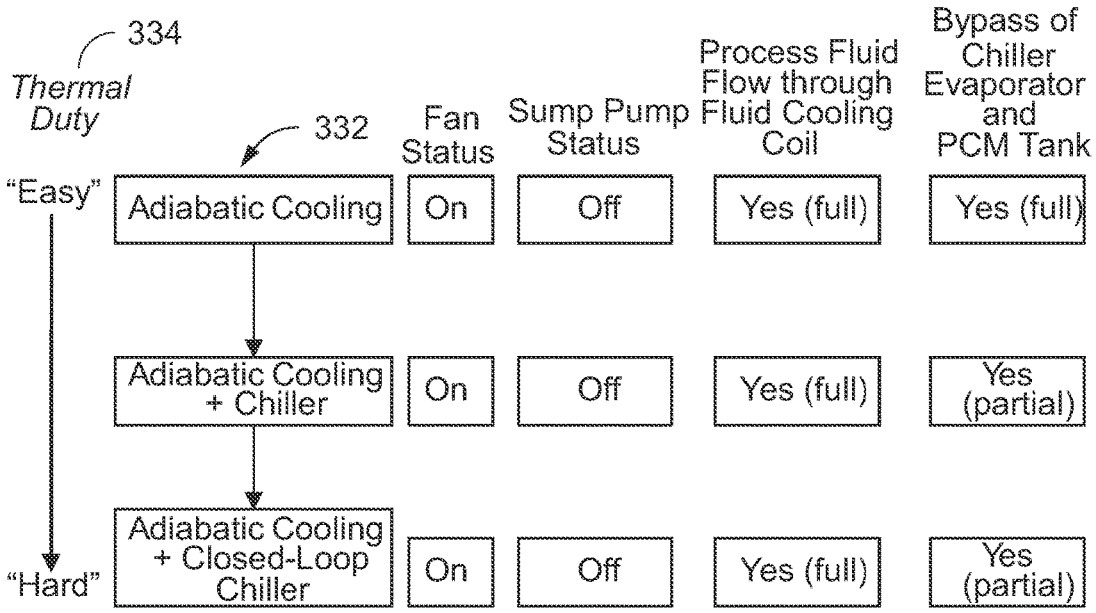

7A 7B

FIG. 7A

| Chiller Status | Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| Off | Off | No | No | Yes (partial) | <100% | Charge |
| On | Off | Yes (partial) | Yes (partial) | Yes (partial) | <100% | Charge |
| On | On | Yes (partial) | No (closed-loop) | No (closed-loop) | <100% | Charge |

330

Approach 1 – Example 1
Energy Saving Sequence of Operation
PCM Charge 7A 7B

FIG. 7B

Approach 1 – Example 2

Approach 1 – Example 2
Water Saving Sequence of Operation
PCM Discharge 9A 9B

| Chiller Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|
| Off | No | No | No | ≥0% | n/a |
| Off | No | No | Yes (partial) | >0% | Discharge |
| On | Yes (partial) | Yes (partial) | No | 0% | n/a |
| On | Yes (partial) | Yes (partial) | Yes (partial) | >0% | Discharge |
| Off | No | No | Yes (partial) | >0% | Discharge |
| On | Yes (partial) | Yes (partial) | No | 0% | n/a |
| On | Yes (partial) | Yes (partial) | Yes (partial) | >0% | Discharge |

Approach 1 – Example 2
Water Saving Sequence of Operation
PCM Discharge 9A 9B

FIG. 9B

Approach 1 – Example 2
Energy Saving Sequence of Operation
PCM Discharge 10A 10B

403

| Chiller Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|
| Off | No | No | No | ≥0% | n/a |
| Off | No | No | Yes (partial) | >0% | Discharge |
| On | Yes (partial) | Yes (partial) | No | 0% | n/a |
| On | Yes (partial) | Yes (partial) | Yes (partial) | >0% | Discharge |

Approach 1 – Example 2
Energy Saving Sequence of Operation
PCM Discharge

FIG. 10B

10A 10B

414

| Thermal Duty | 412 | Fan Status | Sump Pump Status | Process Fluid Flow through Fluid Cooling Coil | Bypass of Chiller Evaporator and PCM Tank |
|---|---|---|---|---|---|
| "Easy" | Dry Cooling | On | Off | Yes (full) | Yes (full) |
| | Dry Cooling + Chiller | On | Off | Yes (full) | Yes (partial) |
| | Adiabatic Cooling | On | On | Yes (full) | Yes (partial) |
| "Hard" | Adiabatic Cooling + Chiller | On | On | Yes (full) | Yes (partial) |

410

11A 11B

FIG. 11A

| Chiller Status | Process Fluid Flow through Chiller Condenser | Process Fluid Flow through Chiller Evaporator | Process Fluid Flow through PCM Tank | PCM Tank Charge | 415 PCM Tank Mode |
|---|---|---|---|---|---|
| Off | No | No | Yes (partial) | <100% | Charge |
| On | Yes (partial) | Yes (partial) | Yes (partial) | <100% | Charge |
| Off | No | No | Yes (partial) | <100% | Charge |
| On | Yes (partial) | Yes (partial) | Yes (partial) | <100% | Charge |

Approach 1 – Example 2
Water Saving Sequence of Operation
PCM Charge 11A 11B

FIG. 11B

Approach 1 – Example 3

Approach 1 - Example 3
Water Saving Sequence of Operation
PCM Discharge 20A 20B

528

| Chiller Status | Primary Closed-Loop Pump Status | Secondary Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|---|
| Off | Off | Off | No | No | No | ≥0% | n/a |
| Off | Off | Off | No | No | Yes (partial) | >0% | Discharge |
| On | Off | Off | Yes (partial) | Yes (partial) | No | 0% | n/a |
| On | Off | Off | Yes (partial) | Yes (partial) | Yes (partial) | >0% | Discharge |
| Off | Off | Off | No | No | Yes (partial) | >0% | Discharge |
| On | Off | Off | Yes (partial) | Yes (partial) | No | 0% | n/a |
| On | Off | Off | Yes (partial) | Yes (partial) | Yes (partial) | >0% | Discharge |

Approach 1 - Example 3
Water Saving Sequence of Operation
PCM Discharge 20A 20B

FIG. 20B

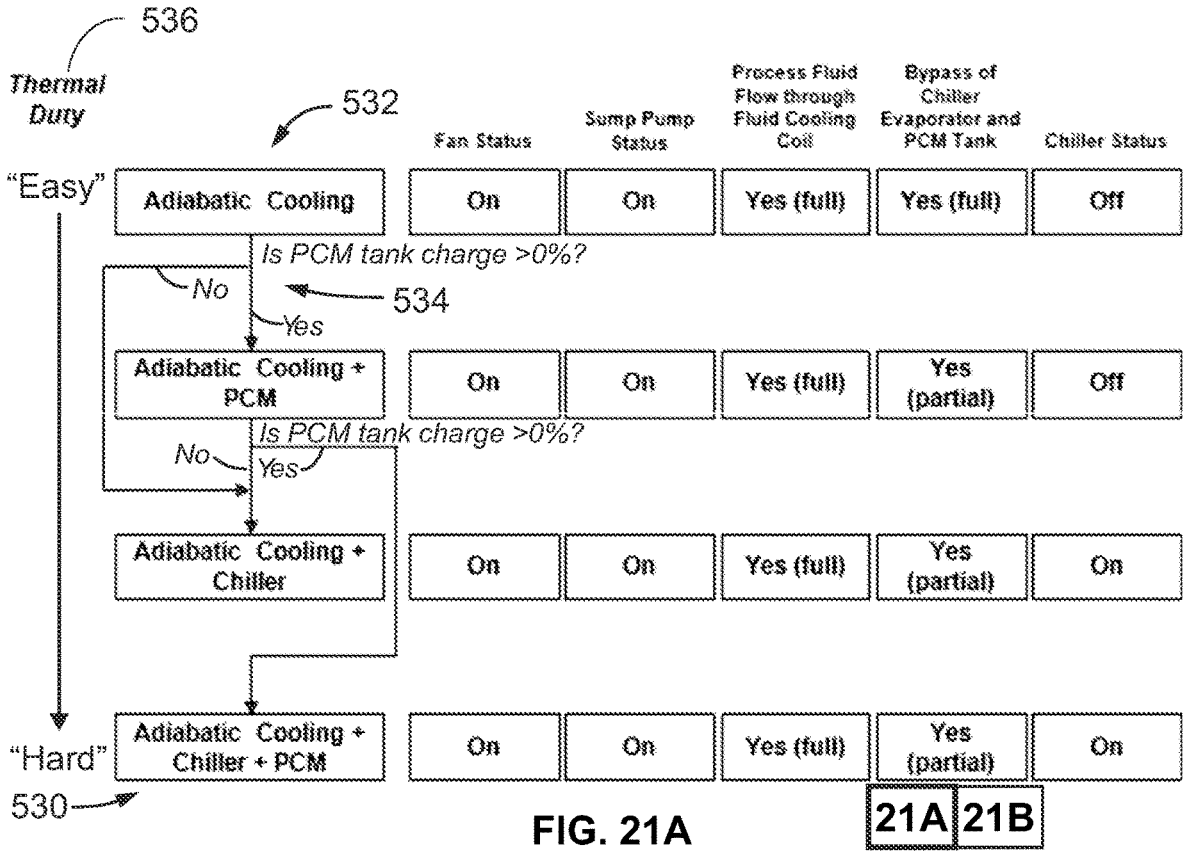

FIG. 21A 21A 21B

| Primary Closed-Loop Pump Status | Secondary Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| Off | Off | No | No | No | >0% | n/a |
| Off | Off | No | No | Yes (partial) | >0% | Discharge |
| Off | Off | Yes (partial) | Yes (partial) | No | 0% | n/a |
| Off | Off | Yes (partial) | Yes (partial) | Yes (partial) | >0% | Discharge |

Approach 1 - Example 3
Energy Saving Sequence of Operation
PCM Discharge 21A 21B

FIG. 21B

544

542

| Thermal Duty | | Fan Status | Sump Pump Status | Process Fluid Flow through Fluid Cooling Coil | Bypass of Chiller Evaporator and PCM Tank | Chiller Status |
|---|---|---|---|---|---|---|
| No thermal load | Closed-Loop Dry Cooling | On | Off | No (closed-loop fluid) | No | On |
| No thermal load | Closed-Loop Adiabatic Cooling | On | On | No (closed-loop fluid) | No | On |
| "Easy" | Dry Cooling | On | Off | Yes (full) | Yes (full) | Off |
| | Dry Cooling + Chiller | On | Off | Yes (full) | Yes (partial) | On |
| | Dry Cooling + Closed-Loop Chiller | On | Off | Yes (full) | Yes (partial) | On |
| | Adiabatic[5] Cooling | On | On | Yes (full) | Yes (partial) | Off |
| | Adiabatic[5] Cooling + Chiller | On | On | Yes (full) | Yes (partial) | On |
| "Hard" | Adiabatic[5] Cooling + Closed-Loop Chiller | On | On | Yes (full) | Yes (partial) | On |

546

548

540

Approach 1 - Example 3
Water Saving Sequence of Operation
PCM Charge 22A 22B

FIG. 22A

545

| Primary Closed-Loop Pump Status | Secondary Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| On | On | No (closed-loop fluid) | No (closed-loop fluid) | No (closed-loop fluid) | <100% | Charge |
| On | On | No (closed-loop fluid) | No (closed-loop fluid) | No (closed-loop fluid) | <100% | Charge |
| Off | Off | No | No | Yes (partial) | <100% | Charge |
| Off | Off | Yes (partial) | Yes (partial) | Yes (partial) | <100% | Charge |
| On | Off | No (closed-loop fluid) | No (closed-loop fluid) | No (closed-loop fluid) | <100% | Charge |
| Off | Off | No | No | Yes (partial) | <100% | Charge |
| Off | Off | Yes (partial) | Yes (partial) | Yes (partial) | <100% | Charge |
| On | Off | Yes (partial) | No (closed-loop fluid) | No (closed-loop fluid) | <100% | Charge |

Approach 1 - Example 3
Water Saving Sequence of Operation
PCM Charge 22A 22B

FIG. 22B

554

552

558

| Thermal Duty | | Fan Status | Sump Pump Status | Process Fluid Flow through Fluid Cooling Coil | Bypass of Chiller Evaporator and PCM Tank | Chiller Status |
|---|---|---|---|---|---|---|
| No thermal load | Closed-Loop Adiabatic Cooling | On | On | No (closed-loop fluid) | No | On |
| "Easy" | Adiabatic Cooling | On | On | Yes (full) | Yes (partial) | Off |
| | Adiabatic Cooling + Chiller | On | On | Yes (full) | Yes (partial) | On |
| "Hard" | Adiabatic Cooling + Closed-Loop Chiller | On | On | Yes (full) | Yes (partial) | On |

550

23A 23B

FIG. 23A

556

| Primary Closed-Loop Pump Status | Secondary Closed-Loop Pump Status | Process Fluid Flow through Chiller Condenser | Process Fluid Flow through Chiller Evaporator | Process Fluid Flow through PCM Tank | PCM Tank Charge | PCM Tank Mode |
|---|---|---|---|---|---|---|
| On | On | No (closed-loop fluid) | No (closed-loop fluid) | No (closed-loop fluid) | <100% | Charge |
| Off | Off | No | No | Yes (partial) | <100% | Charge |
| Off | Off | Yes (partial) | Yes (partial) | Yes (partial) | <100% | Charge |
| On | Off | Yes (partial) | No (closed-loop fluid) | No (closed-loop fluid) | <100% | Charge |

Approach 1 - Example 3
Energy Saving Sequence of Operation
PCM Charge 23A 23B

FIG. 23B

Approach 1 – Example 4

Approach 1 – Example 5

Approach 2

Approach 2 – Example 1

Approach 2 – Example 1
Water Saving Sequence of Operation
PCM Discharge

Approach 2 – Example 1
Energy Saving Sequence of Operation
PCM Charge

Approach 2 – Example 2

Approach 2 – Example 2
Water Saving Sequence of Operation
PCM Discharge

Approach 2 – Example 2
Energy Saving Sequence of Operation
PCM Charge

Approach 2 –Example 3

Approach 2 – Example 4

Approach 3 – Example 1

Mode 2

Mode 3

Mode 4

Approach 3 – Example 2

Approach 3 – Example 3

Approach 3 – Example 4

HEAT TRANSFER APPARATUS AND METHOD

CROSS-REFERENCE TO RELATED APPLICATIONS

This application claims the benefit of U.S. Provisional Patent App. No. 63/355,449, filed Jun. 24, 2022; U.S. Provisional Patent App. No. 63/407,630, filed Sep. 17, 2022; and U.S. Provisional Patent App. No. 63/427,326, filed Nov. 22, 2022, which are all hereby incorporated by reference herein in their entireties.

FIELD

This disclosure relates to systems for removing heat from a process fluid and, more specifically, relates to packaged cooling systems such as cooling towers.

BACKGROUND

Industrial cooling systems are used to remove heat from process fluid in various industrial processes, such as manufacturing processes, HVAC systems for buildings, and heat transfer systems for computer datacenters. One common approach for some industrial cooling systems is to have a heat exchanger, such as an air handler, in a building that transfers heat to a first process fluid (e.g., water or a water-glycol mixture) and a chiller in the building that removes heat from the first process fluid. The chiller transfers heat from the first process fluid to a second process fluid, which is routed to a heat rejection apparatus, such as cooling tower outside of the building. The cooling tower removes heat from the second process fluid and returns cooled second process fluid to the chiller. Chillers used in industrial cooling systems are typically quite large, with power ratings in the range of 100-300 horsepower being common.

An issue with operating an industrial cooling system year-round is that the cooling system is typically designed with sufficient maximum capacity to provide the required cooling even during the hottest days of the year. Providing sufficient maximum capacity for the hottest days of the year in traditional cooling systems involves utilizing higher-capacity system components, such as more powerful chillers, fan motors, pumps, etc. than are required for the rest of the year. The higher-capacity system components consume more energy and/or water than would lower-capacity components, but are used to provide sufficient maximum capacity for the cooling system.

Ice thermal storage systems are sometimes used with industrial cooling systems to provide extra cooling capacity at peak energy usage, such as in the afternoon of a sunny and humid summer day. Ice thermal storage systems have a thermal storage tank that is charged, e.g., ice in the tank is frozen, and discharged as needed to supplement the chiller and cooling tower of the cooling system. For example, the ice thermal storage system may operate to freeze water in the tank overnight when electricity may be less expensive from the local utility. The ice thermal storage system is discharged, e.g., the ice in the tank is melted by process fluid traveling through a coil in the ice tank, in the afternoon of the sunny and humid summer day to provide increased cooling capacity for the cooling system.

An issue with some cooling systems that utilize ice thermal storage is that the cooling system still relies on a large, e.g., 200+ horsepower, chiller in the building to chill water provided to the heat exchanger in the building. While providing sufficient maximum capacity, these large chillers often consume large amounts of energy even when the cooling capacity required is low. Another issue with some ice thermal storage cooling systems is that the one or more ice tanks may take up an entire room, or even a separate building, in order to provide adequate cooling capacity for a large-scale industrial cooling system. The size and complexity of large-scale ice thermal storage tanks may be impractical for some facilities. Further, ice thermal storage systems utilize glycol as process fluid which is more expensive than water, increases pumping power required to circulate the process fluid, and reduces heat transfer performance.

SUMMARY

In one aspect of the present disclosure, a heat transfer apparatus is provided for an industrial process that requires process fluid at a process fluid set temperature. The heat transfer apparatus includes an air inlet, an air outlet, and a process fluid heat exchange circuit to receive process fluid from the industrial process at a temperature different than the process fluid set temperature and provide process fluid to the industrial process at the process fluid set temperature. The process fluid heat exchange circuit includes a heat exchanger, an airflow generator operable to cause air to travel from the air inlet to the air outlet and contact the heat exchanger, and a thermal energy storage.

The process fluid heat exchange circuit has a first mode wherein the process fluid bypasses the thermal energy storage and the heat exchanger transfers heat between the process fluid and the air. The process fluid may bypass the thermal energy storage by, for example, being routed around the thermal energy storage or being routed to the thermal energy storage when the thermal energy storage has limited heat exchange capability. As a further example, the process fluid may bypass the thermal energy storage when the process fluid is directed through the thermal energy storage but the phase change material has been drained from the thermal energy storage such that the process fluid leaves the thermal energy storage at substantially the same temperature as it entered the thermal energy storage. The process fluid heat exchange circuit has a second mode wherein the thermal energy storage transfers heat between the process fluid and the thermal energy storage and the heat exchanger transfers heat between the process fluid and the air. The heat transfer apparatus further comprises a controller operatively connected to the process fluid heat exchange circuit.

The controller is configured to operate the process fluid heat exchange circuit in the second mode based at least in part upon a parameter of the air and a determination of the process fluid heat exchange circuit in the first mode being unable to provide the process fluid at the process fluid set temperature. In this manner, the heat transfer apparatus may utilize the thermal energy storage to trim or partially satisfy the heat transfer load required to provide the process fluid at the process fluid set temperature. By selectively utilizing the thermal energy storage at peak heat transfer loads, such as on the hottest days of the year, the heat exchanger can be sized to have smaller capacity than if the heat exchanger were to satisfy the peak heat transfer load by itself, which facilitates the use of less water and/or energy by the heat exchanger during off-peak heat transfer load situations.

The present disclosure also provides a method for operating a heat transfer apparatus associated with an industrial process that requires process fluid at a process fluid set temperature. The heat transfer apparatus includes a process fluid heat exchange circuit for the process fluid that includes a heat exchanger, a fan to cause movement of air relative to the heat exchanger, and a thermal energy storage. The process fluid heat exchange circuit has a first mode wherein the process fluid bypasses the thermal energy storage and the heat exchanger transfers heat between the process fluid and the air. The process fluid heat exchange circuit has a second mode wherein the thermal energy storage transfers heat between the process fluid and the thermal energy storage and the heat exchanger transfers heat between the process fluid and the air. The method includes operating the process fluid heat exchange circuit in the second mode based at least in part upon a parameter of the air and a determination of the process fluid heat exchange circuit in the first mode being unable to provide the process fluid to the industrial process at the process fluid set temperature.

In one aspect of the present disclosure, a heat transfer apparatus is provided that includes a process fluid heat exchange circuit including a heat exchanger, an airflow generator operable to cause air to contact the heat exchanger, a thermal energy storage, and a mechanical cooler. The process fluid heat exchange circuit has a plurality of modes including a first mode wherein the heat exchanger is operable to transfer heat between a process fluid and the air and a second mode wherein the heat exchanger is operable to transfer heat between the process fluid and the air and the mechanical cooler is operable to remove heat from the process fluid. The plurality of modes further includes a third mode wherein the heat exchanger is operable to transfer heat between the process fluid and the air and the thermal energy storage is operable to remove heat from the process fluid and a fourth mode wherein the heat exchanger is operable to transfer heat between the process fluid and the air, the mechanical cooler is operable to remove heat from the process fluid, and the thermal energy storage is operable to remove heat from the process fluid. The heat transfer apparatus further includes a controller configured to operate the process fluid heat exchange circuit in one of the plurality of modes based at least in part upon a determination of a thermal duty of the heat transfer apparatus. In this manner, the controller may operate the process fluid heat exchange circuit in various configurations based at least in part upon the thermal duty which provides flexibility in tuning the heat transfer apparatus to efficiently remove heat from the process fluid.

In another aspect of the present disclosure, a heat transfer apparatus is provided including an air inlet, an air outlet, and a process fluid cooling system for cooling a process fluid. The process fluid cooling system includes a fan assembly to cause air to travel from the air inlet to the air outlet, a dehumidifier having a dehumidification mode wherein the dehumidifier removes water from the air and a bypass mode wherein the dehumidifier removes less water from the air than when the dehumidifier is in the dehumidification mode, and an adiabatic precooler having a precooler mode wherein the adiabatic precooler lowers the dry bulb temperature of the air and a standby mode wherein the adiabatic precooler lowers the dry bulb temperature of the air less than when the adiabatic precooler is in the precooler mode. The heat transfer apparatus further includes a heat exchanger that receives the process fluid and is downstream of the dehumidifier and the adiabatic precooler. The process fluid cooling system has a first mode wherein the dehumidifier is in the dehumidification mode and the adiabatic precooler is in the precooler mode, a second mode wherein the dehumidifier is in the bypass mode and the adiabatic precooler is in the precooler mode, and a third mode wherein the dehumidifier is in the bypass mode and the adiabatic precooler is in the standby mode. In this manner, the dehumidifier and the adiabatic precooler may be selectively operated to satisfy an operating criterion for the heat transfer apparatus such as providing a process fluid at a process fluid set temperature, satisfying a heat transfer load, minimizing energy consumption, and/or minimizing water consumption. Further, the heat transfer apparatus may include a water recovery system to recover water removed from the air by the dehumidifier. The recovered water may be utilized by the heat transfer apparatus as make-up water for the adiabatic precooler as one example.

The present disclosure also provides a heat transfer apparatus having a heat exchanger for cooling a process fluid, the heat exchanger comprising a liquid distribution system, and a fan operable to cause air to move relative to the heat exchanger. The heat exchanger has a wet mode wherein the liquid distribution system distributes liquid and a dry mode wherein the liquid distribution system distributes less liquid than in the wet mode. The heat transfer apparatus further includes a thermal energy storage having a heat transfer mode wherein the thermal energy storage removes heat from the process fluid and a bypass mode wherein the thermal energy storage removes less heat from the process fluid than when the thermal energy storage is in the heat transfer mode. The heat transfer apparatus further includes a controller configured to receive either a request to minimize water consumption or a request to minimize energy consumption and determine a thermal duty for the heat transfer apparatus from a plurality of thermal duties including a lower thermal duty, an intermediate thermal duty, and a higher thermal duty. In response to receiving the request to minimize water consumption, the controller is configured to operate the heat exchanger in the dry mode and the thermal energy storage in the bypass mode based at least in part upon the thermal duty being the lower thermal duty; operate the heat exchanger in the dry mode and the thermal energy storage in the heat transfer mode based at least in part upon the thermal duty being the intermediate thermal duty; and operate the heat exchanger in the wet mode and the thermal energy storage in the heat transfer mode based at least in part upon the thermal duty being the higher thermal duty. In response to receiving the request to minimize energy consumption, the controller is configured to operate the heat exchanger in the wet mode and the thermal energy storage in the bypass mode based at least in part upon the thermal duty being the lower thermal duty; and operate the heat exchanger in the wet mode and the thermal energy storage in the heat transfer mode based at least in part upon the thermal duty being the higher thermal duty. The controller may thereby operate components of the heat transfer apparatus in different modes depending on the thermal duty and the request to minimize water or energy consumption, which permits accurate and efficient operation of the heat transfer apparatus to provide a requested process fluid set temperature, for example.

BRIEF DESCRIPTION OF THE DRAWINGS

FIGS. 4A and 4B are a chart showing the status of different components of the heat transfer apparatus of FIG.

Figure 1:
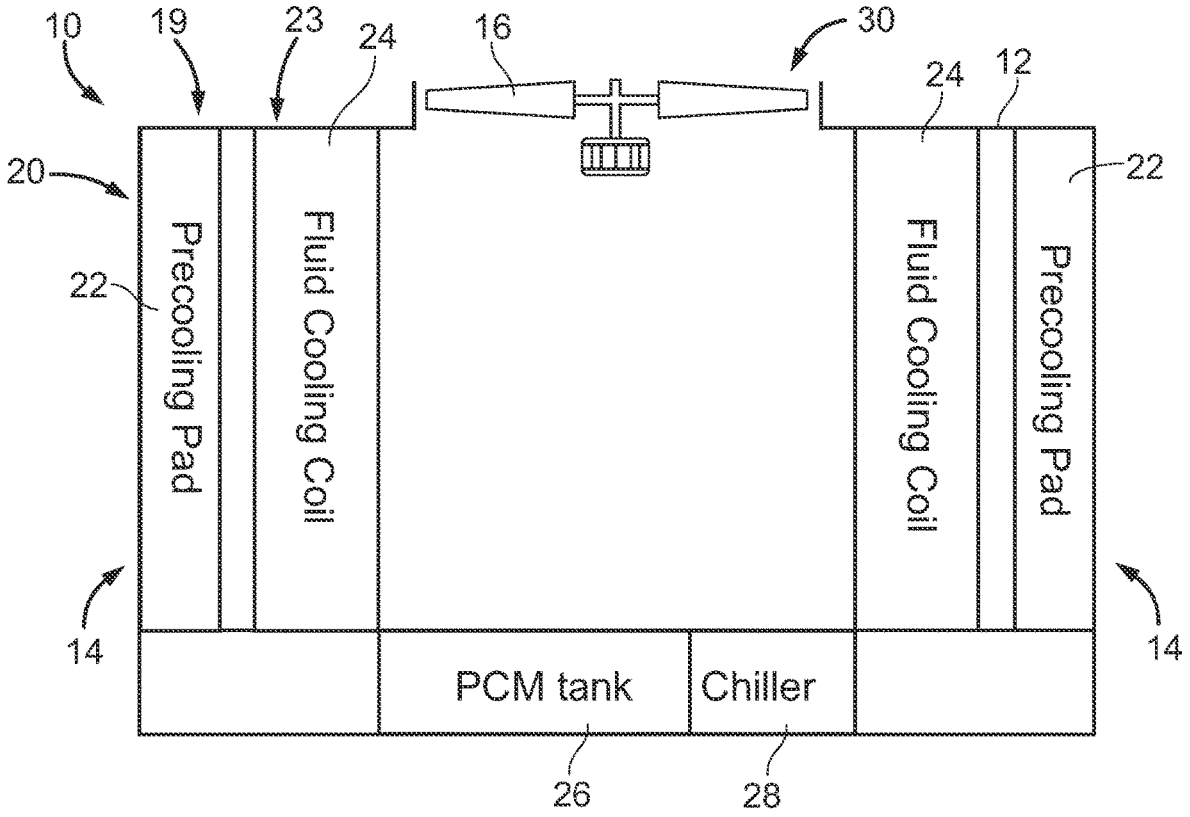
FIG. 1 is a schematic representation of a heat transfer apparatus according to a first approach.
Figure 3:
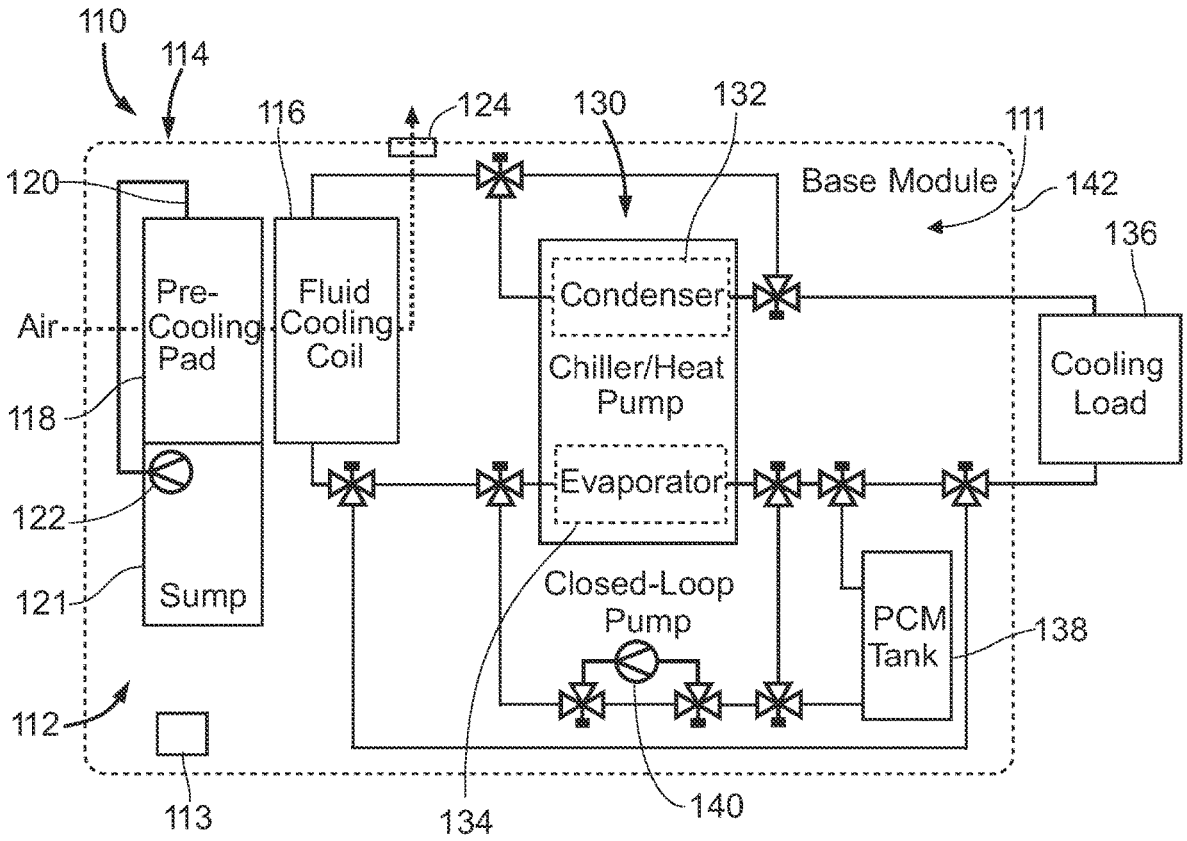
FIG. 3 is a schematic representation of a heat transfer apparatus that is a first example of the heat exchanger of FIG. 1.
Figure 5A:
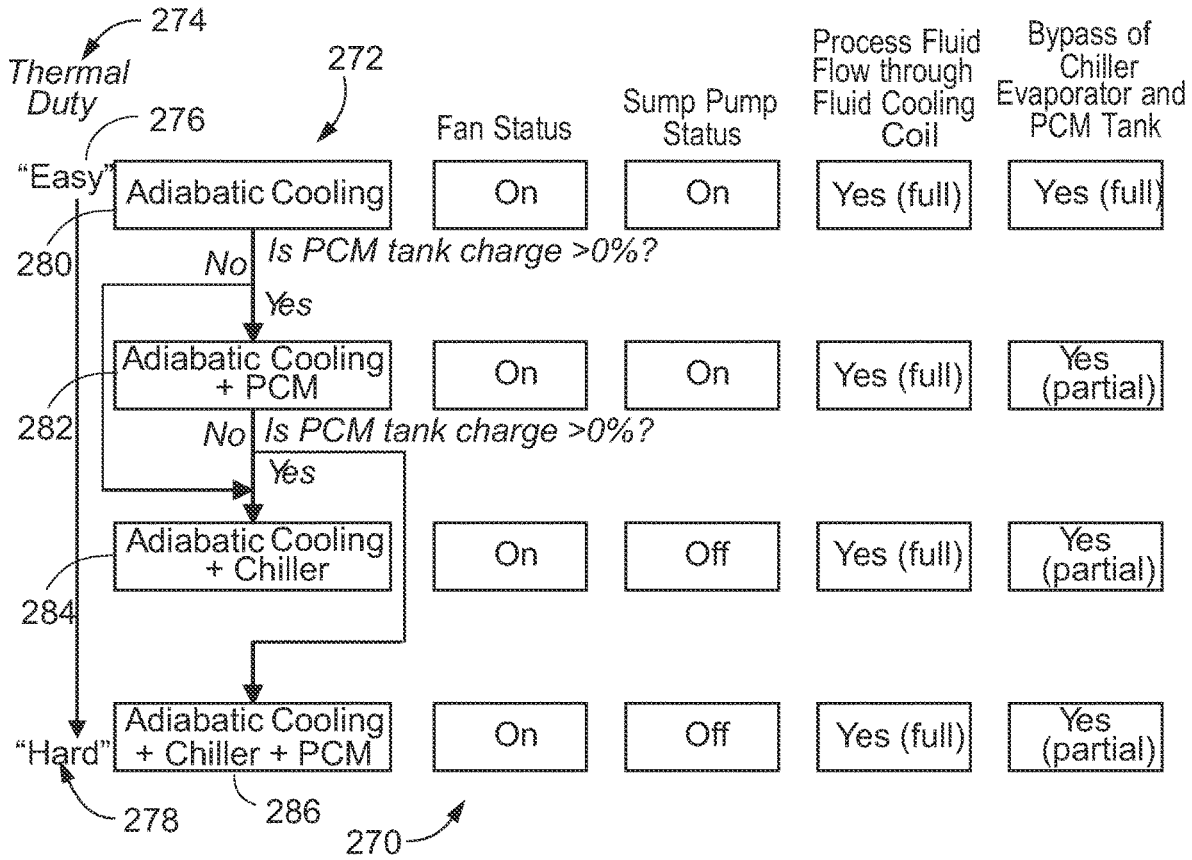
Figure 6A:
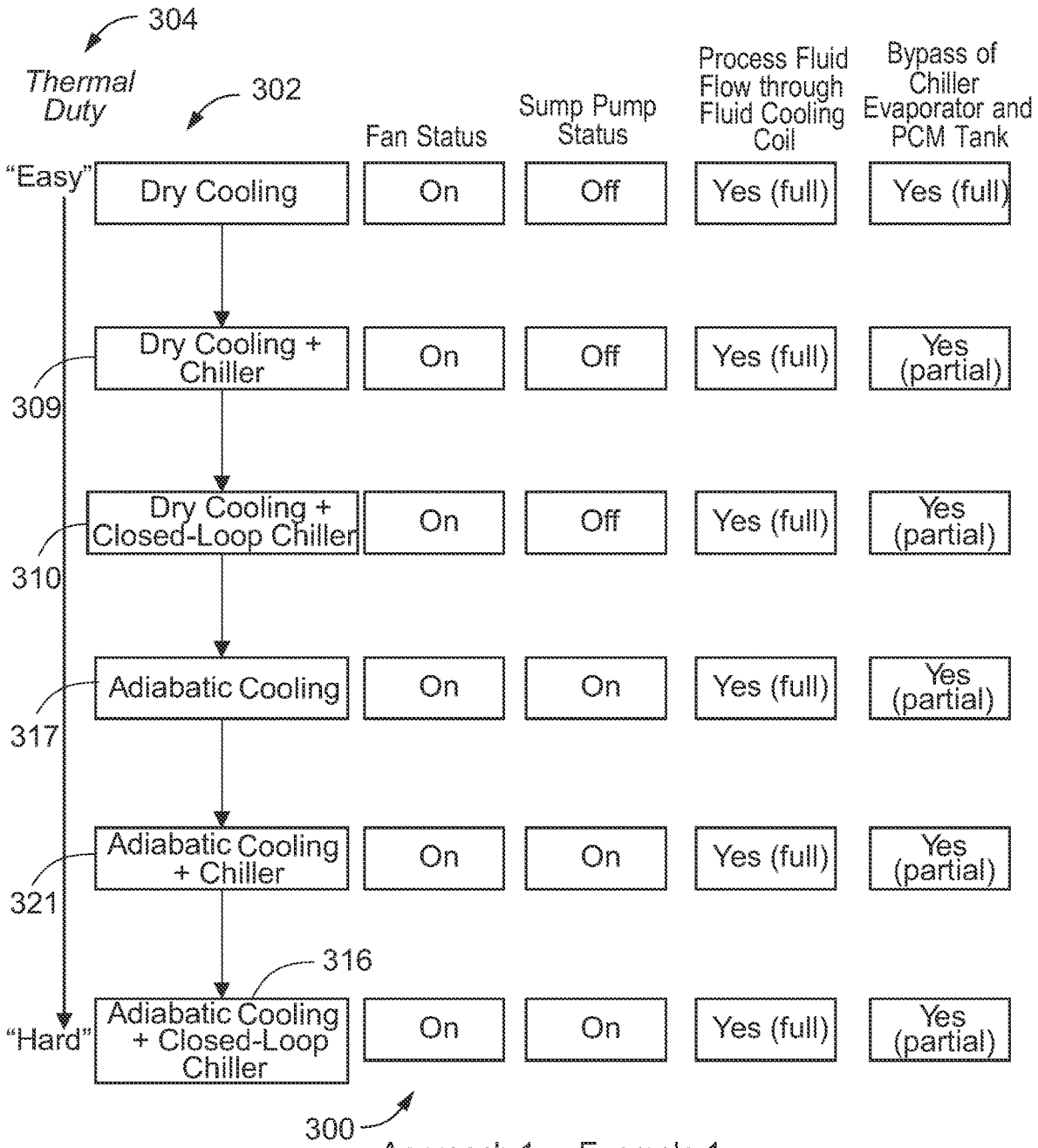
Figure 8:
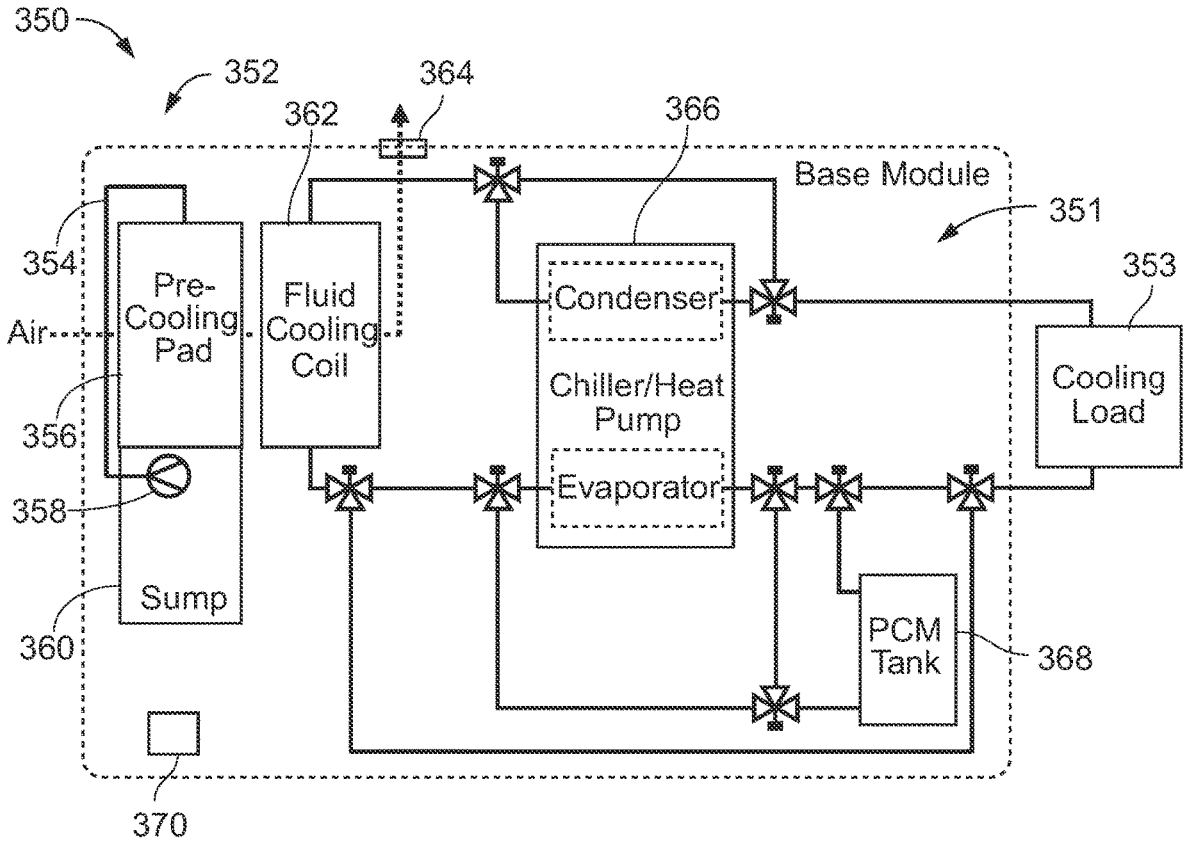
Figure 9A:
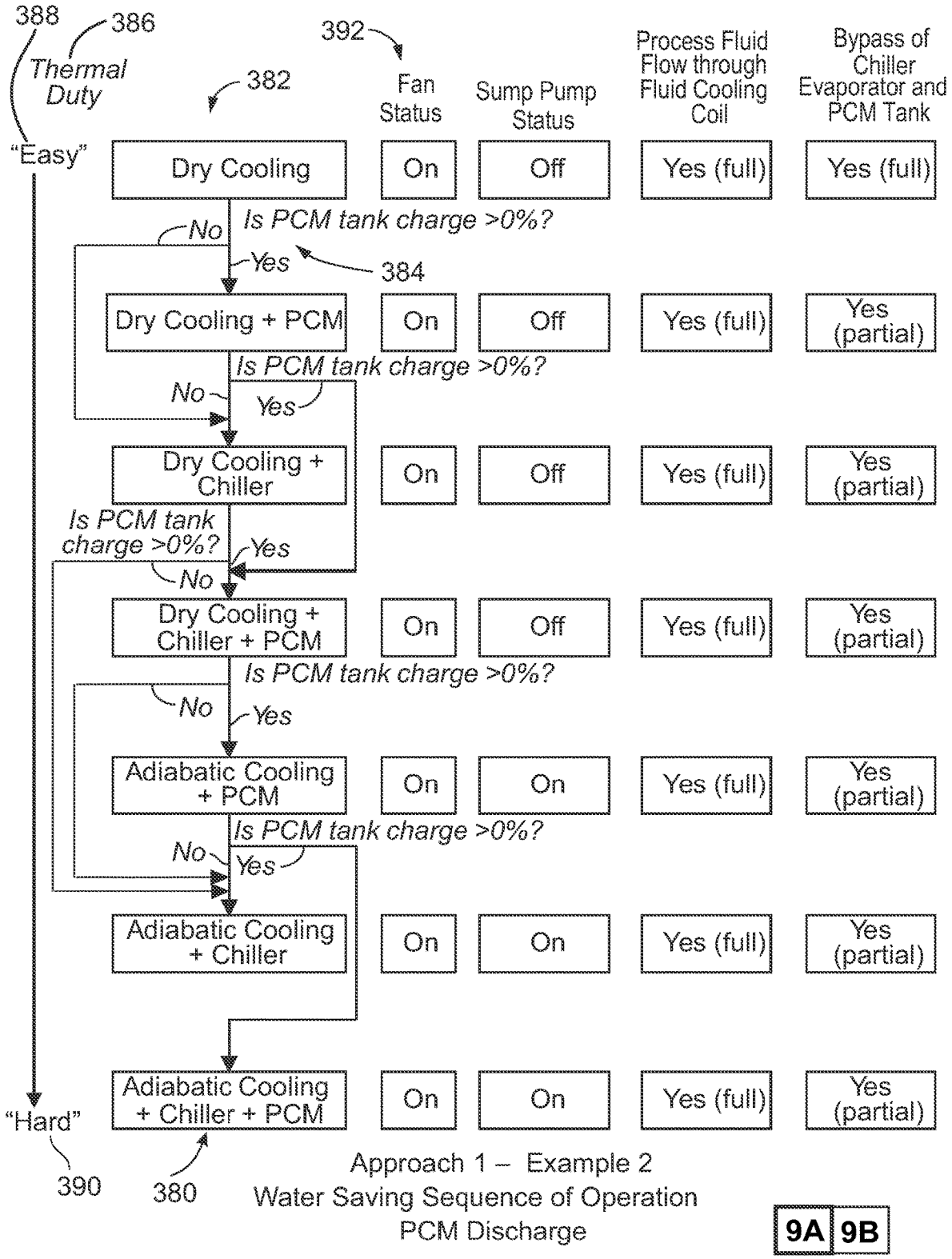
Figure 10A:
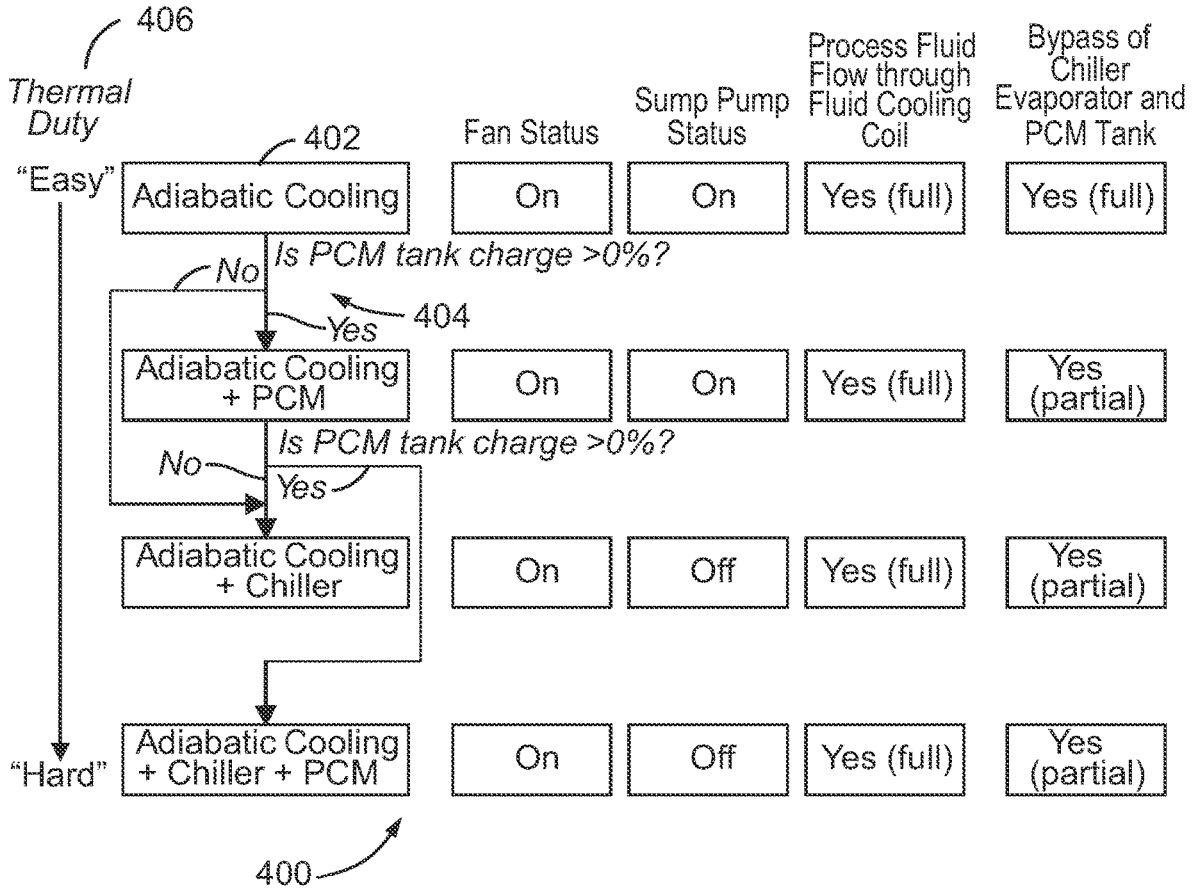
Figure 12A:
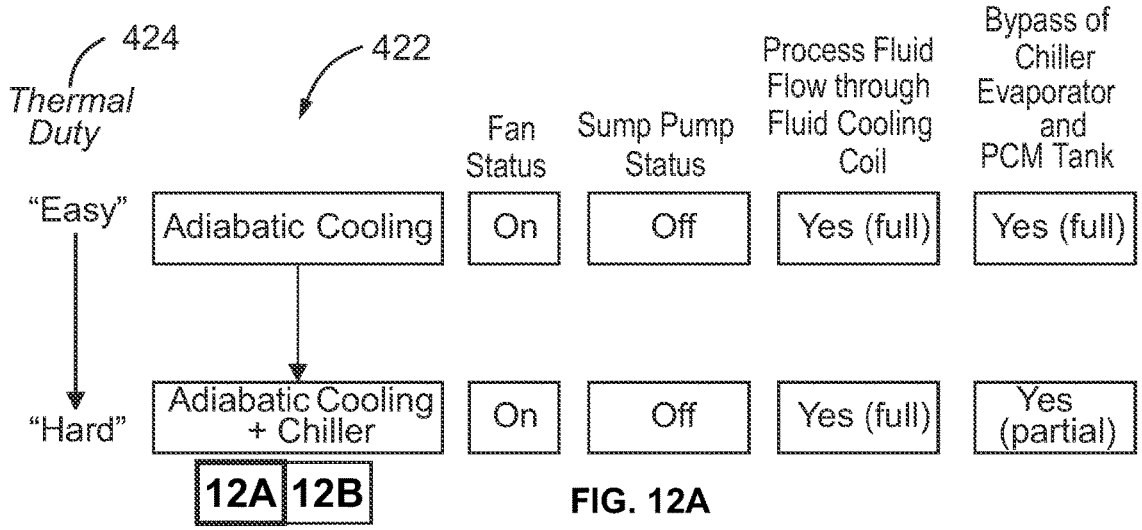
Figure 12B:
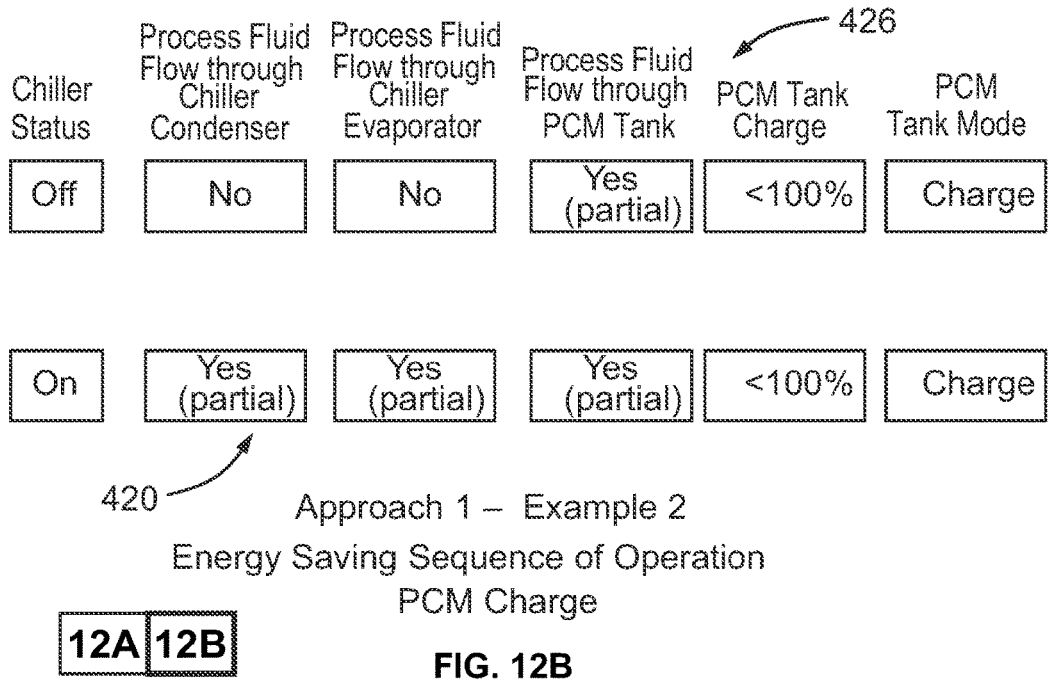
Figure 13:
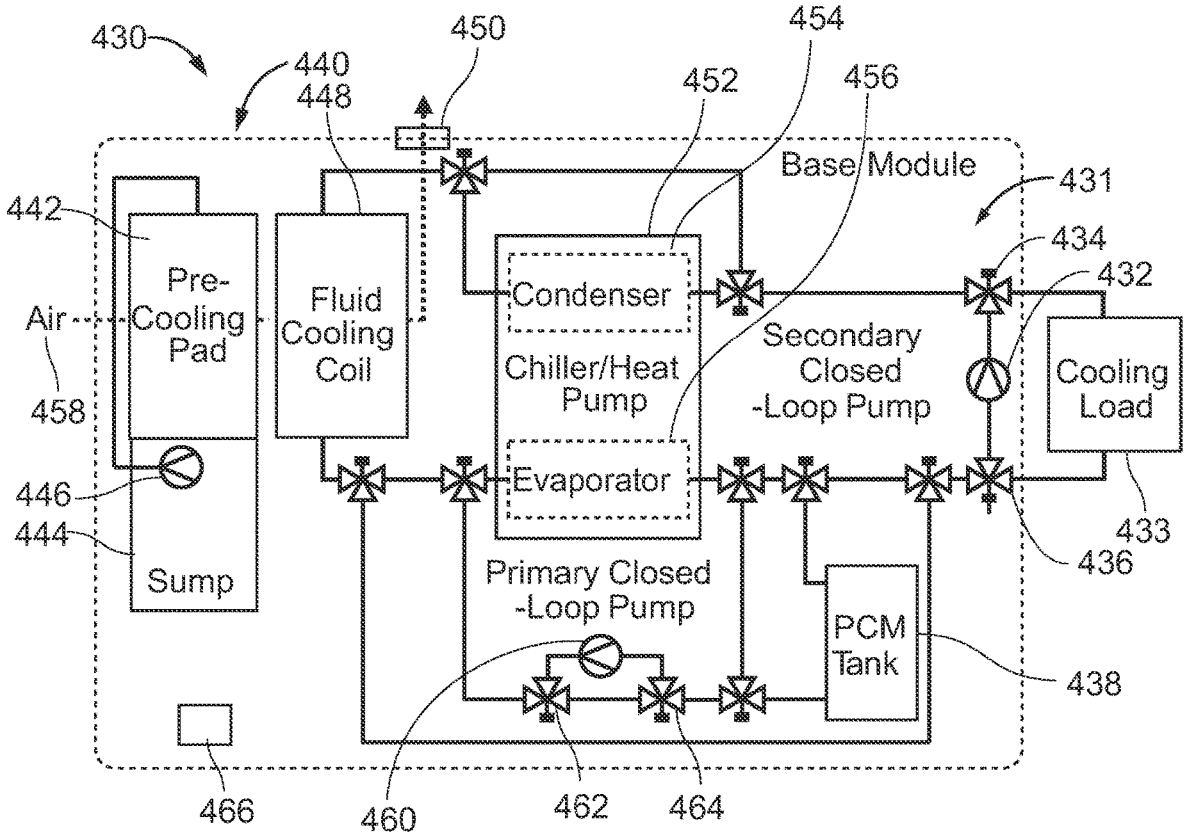
Figure 20A:
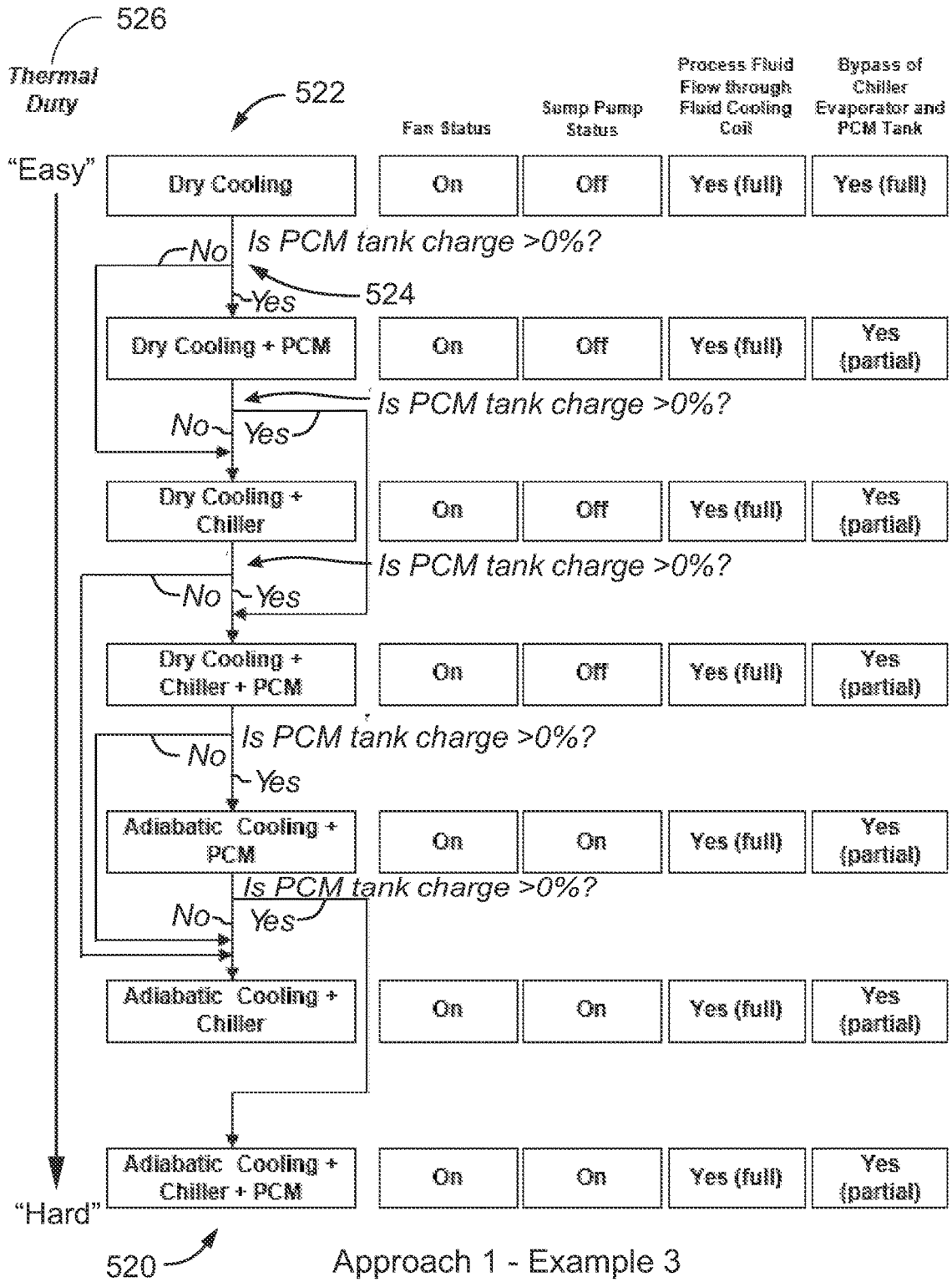
Figure 24:
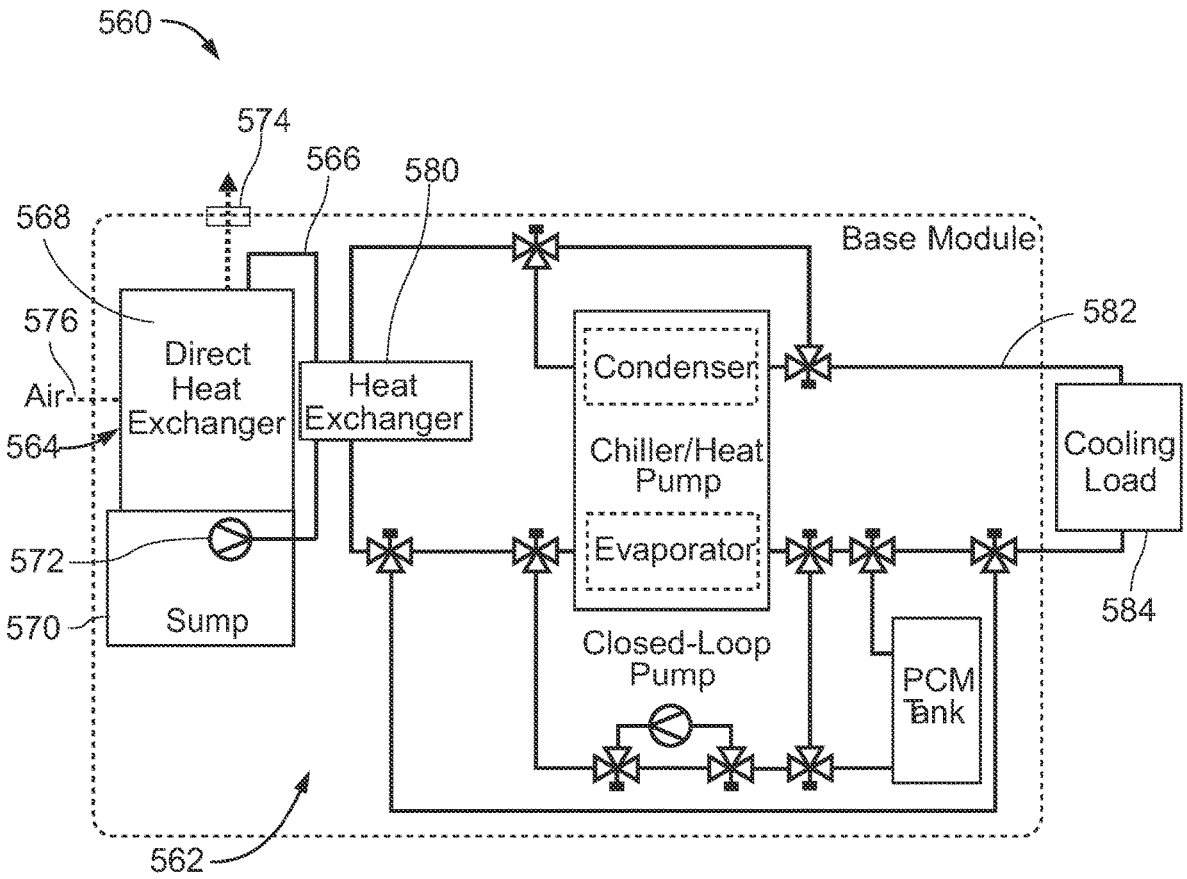
Figure 25:
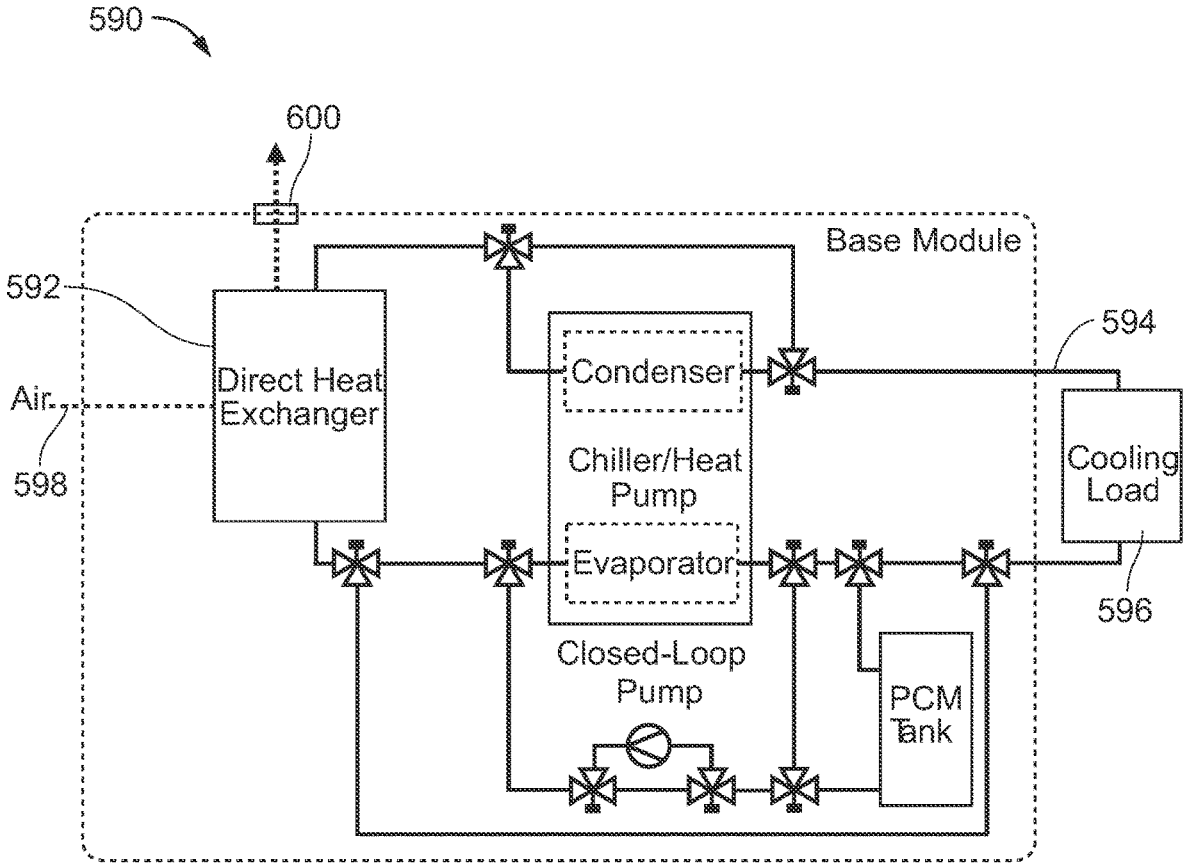
Figure 26:
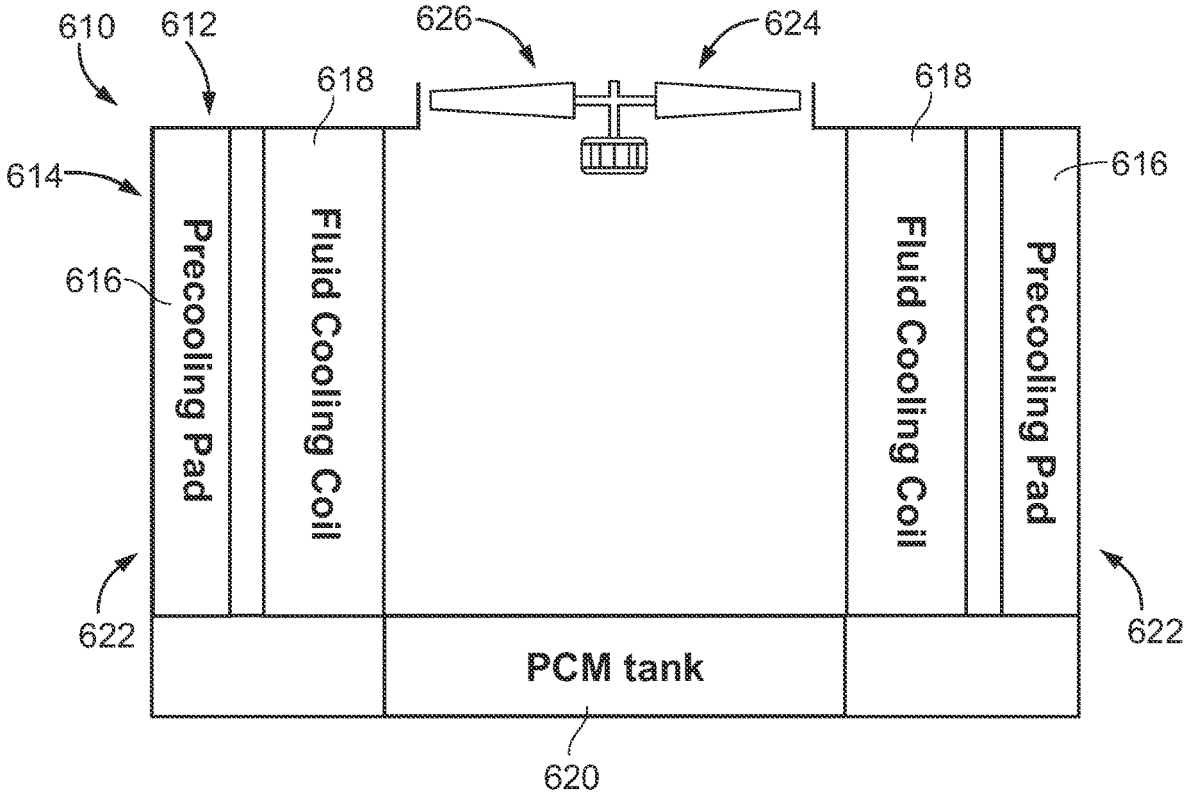
Figure 27:
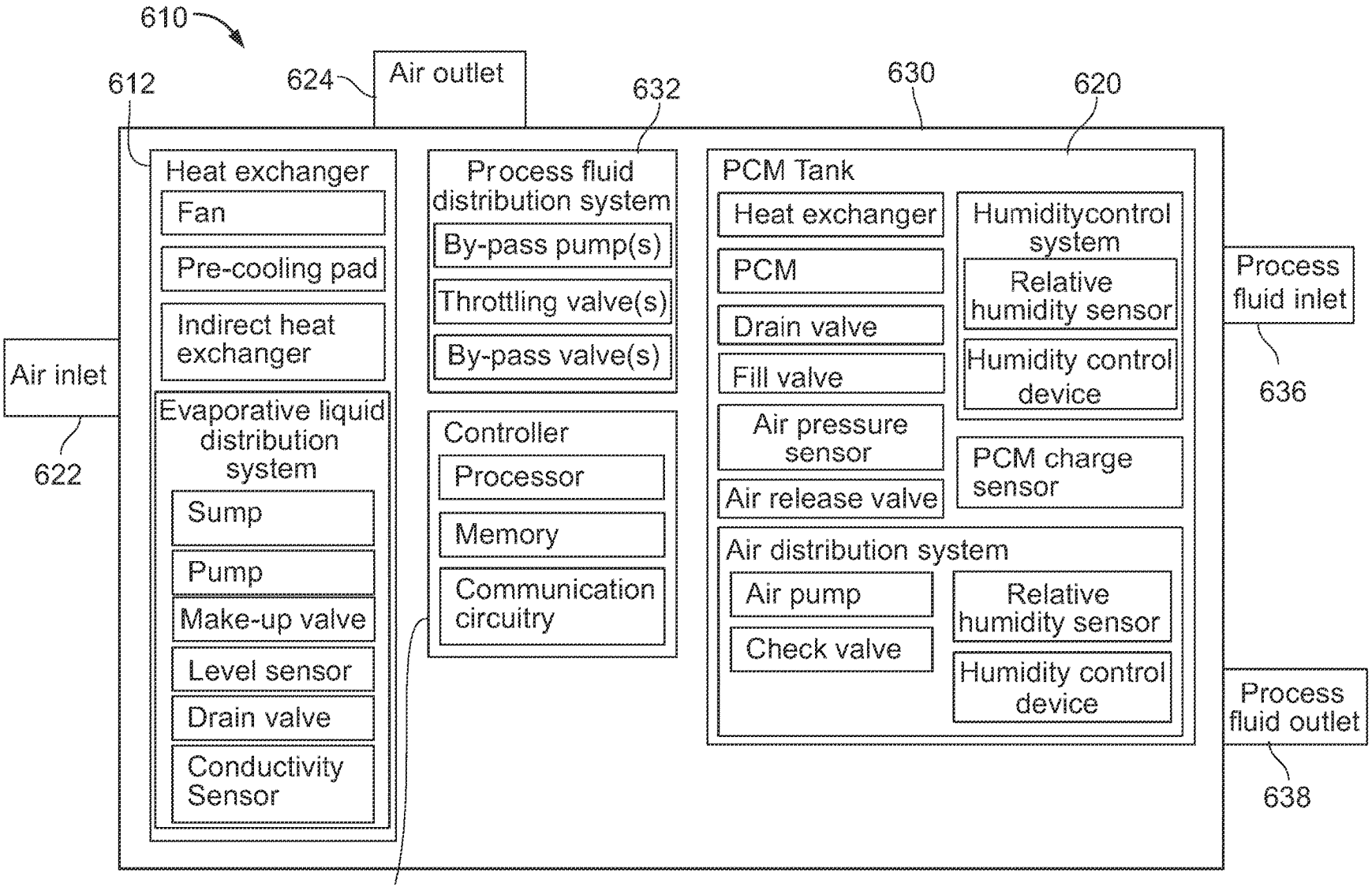
Figure 28:
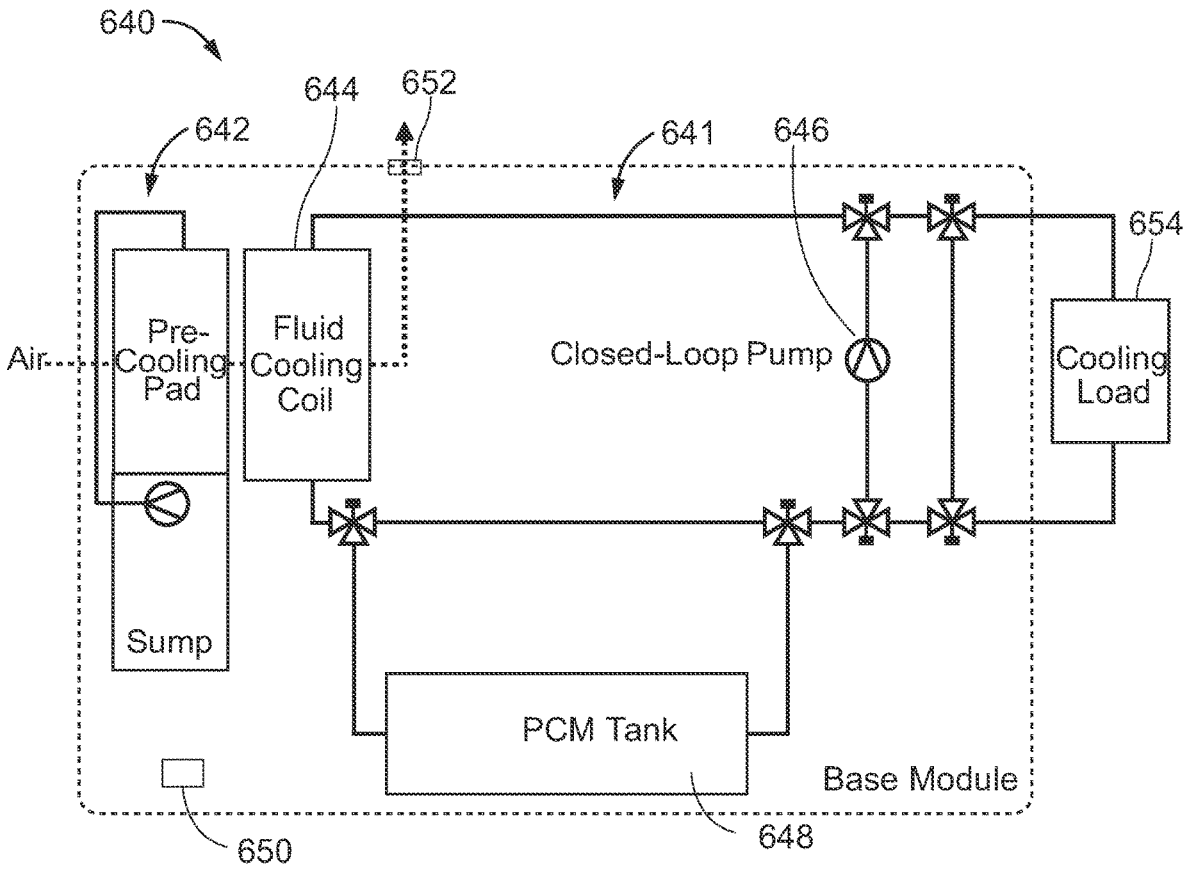
Figure 33:
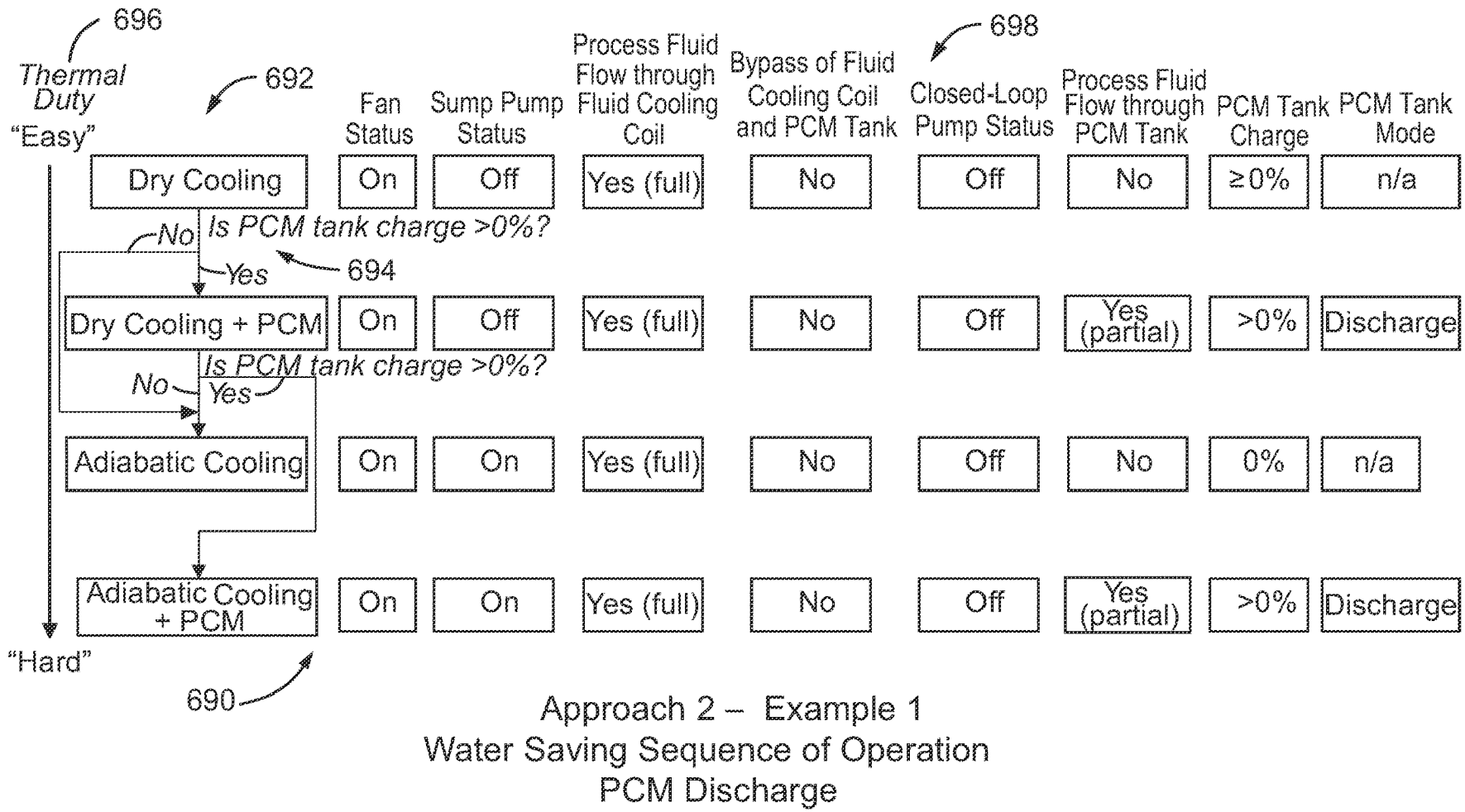
Figure 34:
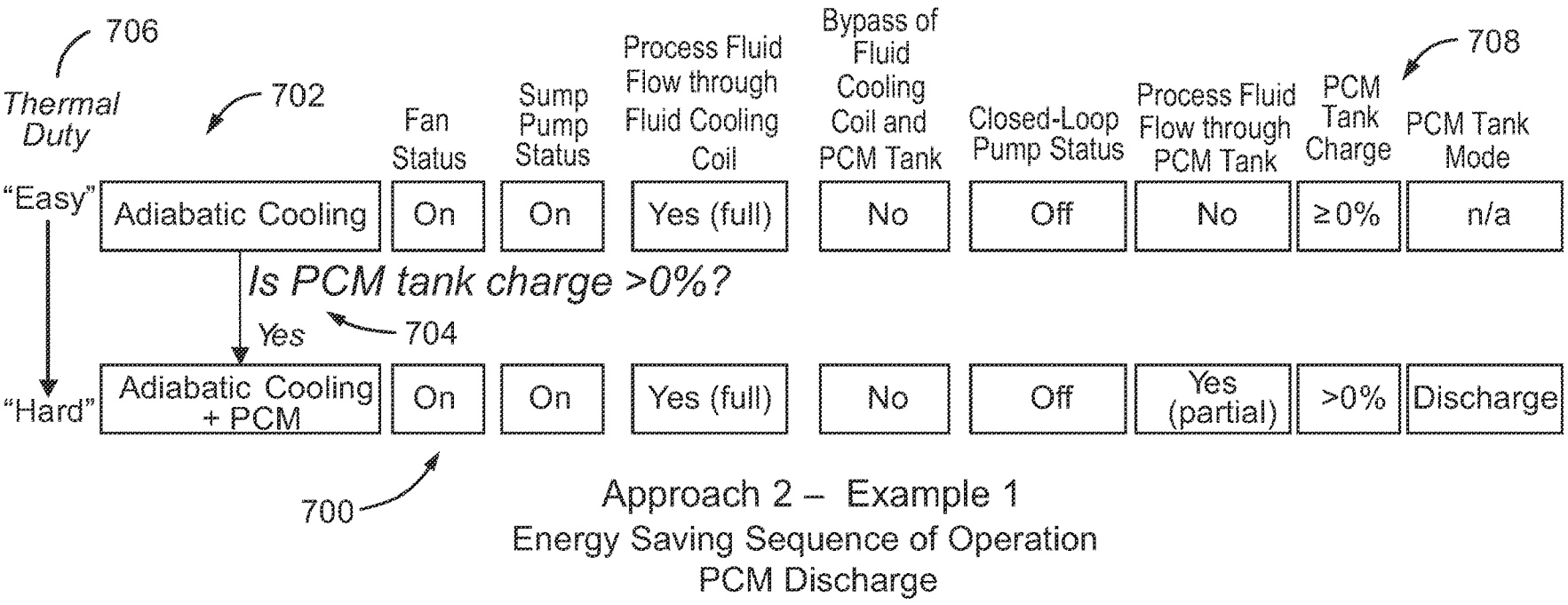
Figure 35:
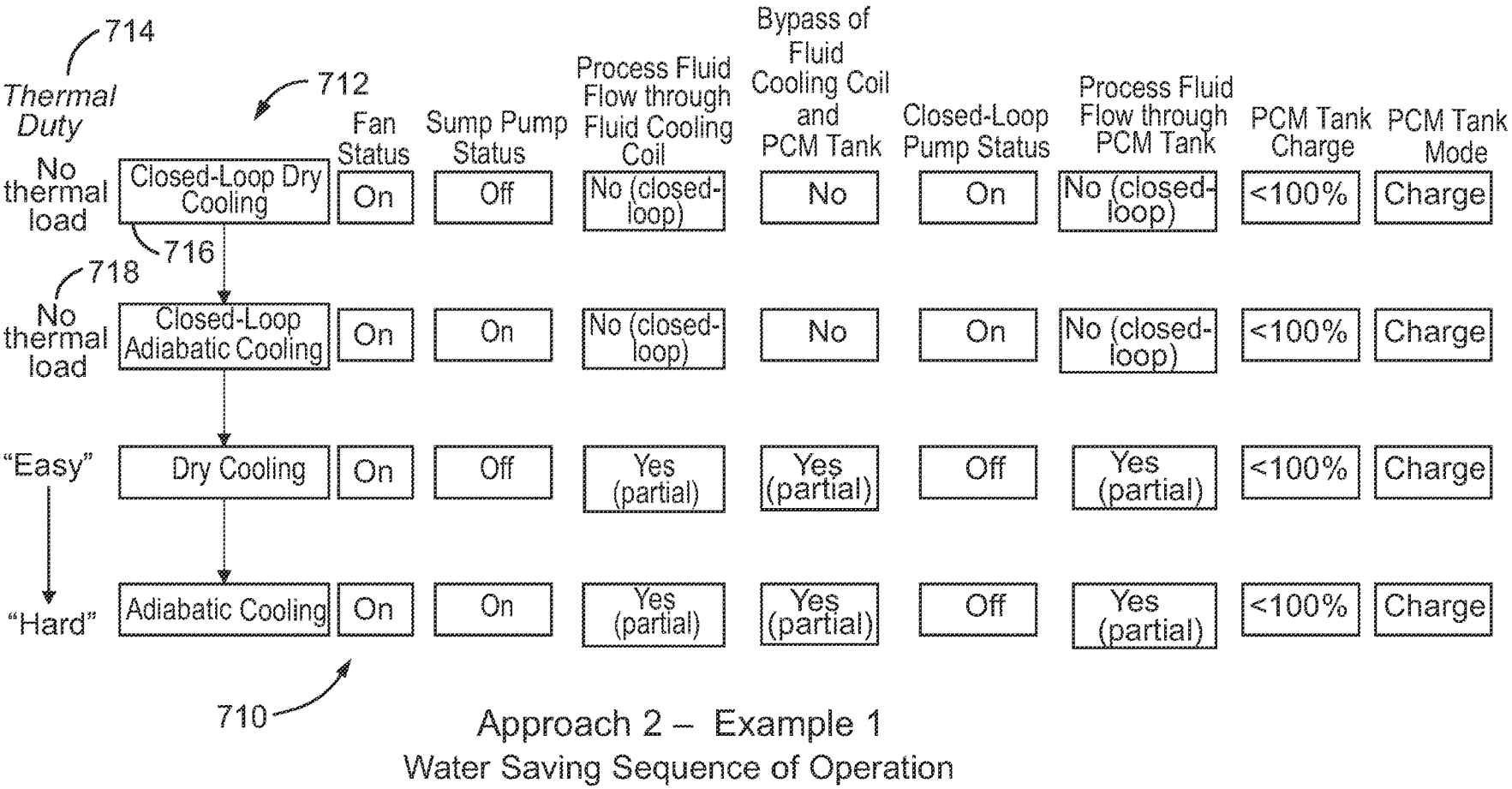
Figure 36:
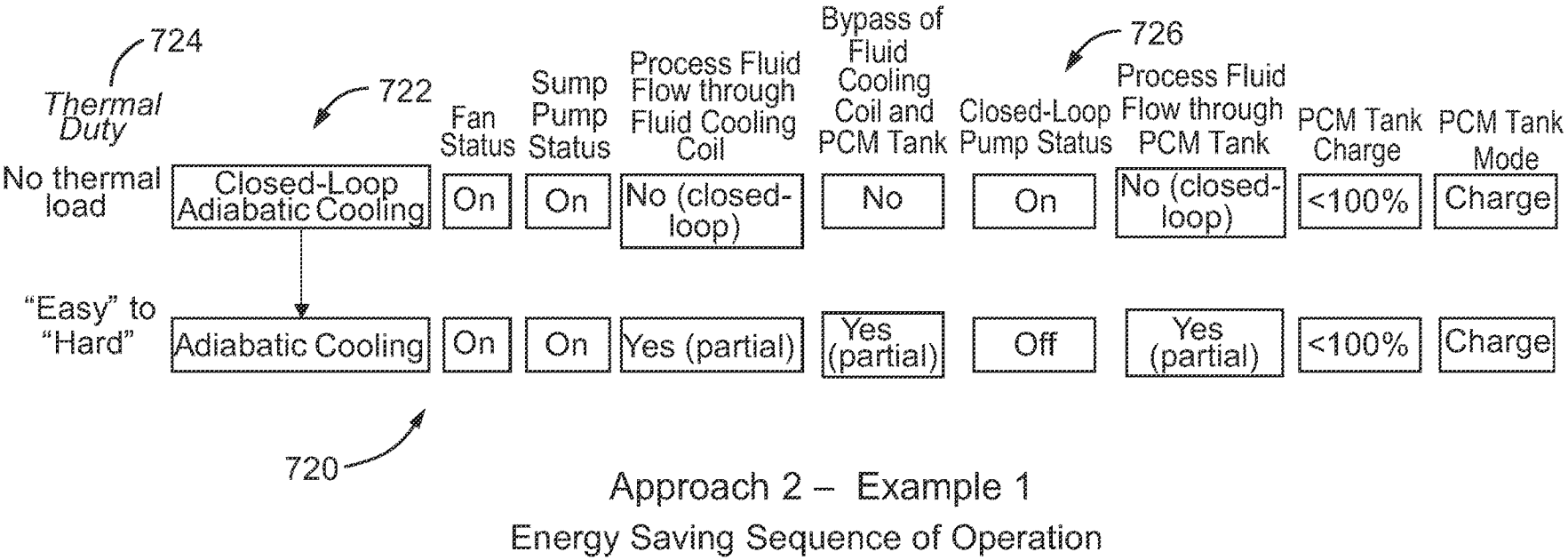
Figure 37:
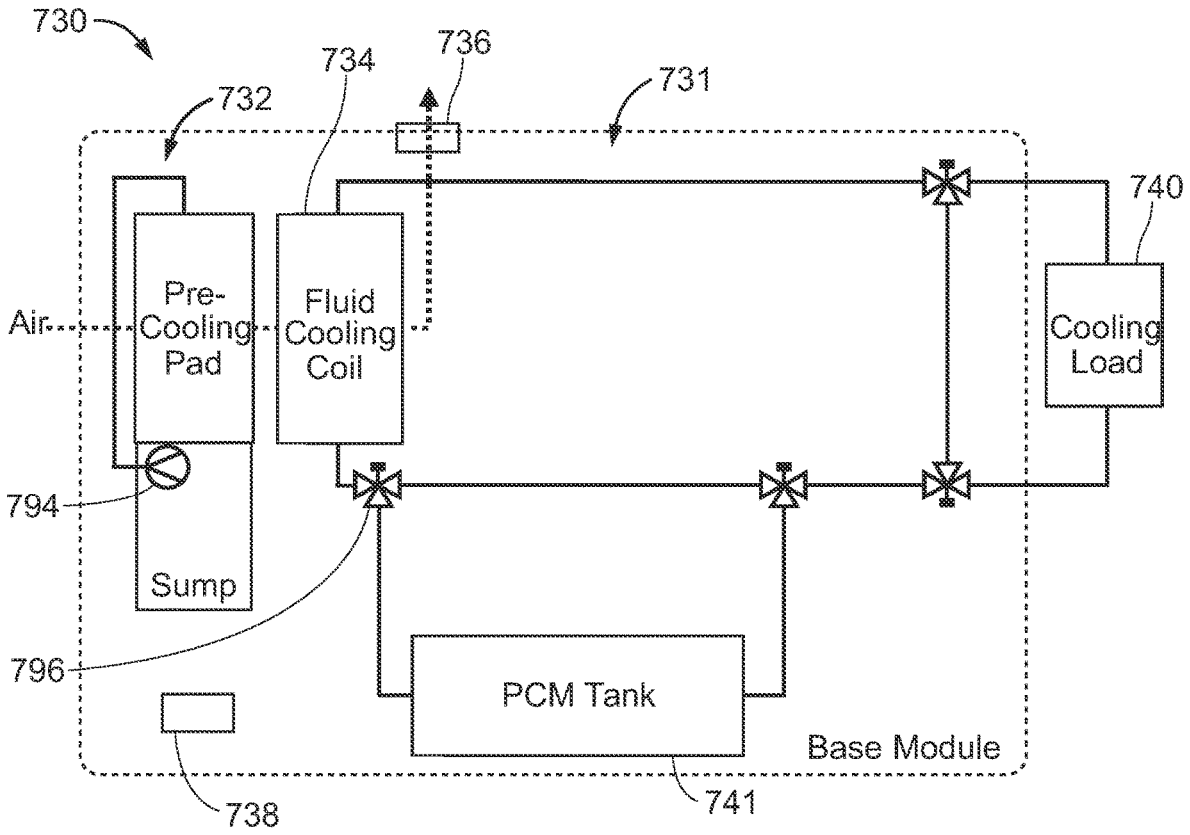
Figure 38:
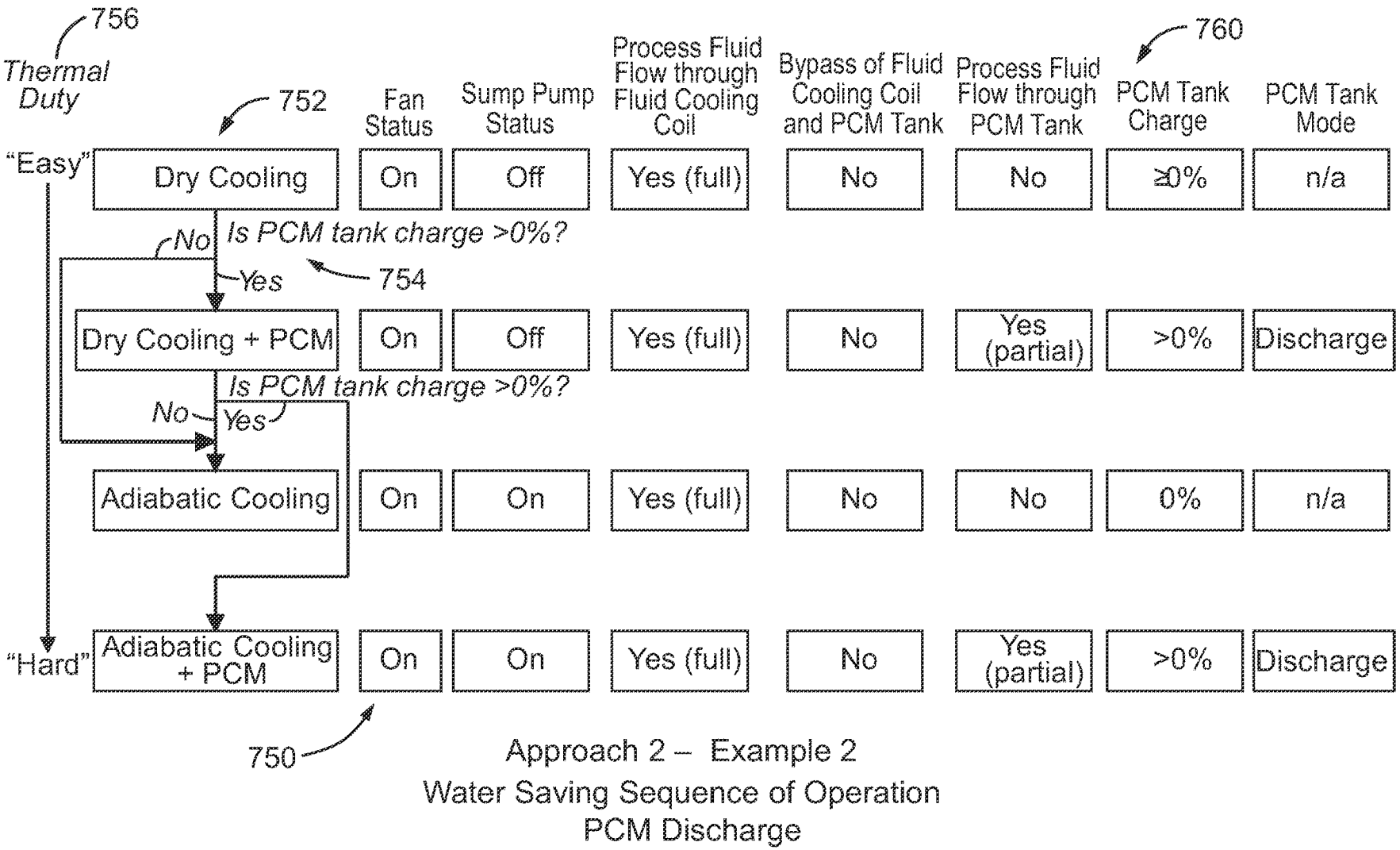
Figure 39:
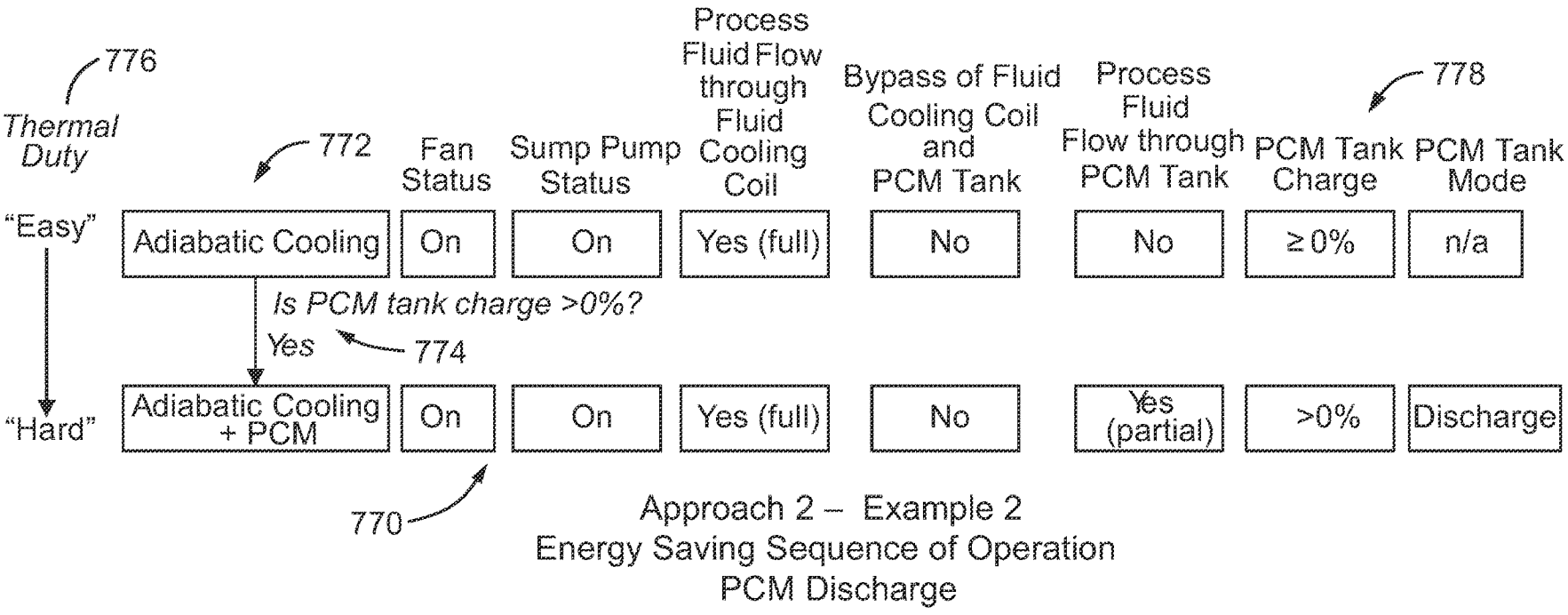
Figure 40:
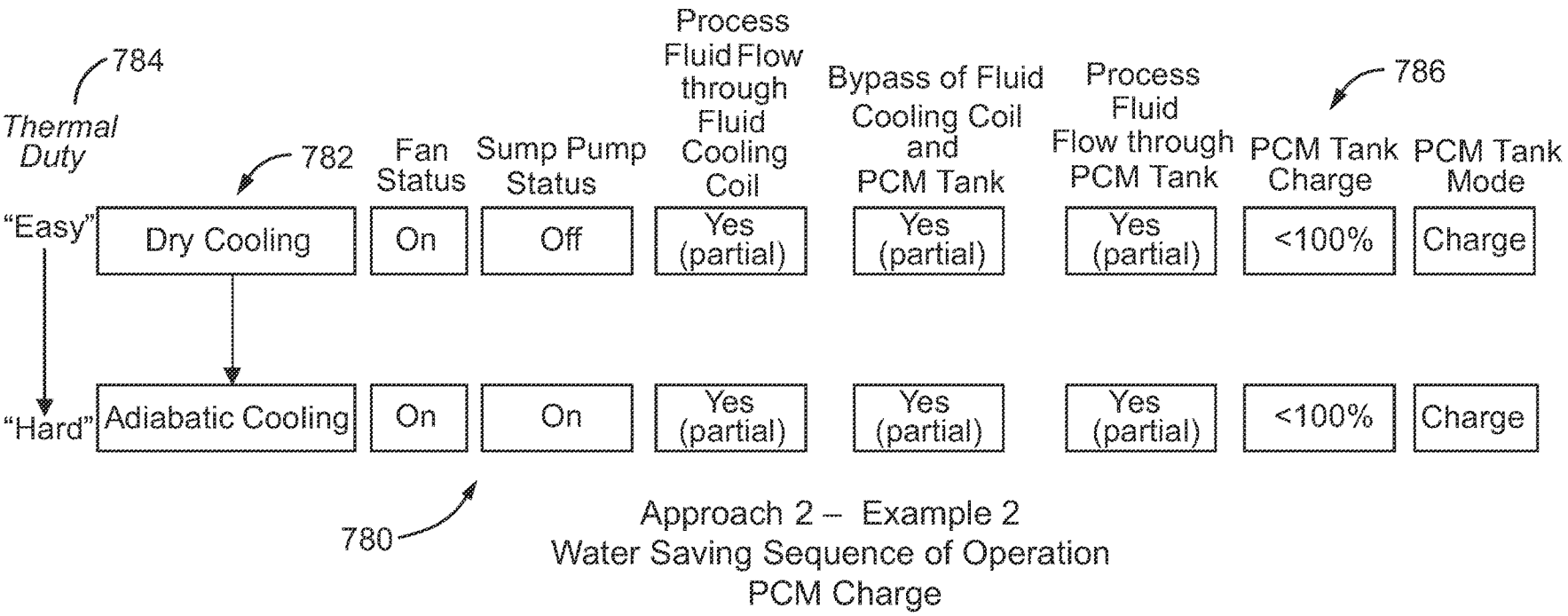
Figure 41:
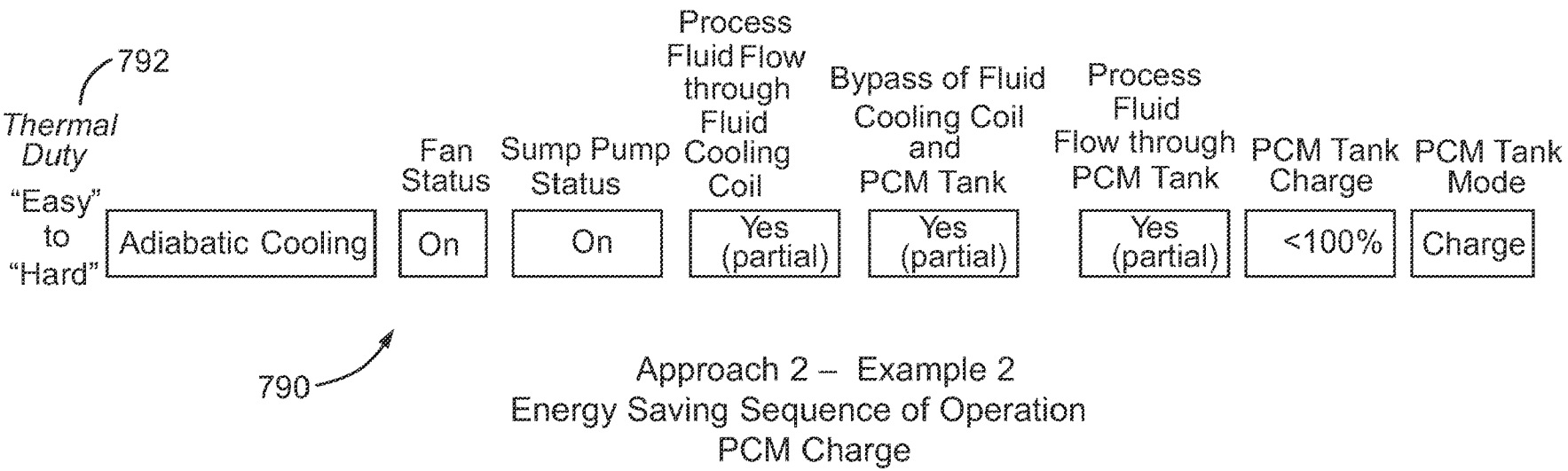
Figure 42:
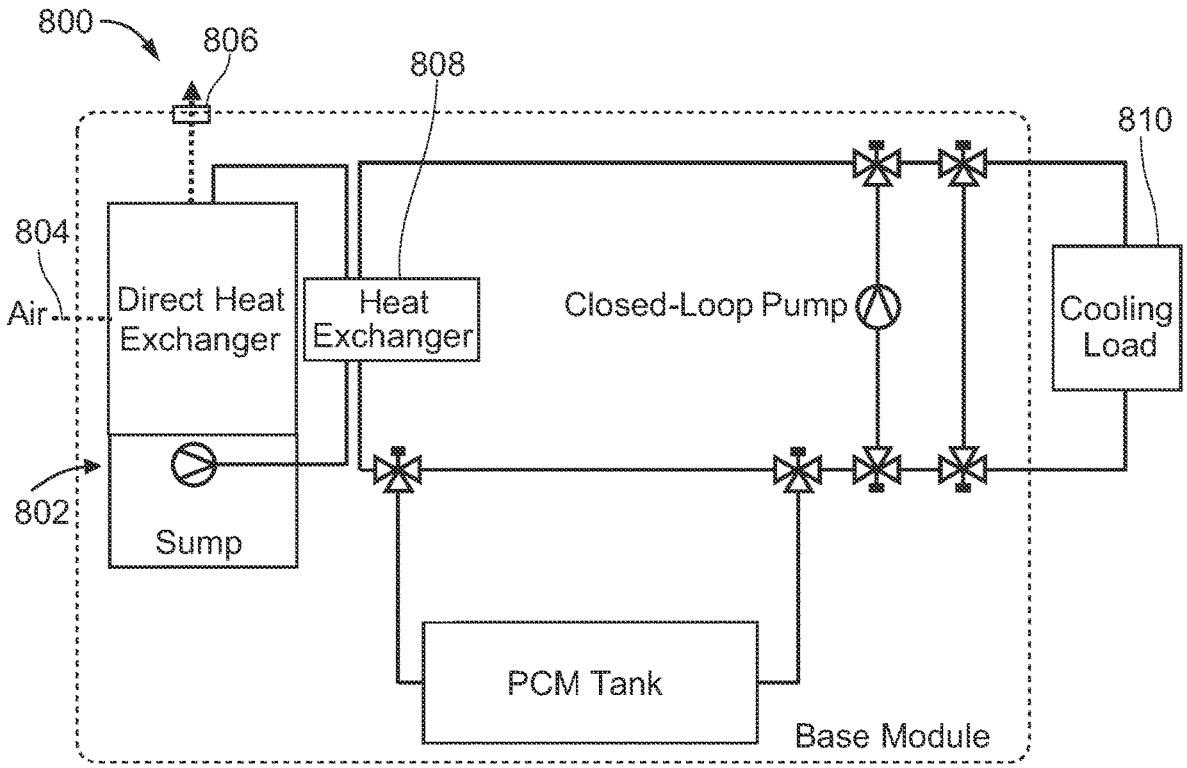
Figure 43:
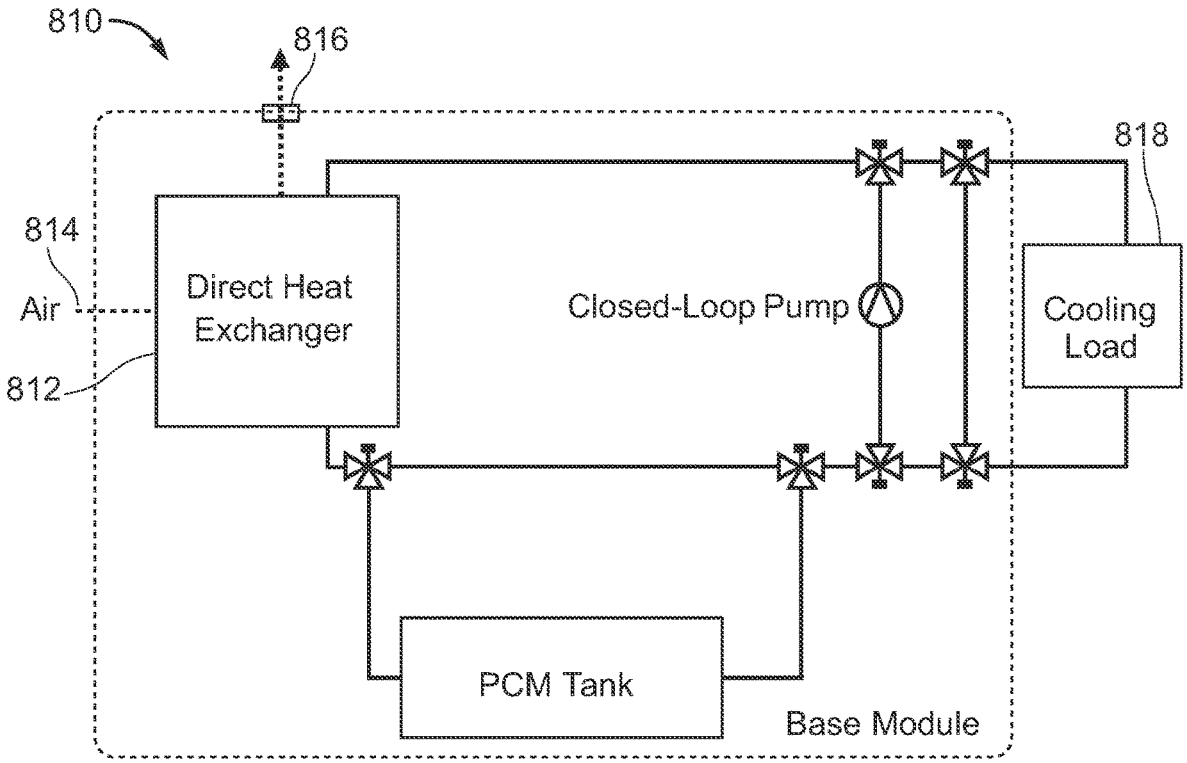
Figure 44:
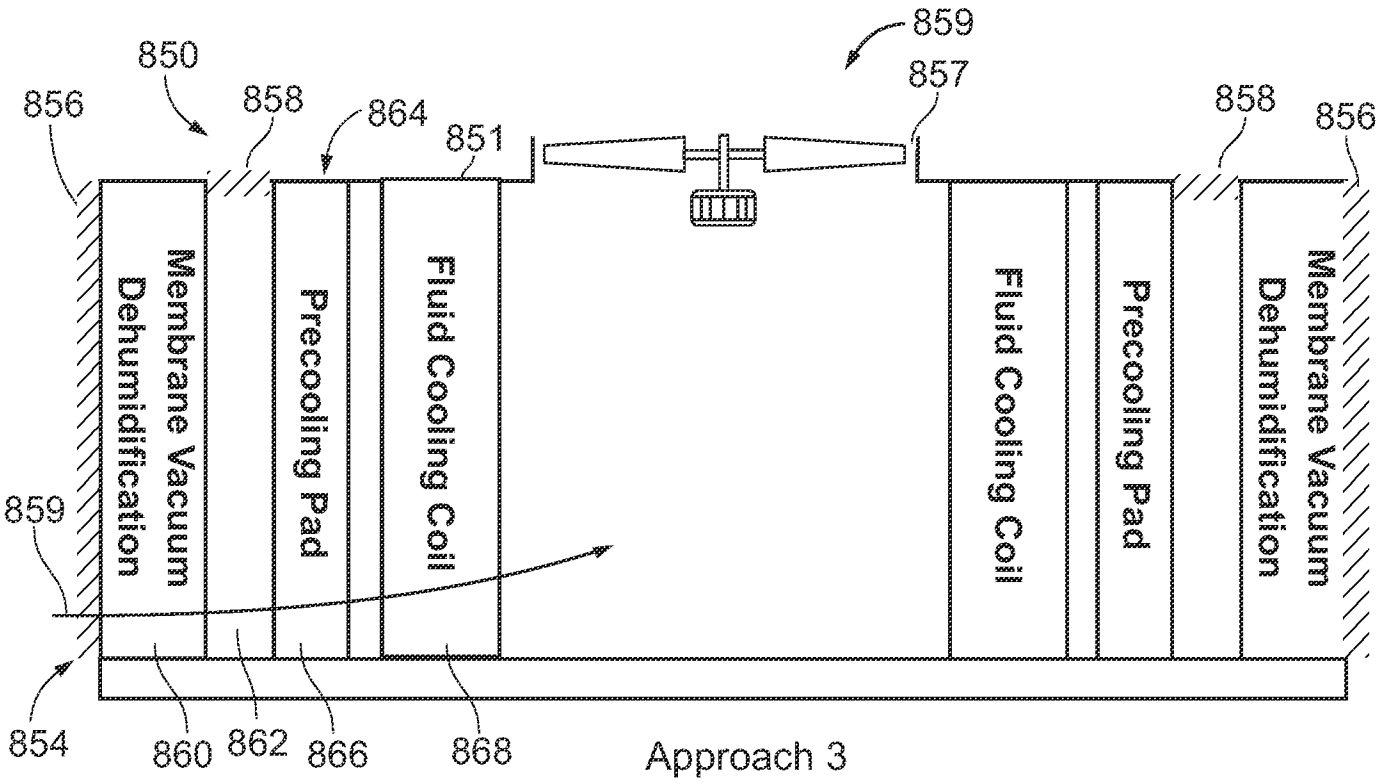
Figure 45:
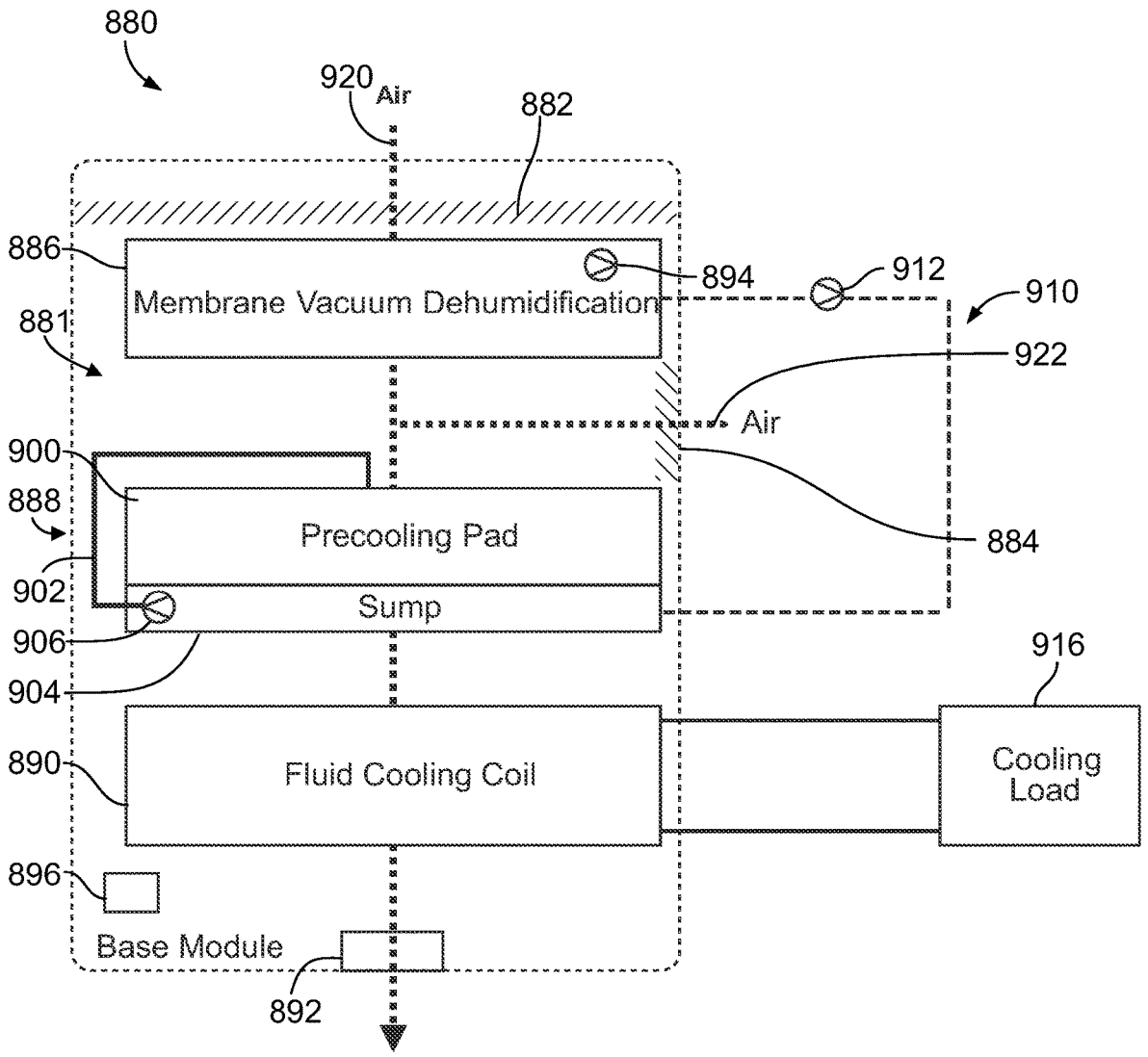
Figure 46:
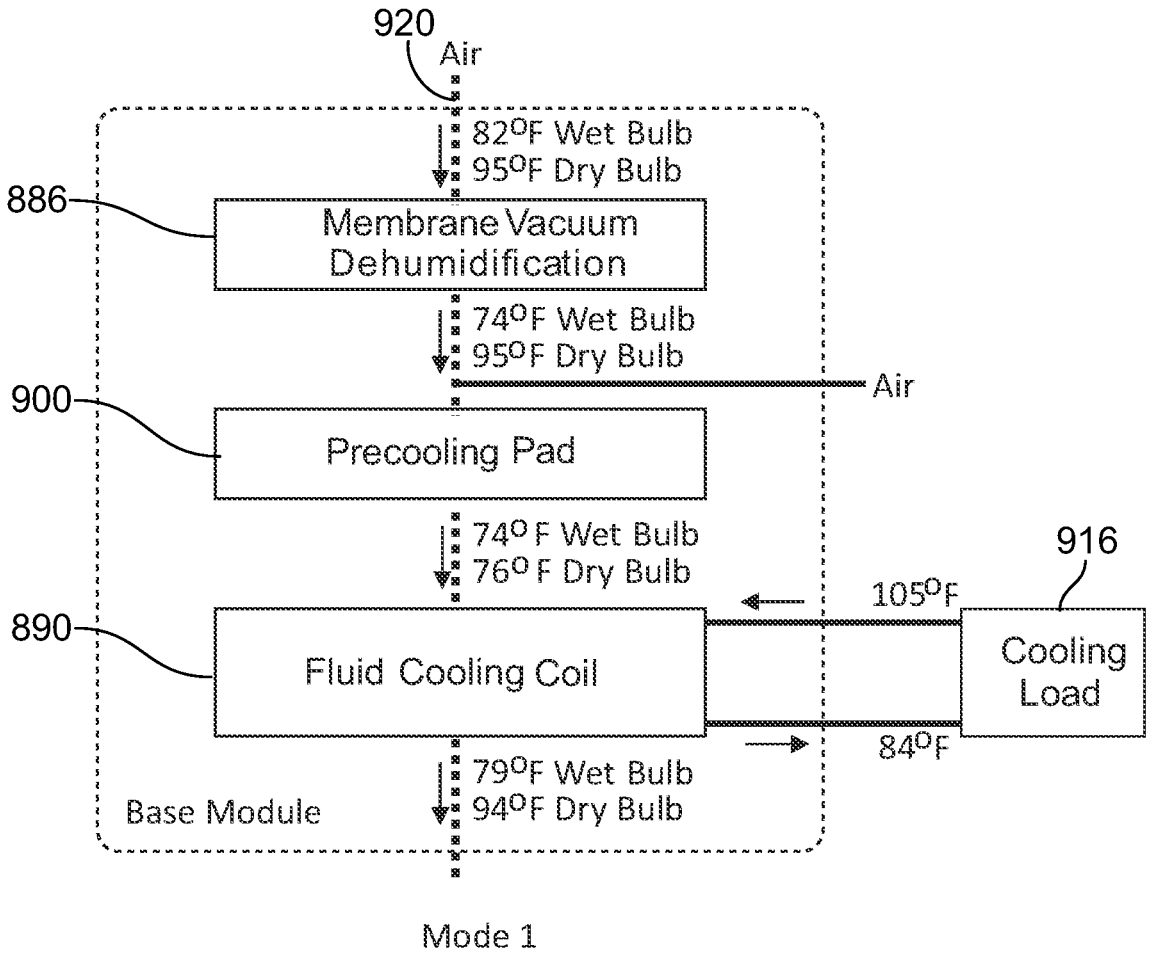
Figure 50:
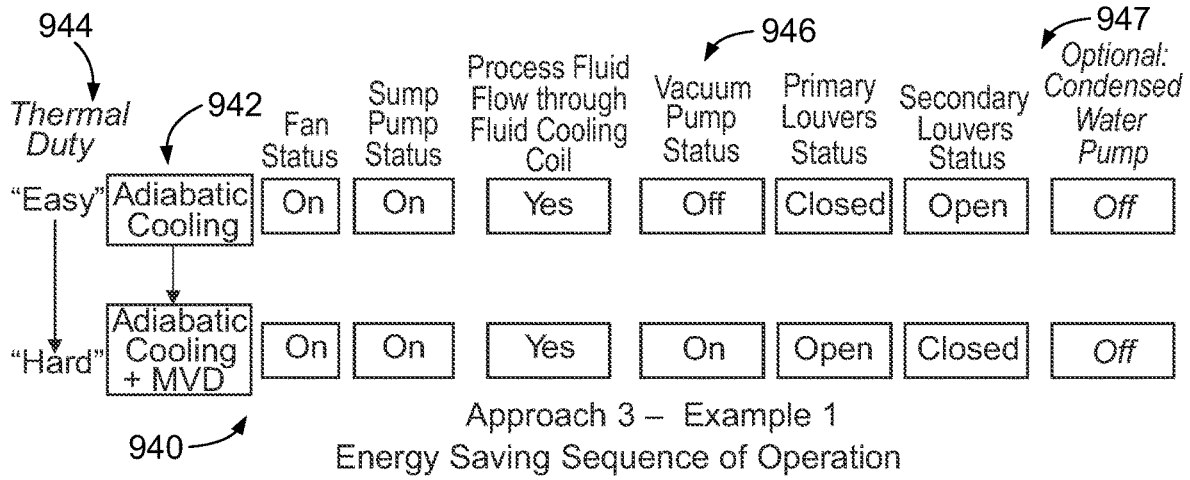
Figure 51:
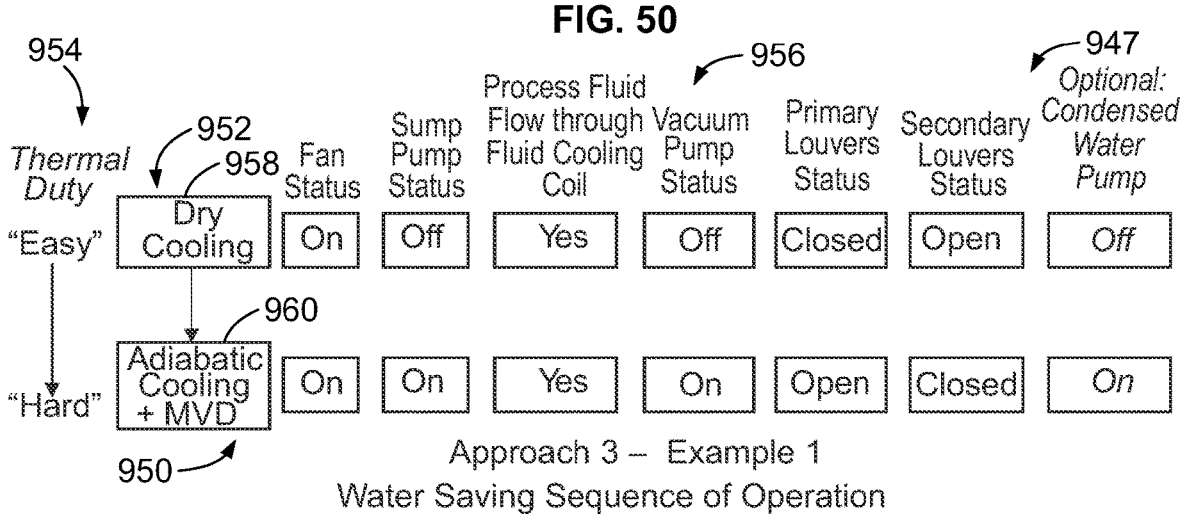
Figure 52:
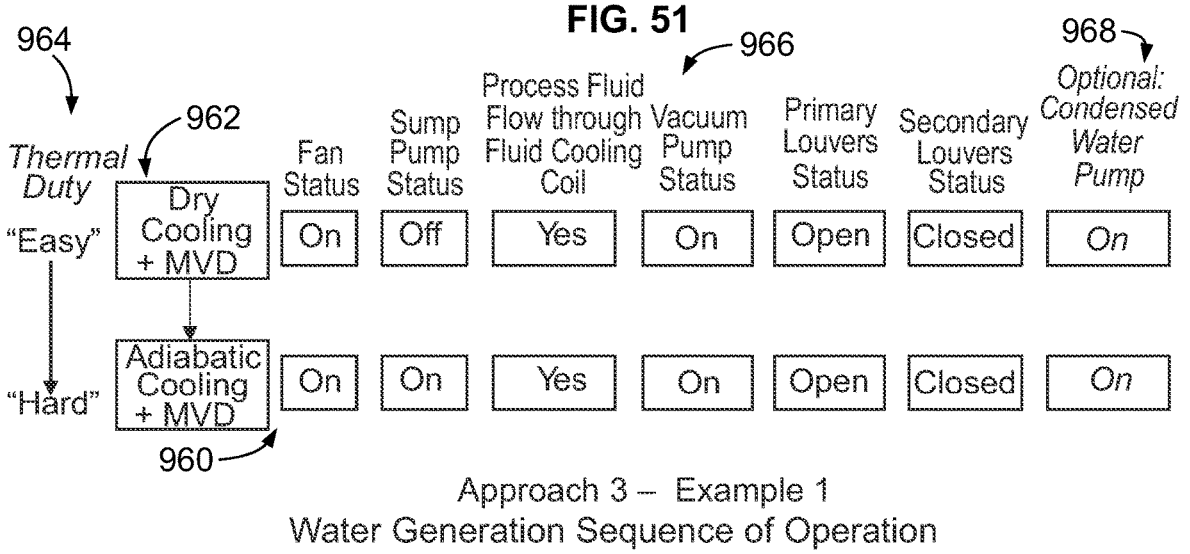
Figure 53:
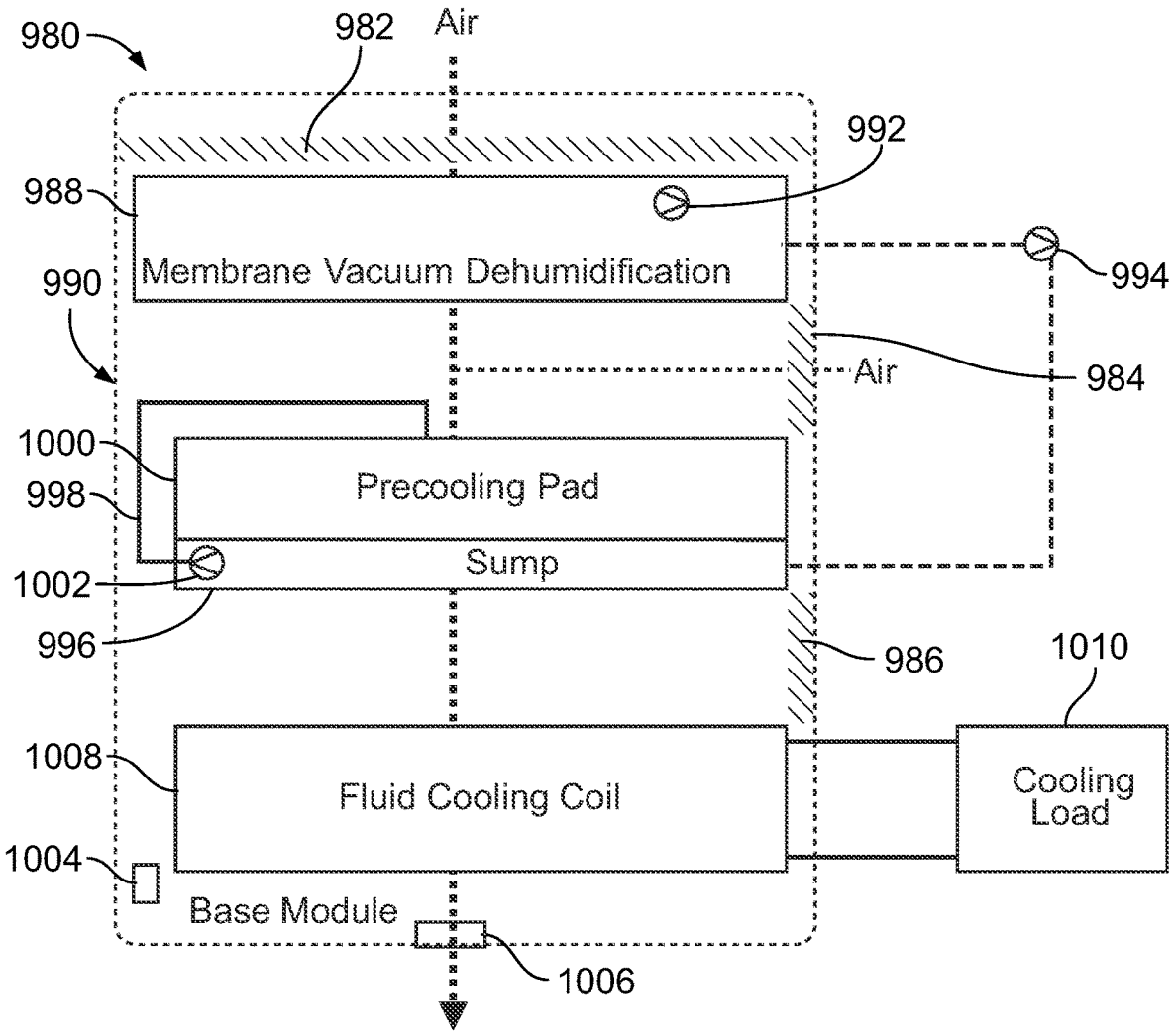
Figure 54:
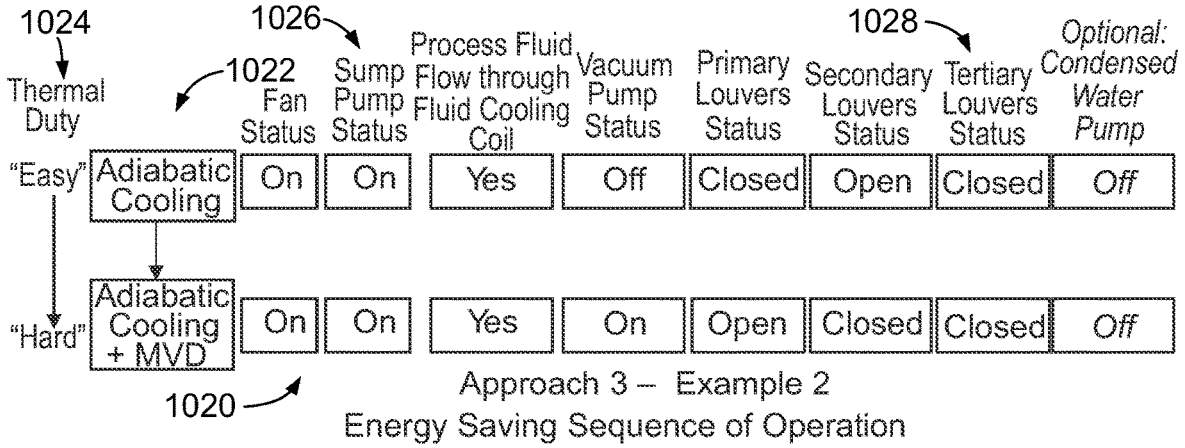
Figure 55:
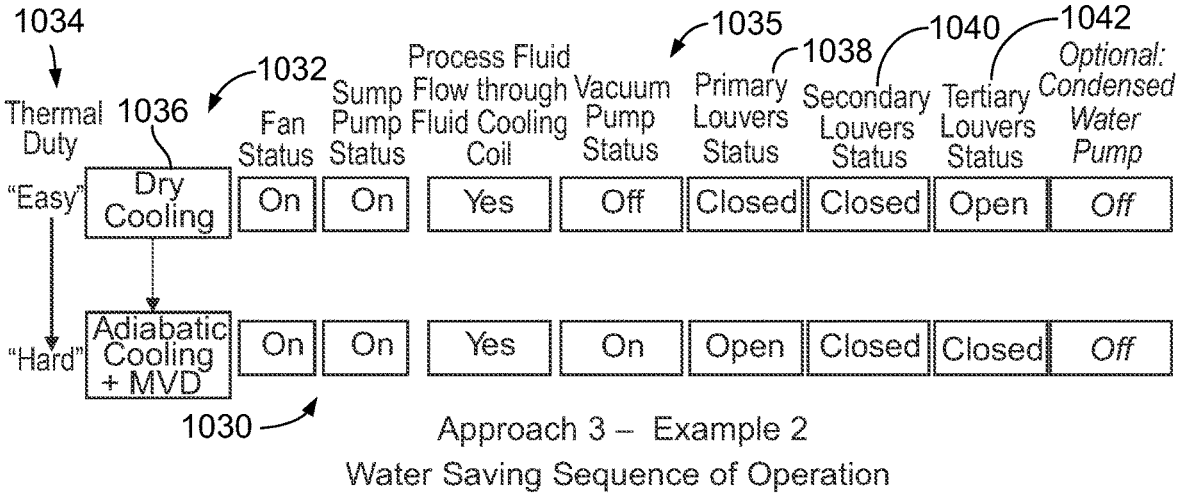
Figure 56:
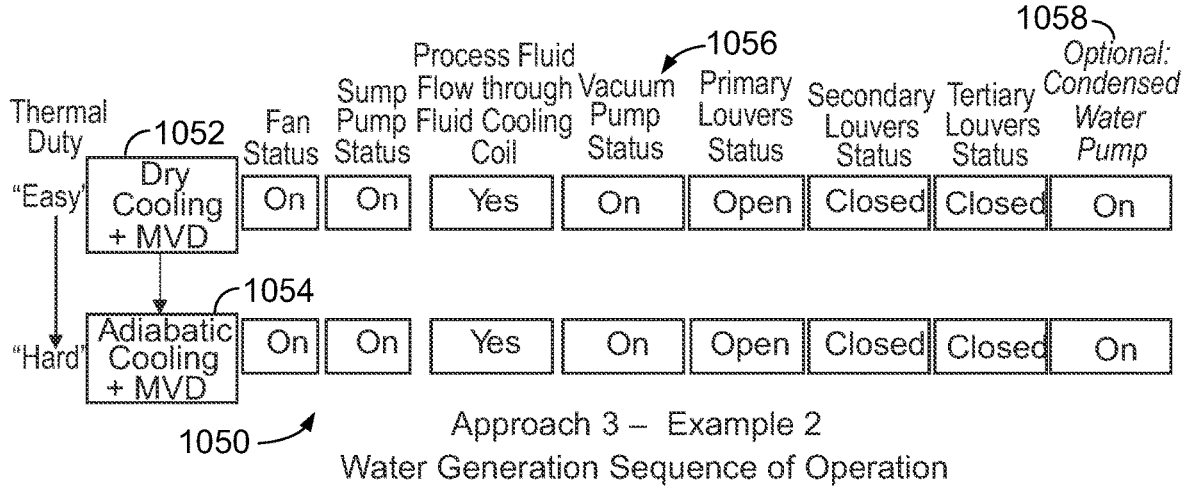
Figure 57:
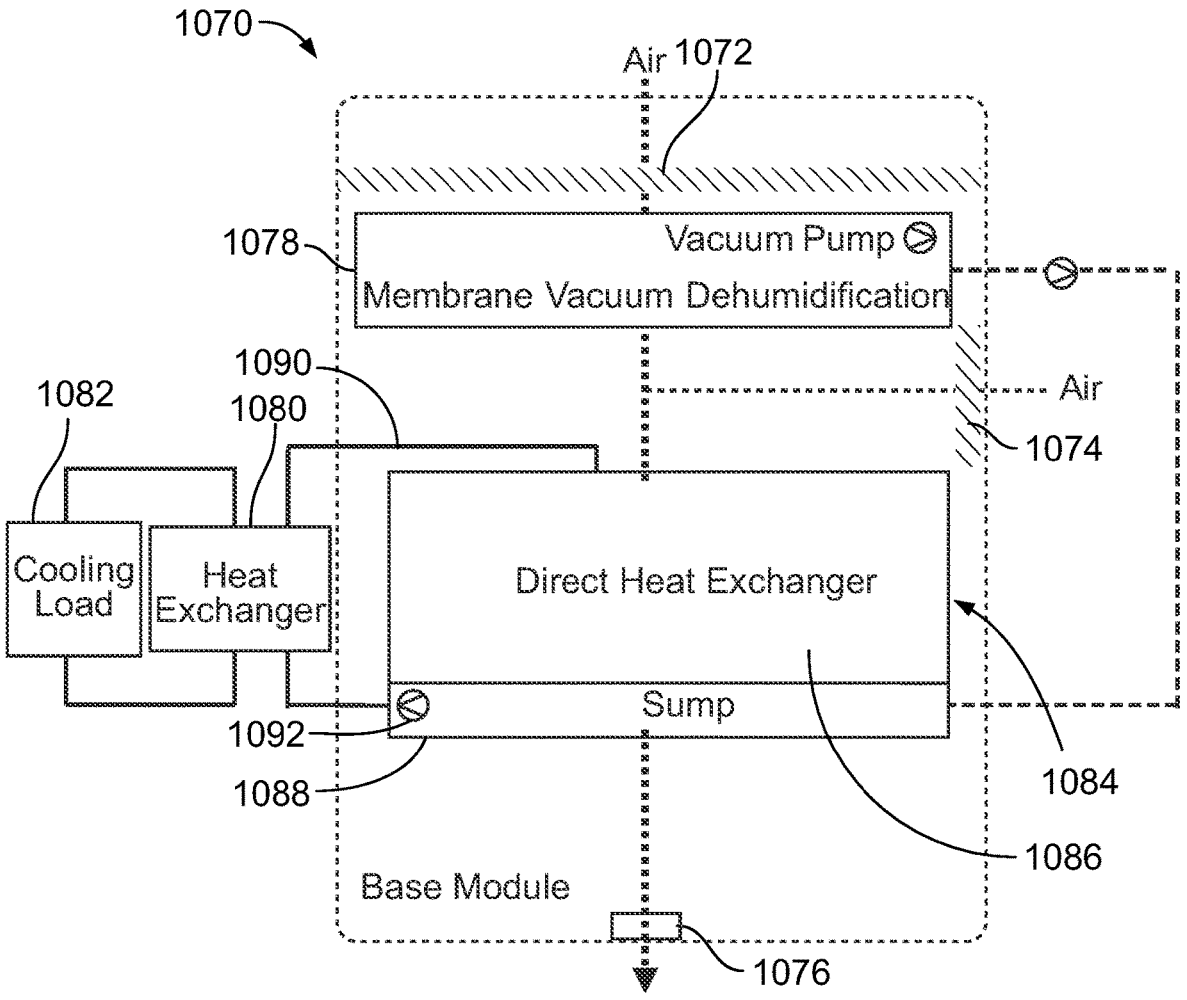
Figure 58:
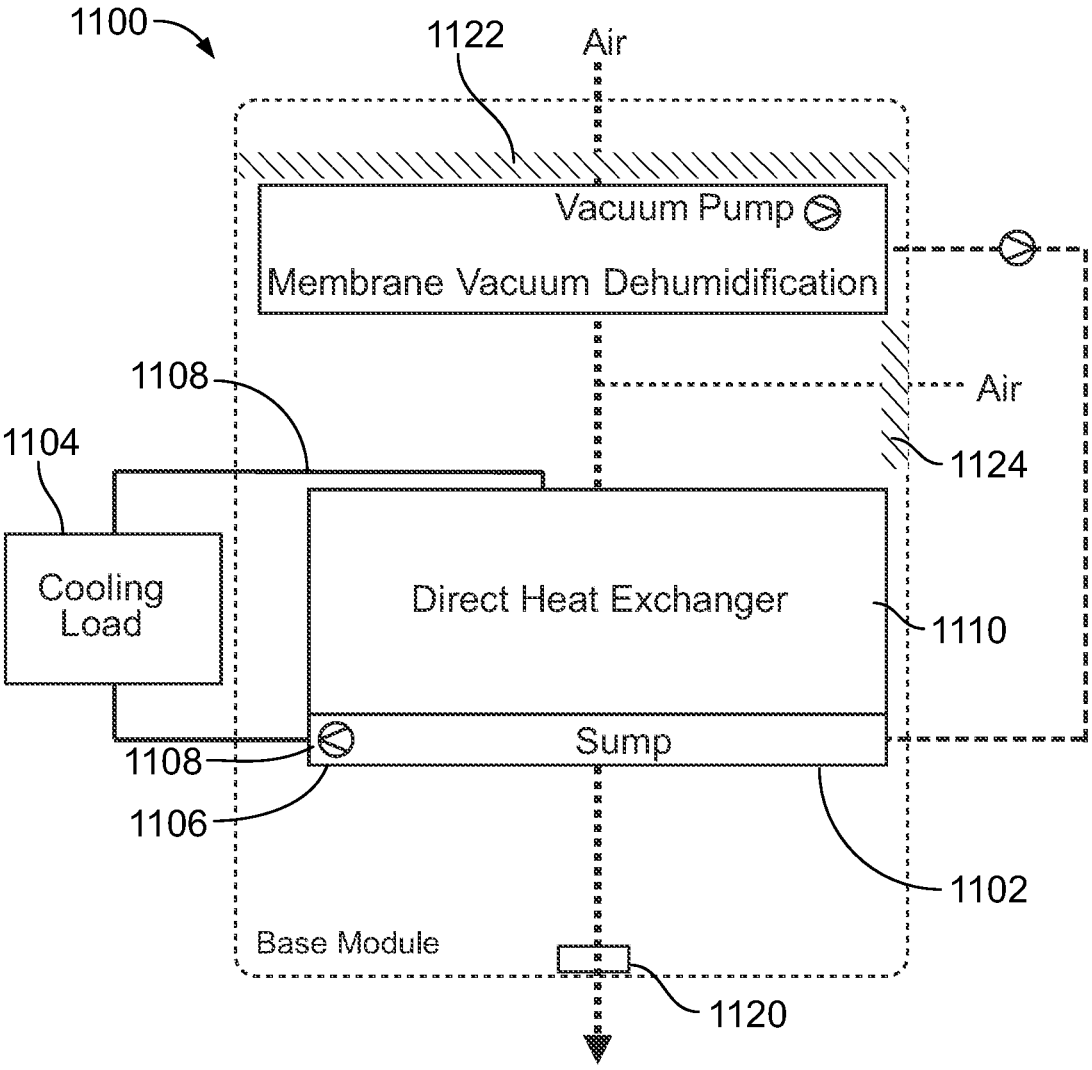
Figure 59:
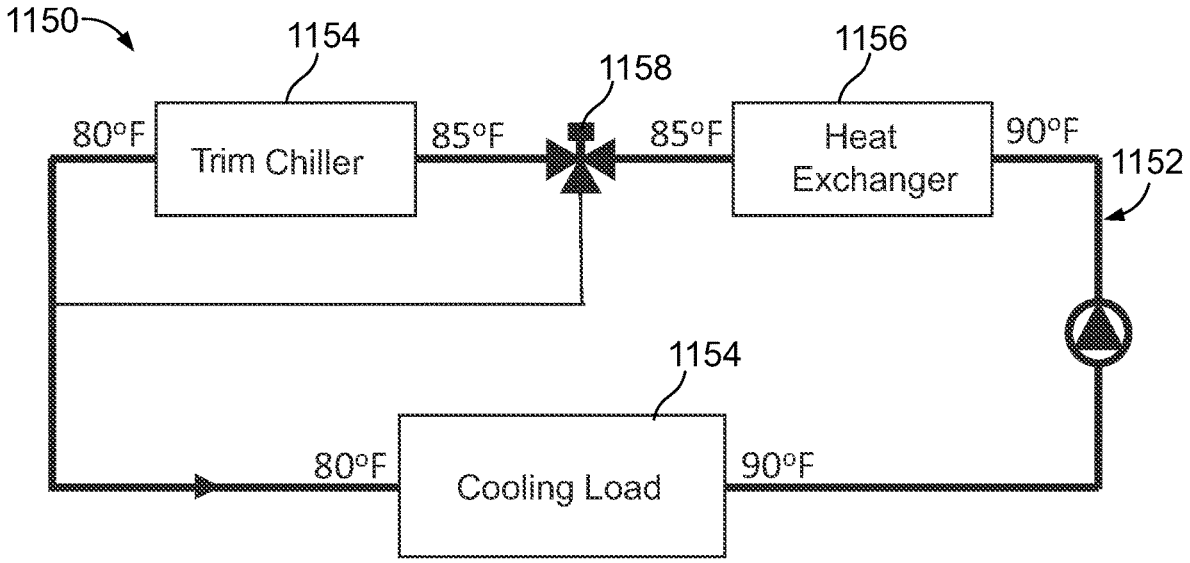
Figure 60:
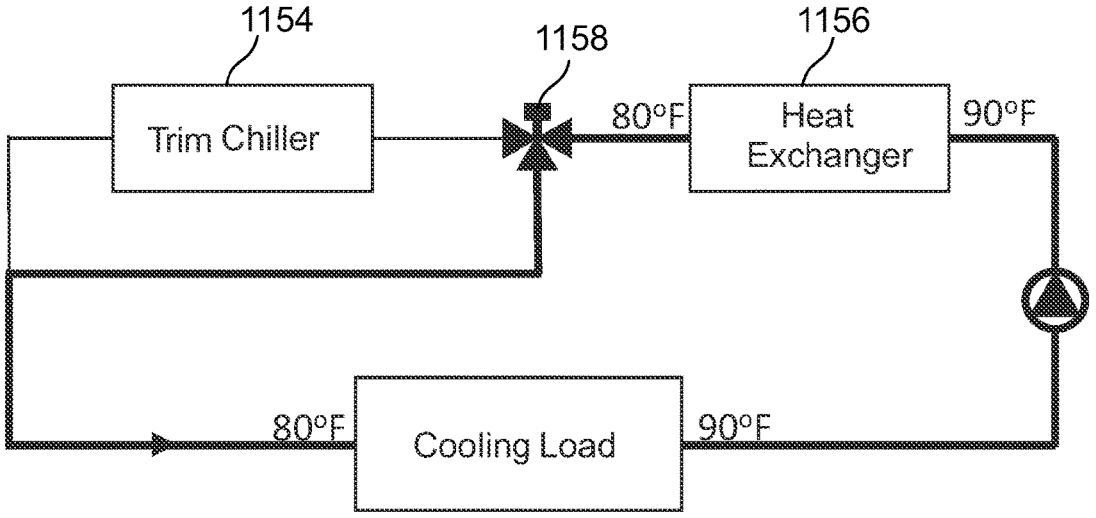
Figure 61:
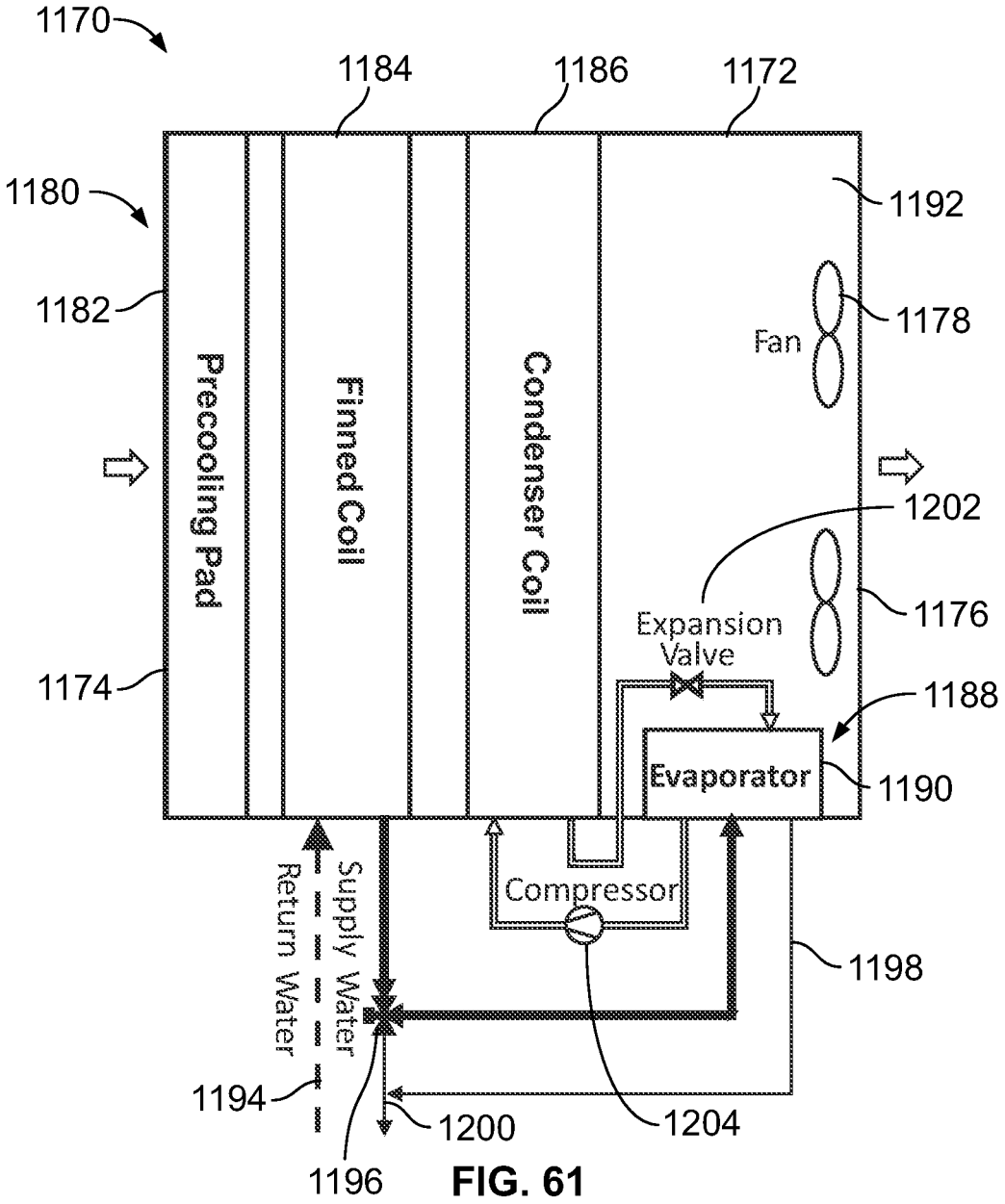
Figure 62:
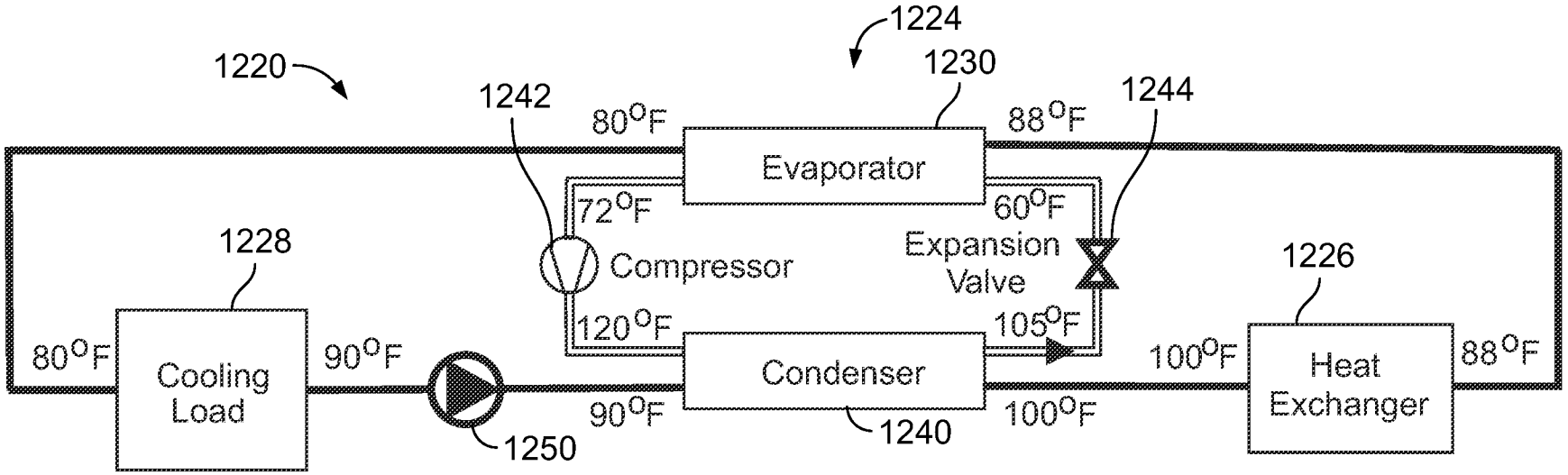
Figure 63:
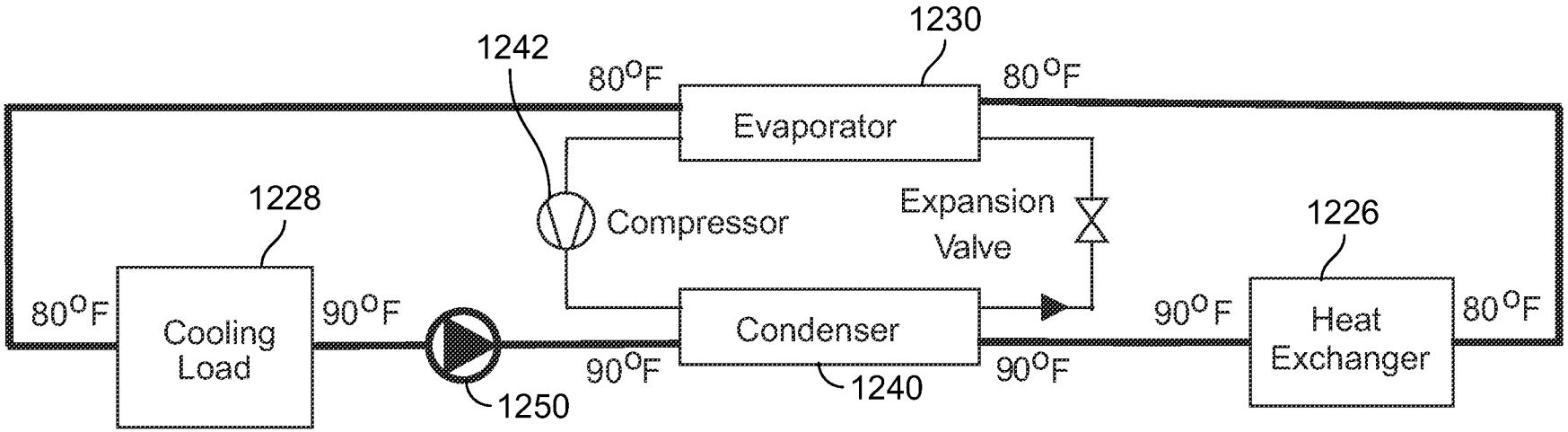
Figure 68:
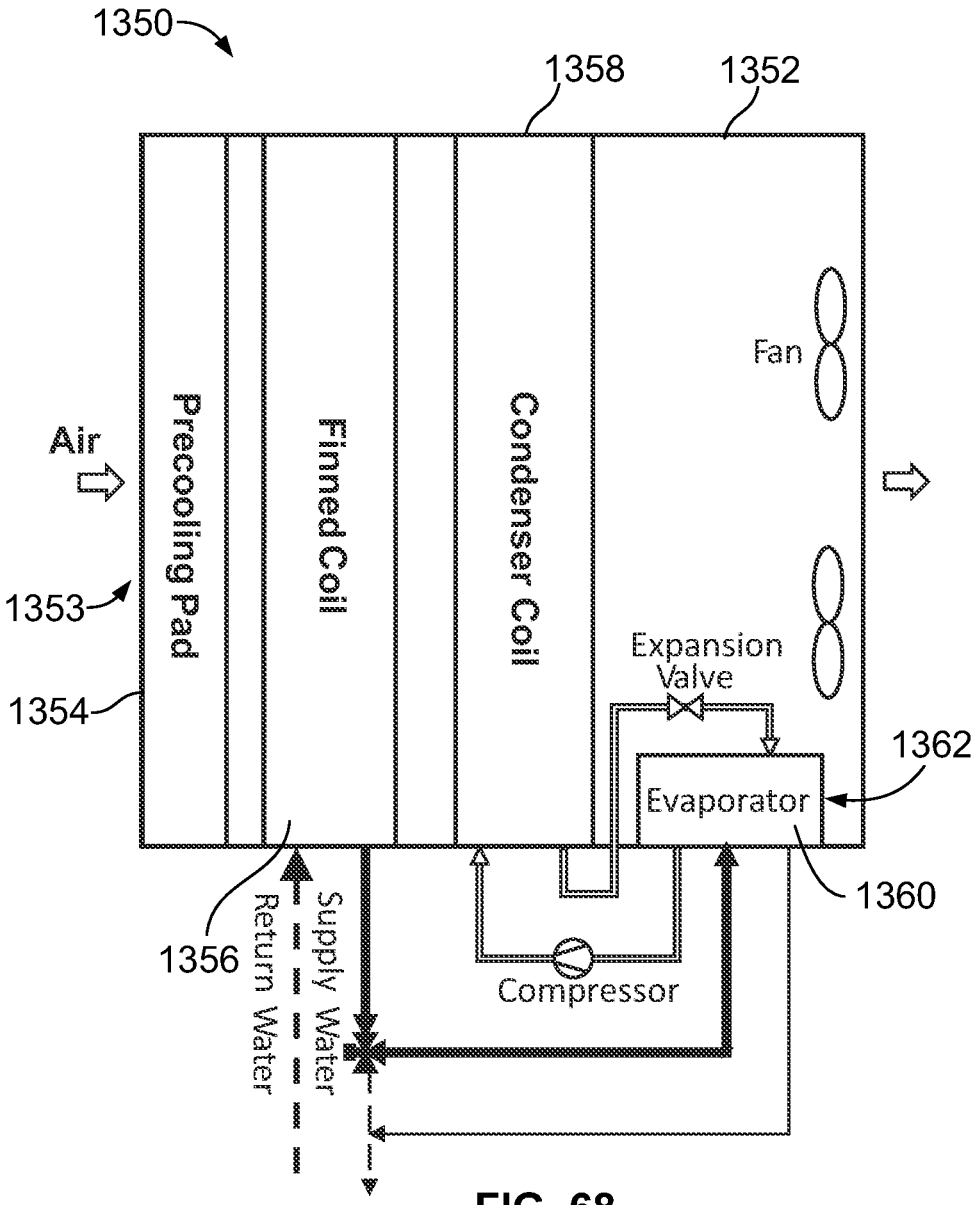
Figure 69:
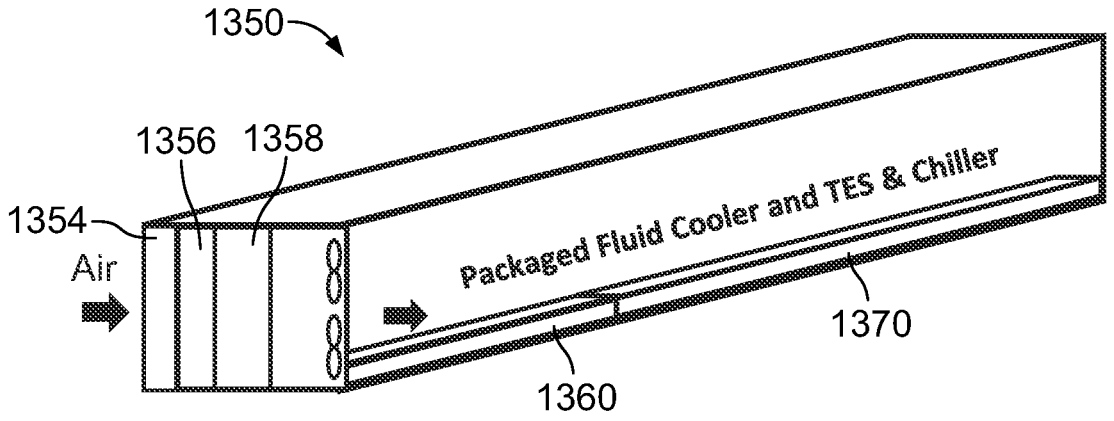
Figure 74:
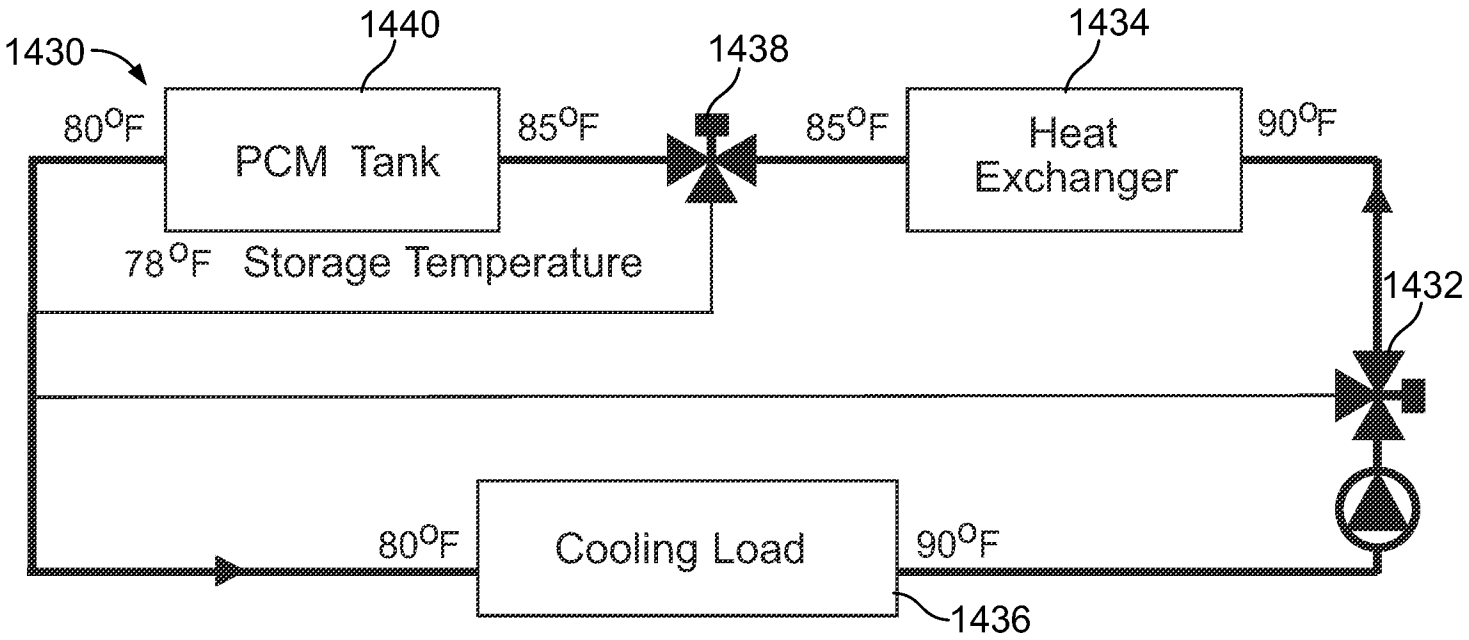
Figure 75:
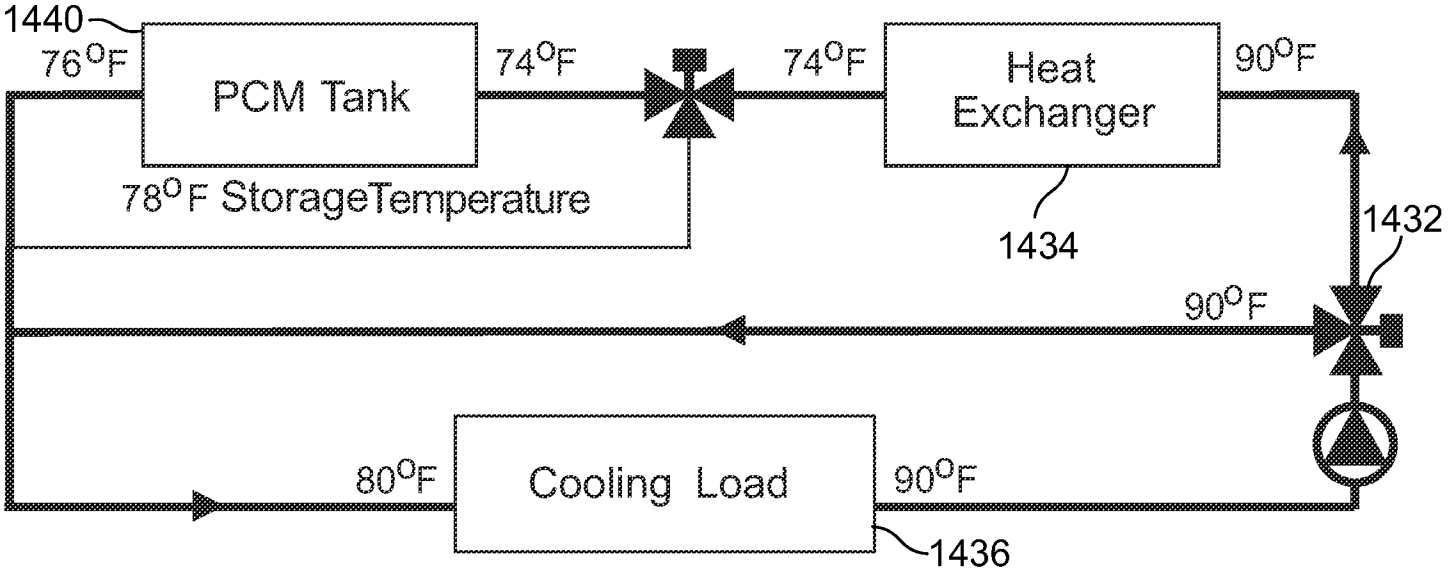
Figure 76:
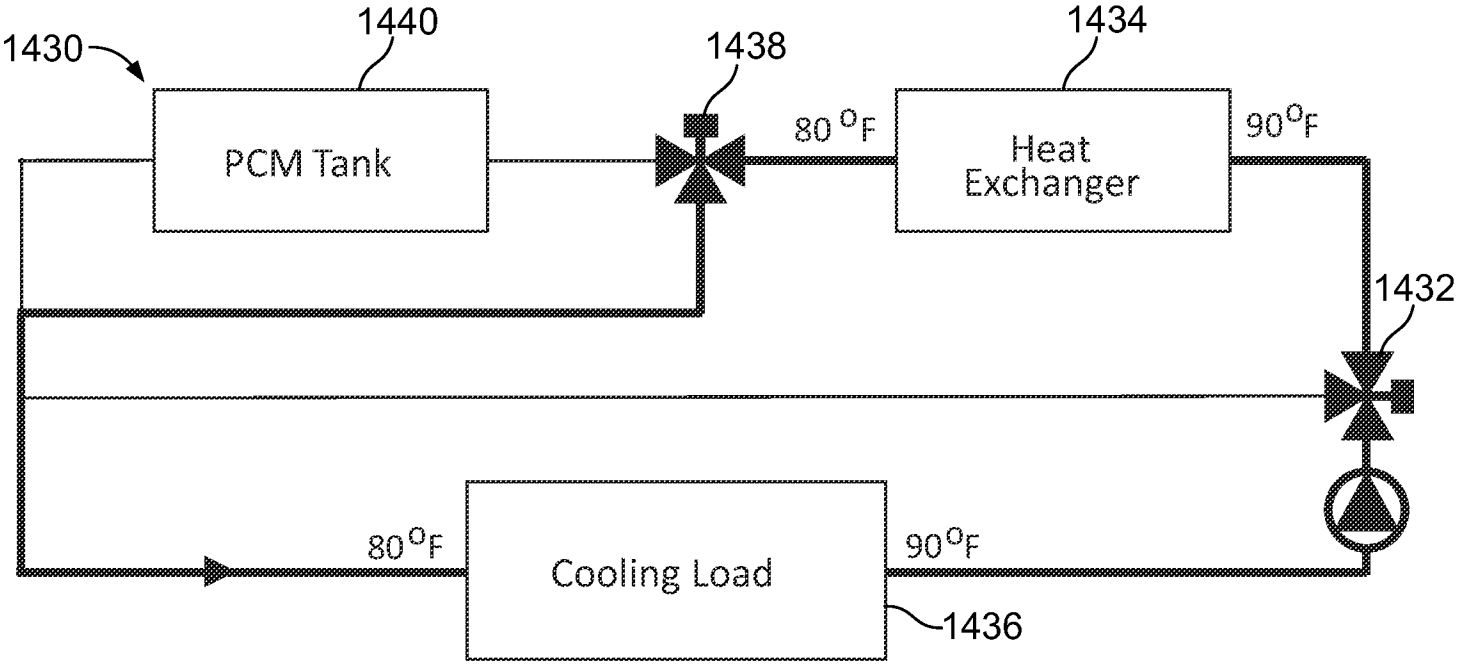
Figure 77:
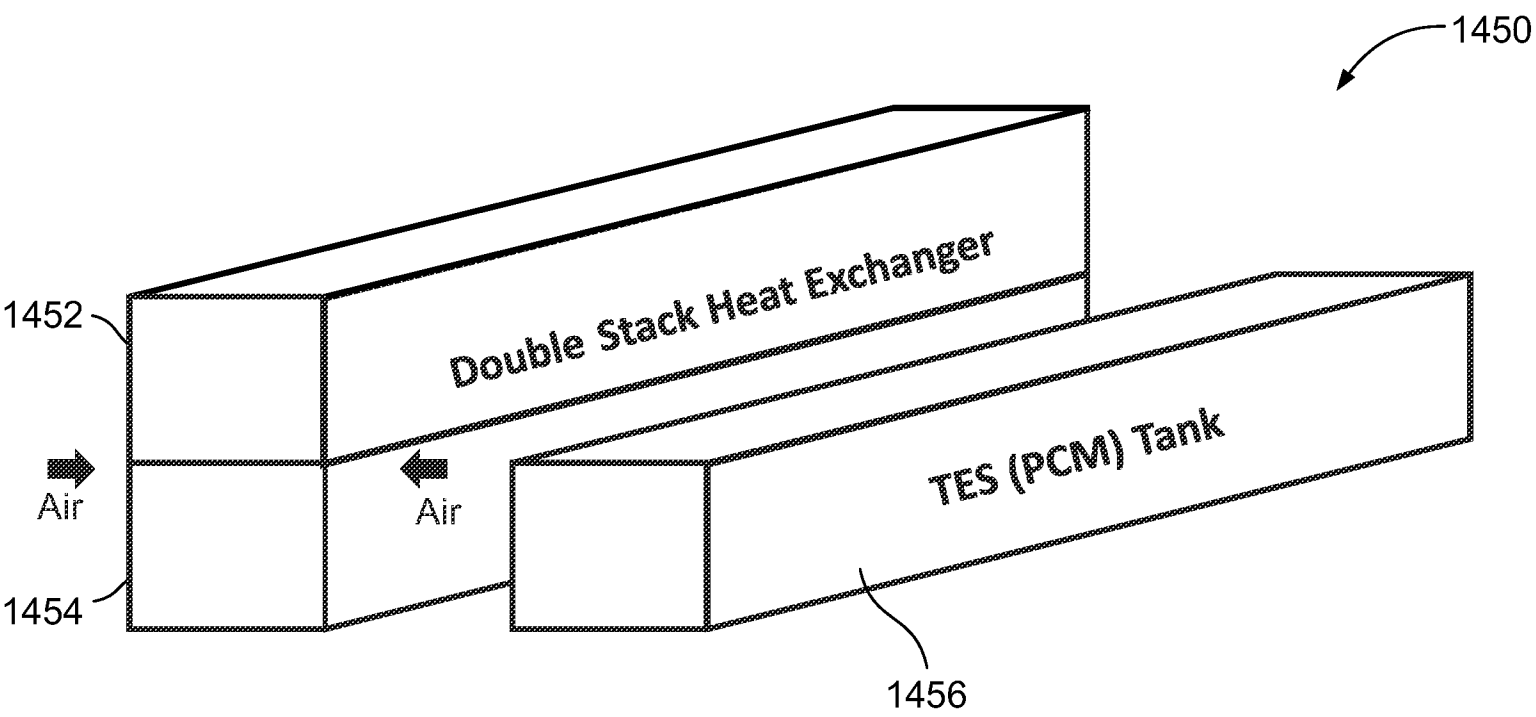
Figure 78:
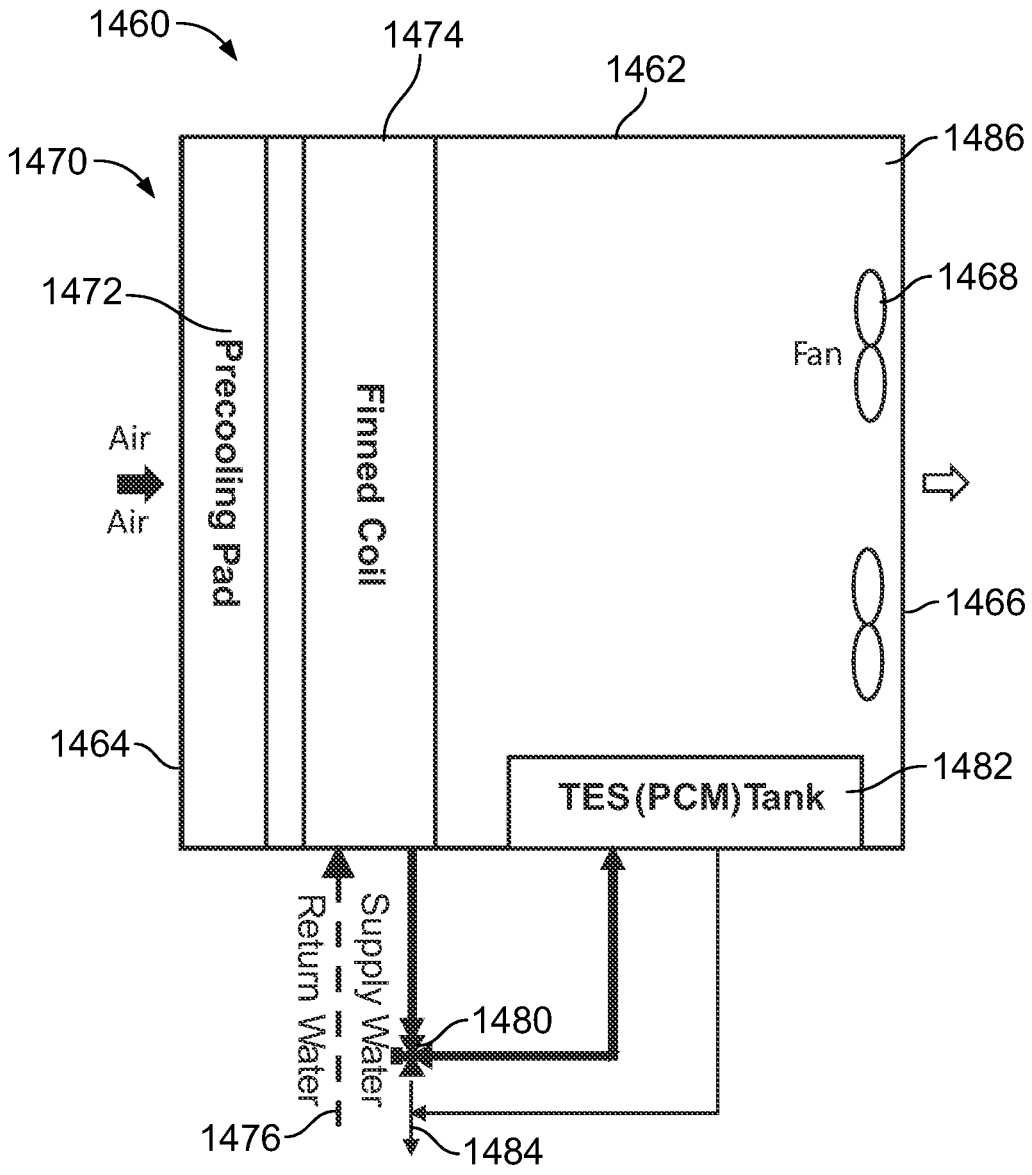
Figure 79:
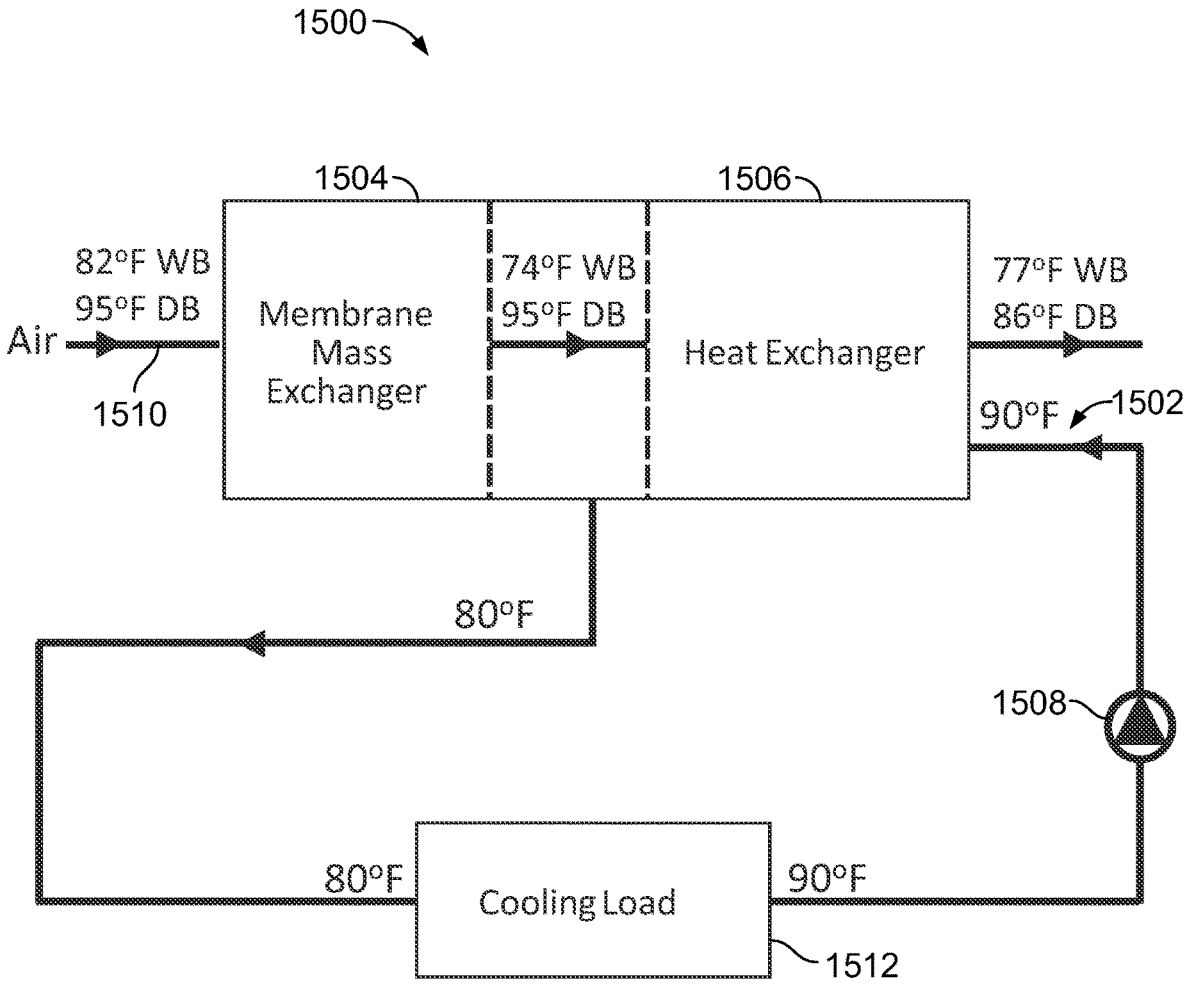
Figure 80:
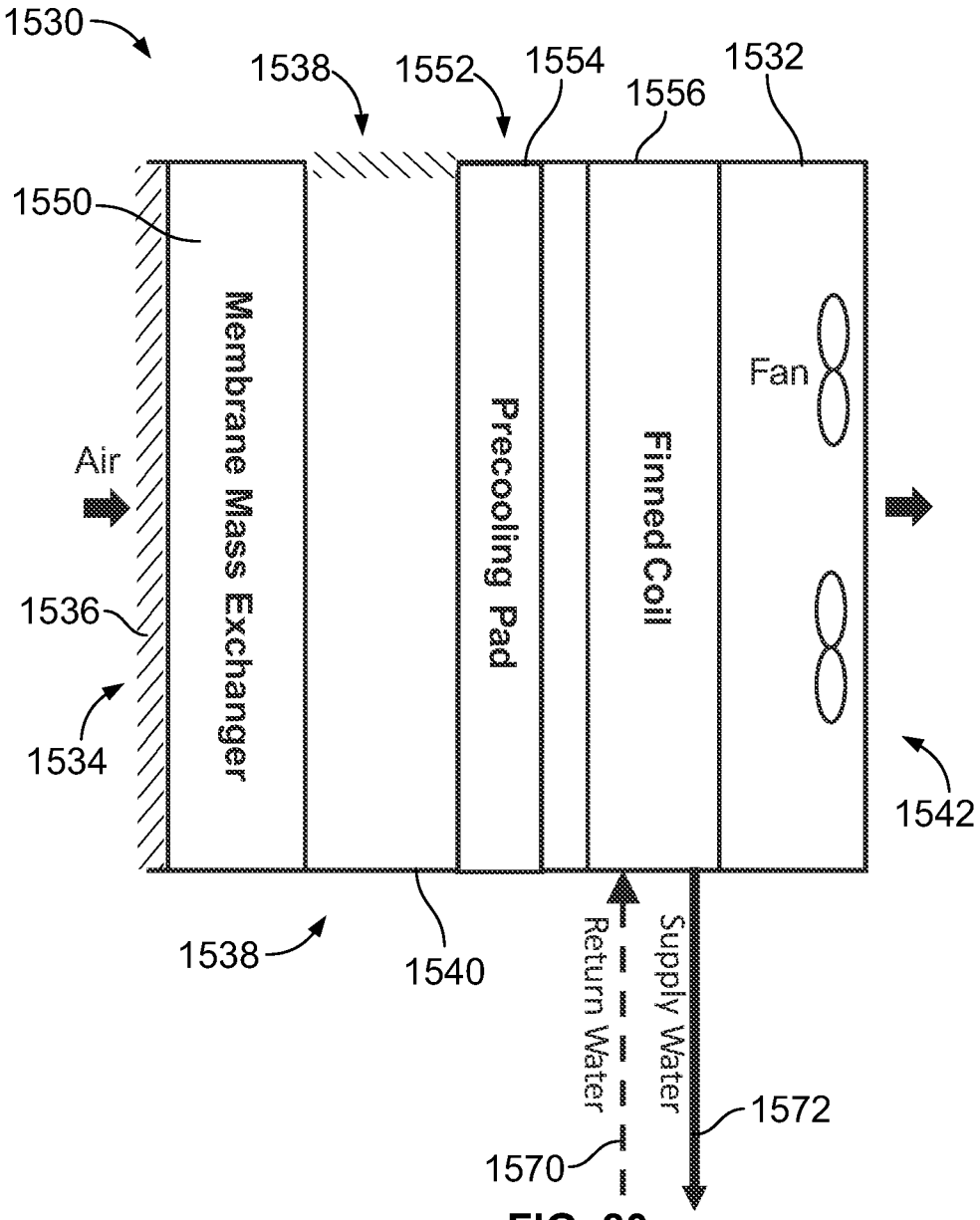
Figure 81:
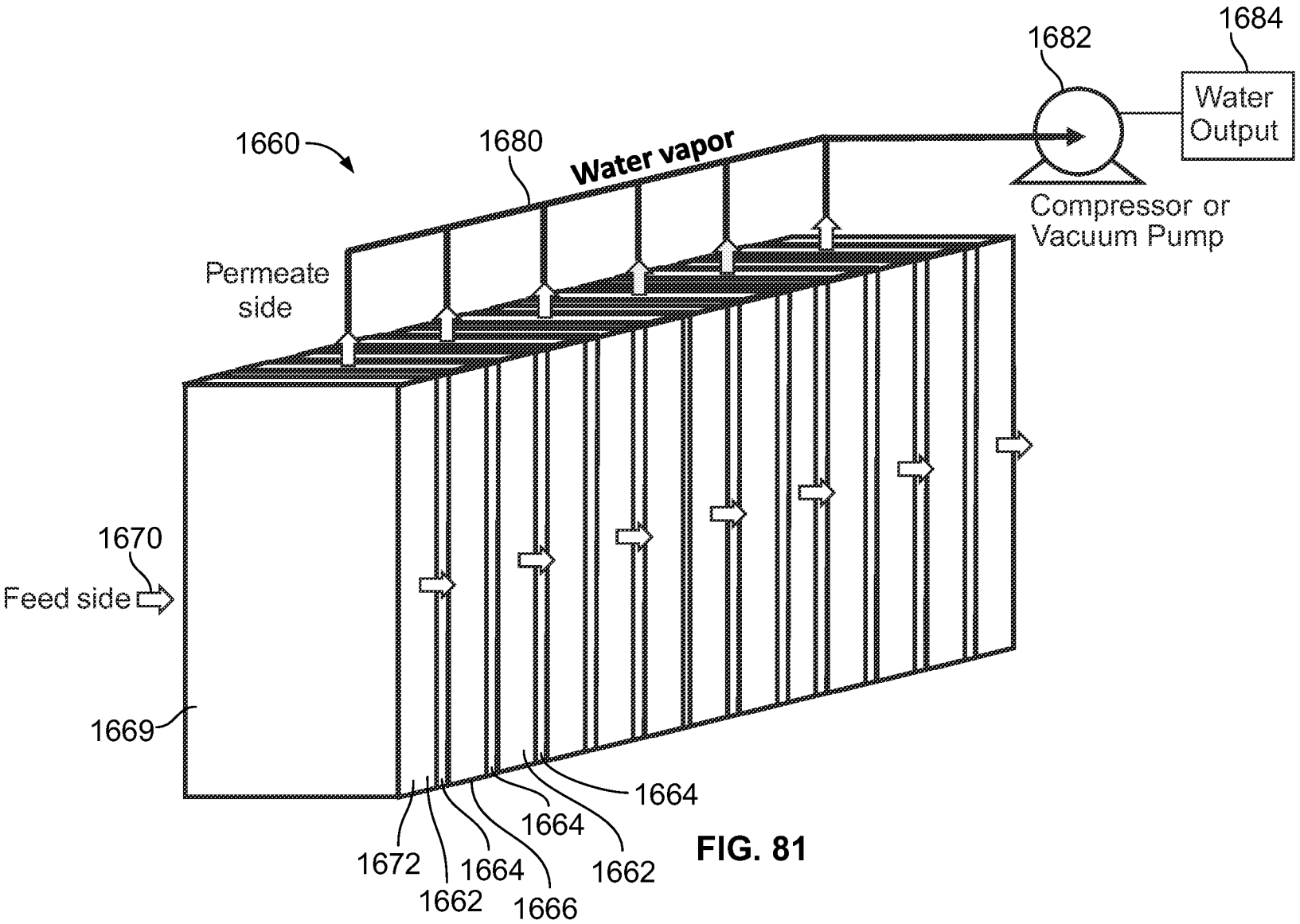
Figure 82:
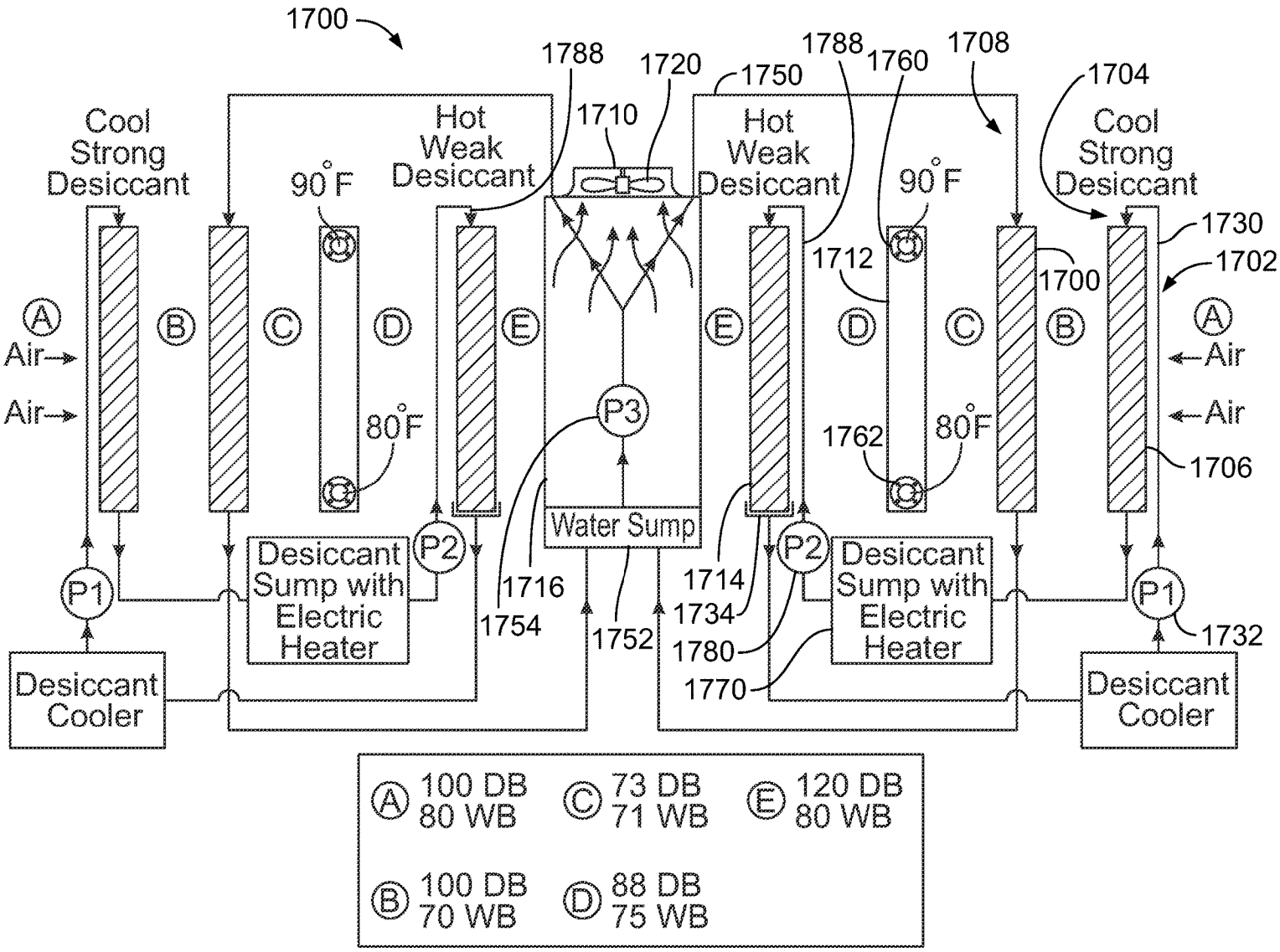
Figure 83:
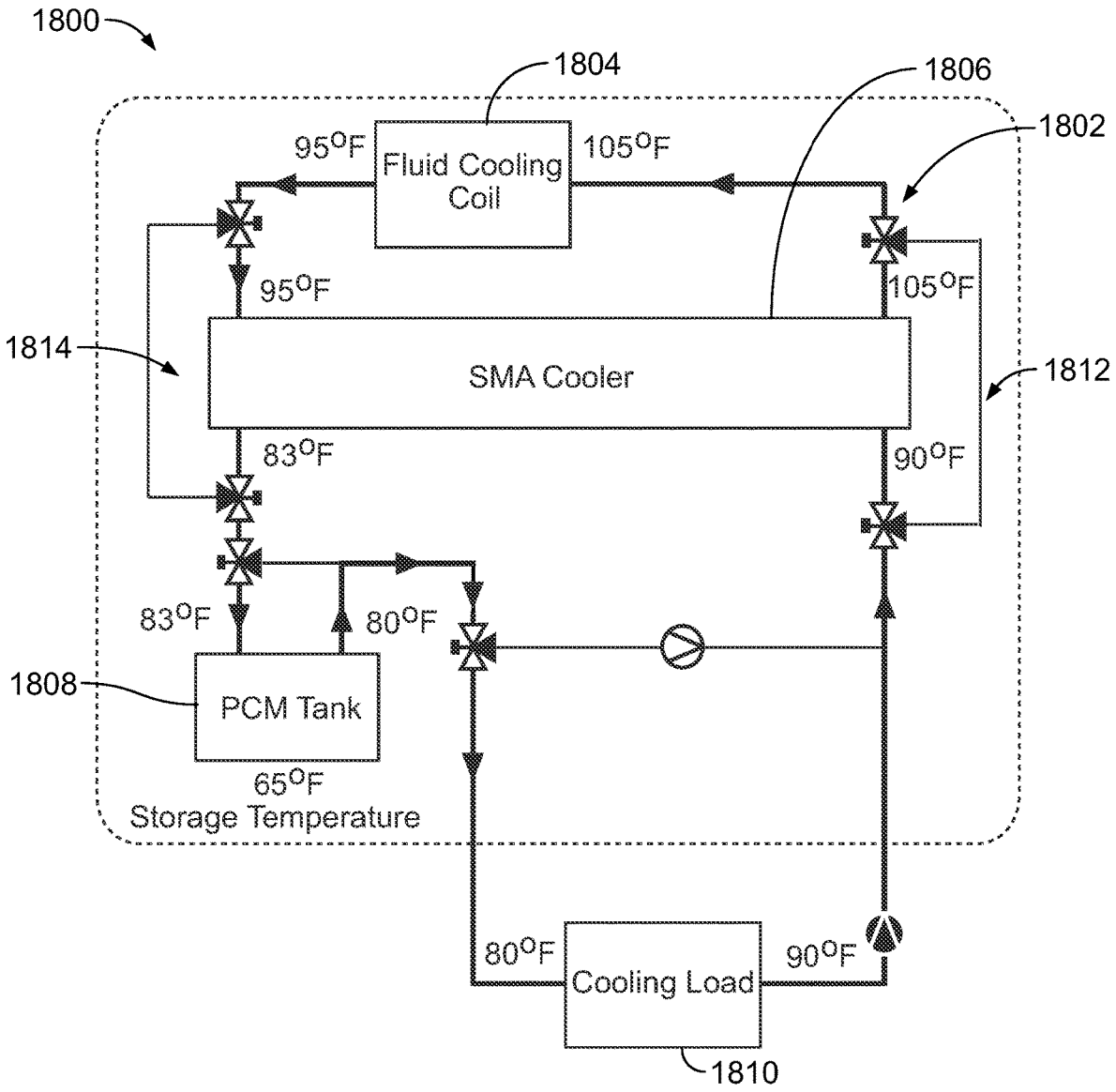
Figure 84:
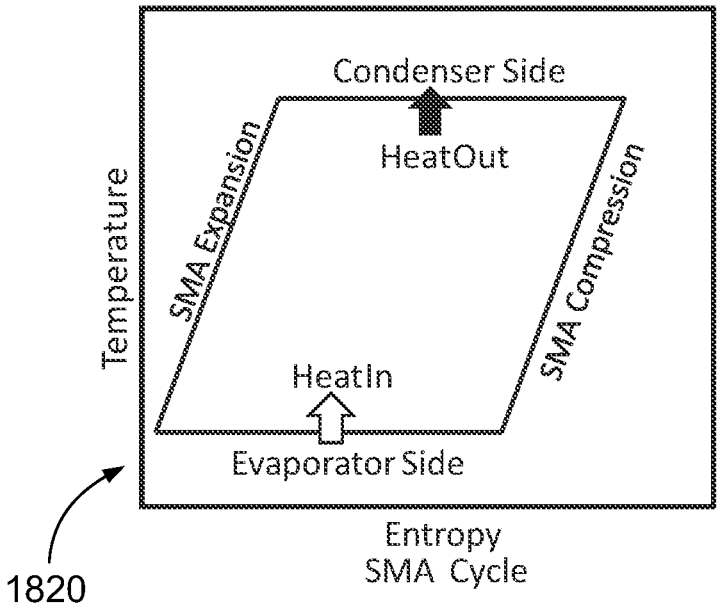

3 during different operating modes while the heat transfer apparatus minimizes water consumption and discharges a phase change material;

FIGS. 5A and 5B are a chart showing the status of components of the heat transfer apparatus of FIG. 3 during different operating modes while the heat transfer apparatus minimizes energy consumption and discharges the phase change material;

FIGS. 6A and 6B are a chart showing the status of components of the heat transfer apparatus of FIG. 3 during different operating modes while the heat transfer apparatus minimizes water consumption and charges the phase change material;

FIGS. 7A and 7B are a chart showing the status of components of the heat transfer apparatus of FIG. 3 showing the status of the components during different operating modes and while the heat transfer apparatus minimizes energy consumption and charges the phase change material;

FIG. 8 is a schematic representation of a second example of the heat transfer apparatus of FIG. 1;

FIGS. 9A and 9B are a chart showing the status of components of the heat transfer apparatus of FIG. 8 during different operating modes while the heat transfer apparatus minimizes water consumption and discharges a phase change material;

FIGS. 10A and 10B are a chart showing the status of components of the heat transfer apparatus of FIG. 8 during different operating modes while the heat transfer apparatus minimizes energy consumption and discharges the phase change material;

FIGS. 11A and 11B are a chart showing the status of components of the heat transfer apparatus of FIG. 8 during different operating modes while the heat transfer apparatus minimizes water consumption and charges the phase change material;

FIGS. 12A and 12B are a chart showing the status of components of the heat transfer apparatus of FIG. 8 during different operating modes while the heat transfer apparatus minimizes energy consumption and charges the phase change material;

FIG. 13 is a schematic representation of a third example of the heat transfer apparatus of FIG. 1, the heat transfer apparatus having a secondary closed-loop pump to facilitate charging of the phase change material;

FIGS. 14-19 are schematic representation of the heat transfer apparatus of FIG. 13 during different operating modes;

FIGS. 20A and 20B are a chart showing the status of components of the heat transfer apparatus of FIG. 13 during different operating modes while the heat transfer apparatus minimizes water consumption and discharges the phase change material;

FIGS. 21A and 21B are a chart showing the status of components of the heat transfer apparatus of FIG. 13 during different operating modes while the heat transfer apparatus minimizes energy consumption and discharges the phase change material;

FIGS. 22A and 22B are a chart showing the status of components of the heat transfer apparatus of FIG. 13 during different operating modes while the heat transfer apparatus minimizes energy consumption and charges the phase change material;

FIGS. 23A and 23B are a chart showing the status of components of the heat transfer apparatus of FIG. 13 during different operating modes while the heat transfer apparatus minimizes energy consumption and charges the phase change material;

FIG. 24 is a fourth example of the heat transfer apparatus of FIG. 1, the heat transfer apparatus having a direct heat exchanger and an indirect heat exchanger for removing heat from a process fluid;

FIG. 25 is a fifth example of the heat transfer apparatus of FIG. 1, the heat transfer apparatus having a direct heat exchanger to remove heat from a process fluid;

FIG. 26 is a schematic representation of a heat transfer apparatus according to a second approach;

FIG. 27 is a more detailed schematic representation of the heat transfer apparatus of FIG. 26;

FIG. 28 is a schematic representation of a first example of the heat transfer apparatus of FIG. 26;

FIGS. 29-32 are schematic representations of the heat transfer apparatus of FIG. 28 during different operating modes;

FIG. 33 is a chart showing the status of components of the heat transfer apparatus of FIG. 28 during different operating modes while the heat transfer apparatus minimizes water consumption and discharges a phase change material;

FIG. 34 is a chart showing the status of components of the heat transfer apparatus of FIG. 28 during different operating modes while the heat transfer apparatus minimizes energy consumption and discharges the phase change material;

FIG. 35 is a chart showing the status of components of the heat transfer apparatus of FIG. 28 during different operating modes while the heat transfer apparatus minimizing water consumption and charges the phase change material;

FIG. 36 is a chart showing the status of components of the heat transfer apparatus of FIG. 28 during different operating modes while the heat transfer apparatus minimizes energy consumption and charges the phase change material;

FIG. 37 is a schematic representation of a second example of the heat transfer apparatus of FIG. 26;

FIG. 38 is a chart showing the status of components of the heat transfer apparatus of FIG. 37 during different operating modes while the heat transfer apparatus minimizes water consumption and discharges the phase change material;

FIG. 39 is a chart showing the status of components of the heat transfer apparatus of FIG. 37 during different operating modes while the heat transfer apparatus minimizes energy consumption and discharges the phase change material;

FIG. 40 is a chart showing the status of components of the heat transfer apparatus of FIG. 37 during different operating modes while the heat transfer apparatus minimizes water consumption and charges the phase change material;

FIG. 41 is a chart showing the status of components of the heat transfer apparatus of FIG. 37 during an adiabatic cooling mode, while minimizing energy consumption, and charging the phase change material;

FIG. 42 is a schematic representation of a third example of the heat transfer apparatus of FIG. 26;

FIG. 43 is a schematic representation of a fourth example of the heat transfer apparatus of FIG. 26;

FIG. 44 is a schematic representation of a heat transfer apparatus according to a third approach;

FIG. 45 is a schematic representation of a first example of the heat transfer apparatus of FIG. 44;

FIGS. 46-49 are schematic views of a portion of the heat transfer apparatus of FIG. 45 showing different operating modes;

FIG. 50 is a chart showing the status of components of the heat transfer apparatus of FIG. 45 during different operating modes, while minimizing energy consumption;

FIG. 51 is a chart showing the status of components of the heat transfer apparatus of FIG. 45 while the heat transfer apparatus minimizes water consumption;

FIG. 52 is a chart showing the status of components of the heat transfer apparatus of FIG. 45 during different operating modes and while the heat transfer apparatus generates water;

FIG. 53 is a schematic view of a second example of the heat transfer apparatus of FIG. 44;

FIG. 54 is a chart showing the status of components of the heat transfer apparatus of FIG. 53 during different operating modes and while the heat transfer apparatus minimizes energy consumption;

FIG. 55 is a chart showing the status of components of the heat transfer apparatus of FIG. 53 during different operating modes and while the heat transfer apparatus minimizes water consumption;

FIG. 56 is a chart showing the status of components of the heat transfer apparatus of FIG. 53 during different operating modes and while the heat transfer apparatus generates water;

FIG. 57 is a schematic representation of a third example of the heat transfer apparatus of FIG. 44;

FIG. 58 is a schematic representation of a fourth example of the heat transfer apparatus of FIG. 44;

FIG. 59 is a schematic representation of a heat transfer apparatus in a chiller on mode;

FIG. 60 is a schematic representation of the heat transfer apparatus of FIG. 59 showing the heat transfer apparatus in a chiller off mode;

FIG. 61 is a schematic representation of a heat transfer apparatus having a condenser coil of a chiller downstream of a finned coil as air is directed through the heat transfer apparatus;

FIGS. 62 and 63 are schematic representation of a heat transfer apparatus when the heat transfer apparatus is in a chiller on mode and a chiller off mode;

FIGS. 64-67 are schematic representation of a heat transfer apparatus showing different modes of the heat transfer apparatus;

FIG. 68 is a schematic representation of a heat transfer apparatus having an evaporator of a chiller in an outer structure of the heat transfer apparatus;

FIG. 69 is a perspective view of the heat transfer apparatus of FIG. 68 showing the heat transfer apparatus having a thermal energy storage side-by-side the evaporator;

FIGS. 70-73 are schematic representations of a heat transfer apparatus during different operating modes thereof;

FIGS. 74 and 75 are schematic representations of a heat transfer apparatus having a phase change material with an elevated storage temperature during different operating modes of the heat transfer apparatus;

FIG. 76 is a schematic view of a heat transfer apparatus having a phase change material tank bypass;

FIG. 77 is a perspective view of a heat transfer apparatus having two stacked air/process fluid heat exchangers and a phase change material tank;

FIG. 78 is a schematic view of a heat transfer apparatus having a housing and a phase change material tank in the housing;

FIG. 79 is a schematic view of a heat transfer apparatus having a membrane mass exchanger that dehumidifies air before the air reaches a heat exchanger of the heat transfer apparatus;

FIG. 80 is a schematic view of a heat transfer apparatus having a membrane mass exchanger upstream of an adiabatic cooling pad and a finned coil to dehumidify the air and improve the efficiency of heat transfer between the finned coil and the air flow;

FIG. 81 is a schematic view of a vacuum membrane mass exchanger having sheet membranes interposed between air passageways and permeate passageways;

FIG. 82 is a schematic view of a heat transfer apparatus having a dehumidifier that uses liquid desiccant to dehumidify air before the air reaches an indirect heat exchanger of the heat transfer apparatus;

FIG. 83 is a schematic view of a heat transfer apparatus having a shape memory alloy cooler; and FIG. 84 is a graph showing temperature versus entropy for a shape memory alloy material of the shape memory alloy cooler.

DETAILED DESCRIPTION

With reference to FIG. 1, a heat transfer apparatus 10 according to a first approach is provided. The heat transfer apparatus 10 has an outer structure such as a housing 12, one or more air inlets 14 and one or more air outlets 16. The heat transfer apparatus 10 has a heat exchanger 19 for transferring heat between the process fluid and the air moving from the air inlets 14 to the air outlet 16. The heat exchanger 19 may utilize various air/process fluid flow configurations, such as cross-flow, counter flow, parallel flow, or a combination thereof. The heat transfer apparatus 10 further includes a thermal energy storage (TES) such as a phase change material (PCM) tank 26 and a mechanical cooler, such as a heat pump or chiller 28, for providing additional heat transfer for the process fluid. The PCM in the PCM tank 26 may have a fixed or variable freezing temperature. The heat exchanger 19 includes an adiabatic precooler 20 having a precooling pad 22 and an indirect heat exchanger such as a fluid cooling coil 24. The heat transfer apparatus 10 has an air flow generator such as one or more fans 30 that are operable to cause air flow from the air inlets 14, across the precooling pads 22 and fluid cooling coils 24, and out from the air outlet 16. The one or more fans 30 may be fixed or variable speed fans. The PCM tank 26 and chiller 28 provide trim cooling as needed to satisfy a cooling load requirement while permitting the fan 30, adiabatic precooler 20, and indirect heat exchanger 23 to be sized for less than peak cooling loads which reduces water consumption and/or energy consumption for off-peak cooling loads. The heat transfer apparatus 10 may thereby satisfy a peak cooling load or requested process fluid set temperature for an industrial process at a particular geographic location even on the hottest days of the year. Further, the heat transfer apparatus 10 is operable to either minimize water consumption or energy consumption while satisfying cooling loads throughout the year.

Figure 2:
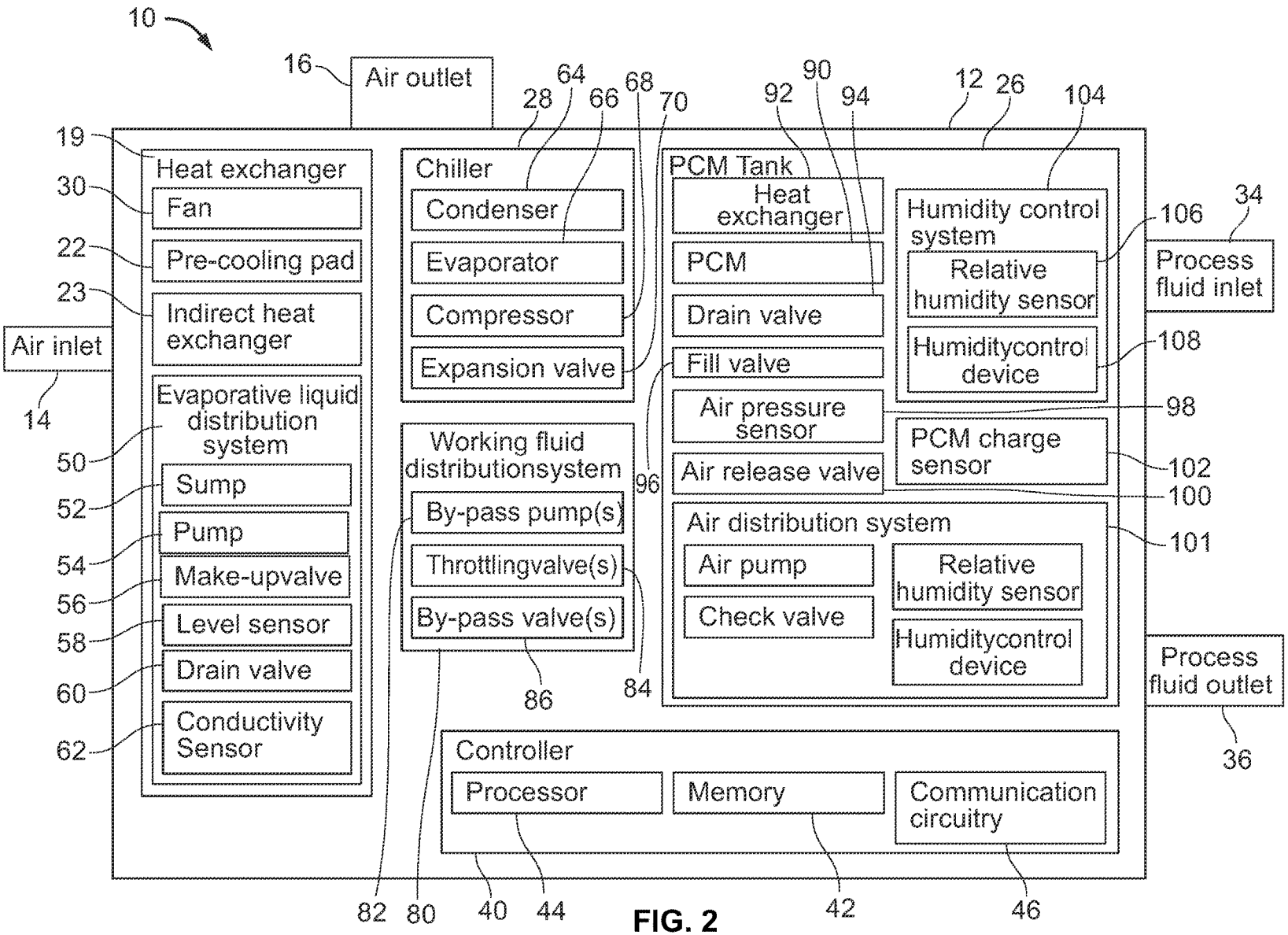
FIG. 2 is a more detailed schematic representation of the heat transfer apparatus of FIG. 1.

Regarding FIG. 2, a more detailed schematic representation of the heat transfer apparatus 10 is provided. The heat transfer apparatus 10 includes a process fluid inlet 34 to receive process fluid, such as a water or water/glycol mixture, from an industrial process such as a computer datacenter. In one embodiment, multiple heat transfer apparatuses 10 may be arranged in parallel such that the process fluid inlet 34 receives process fluid from an upstream heat transfer apparatus 10. The process fluid received at process fluid inlet 34 may be a liquid, a gas, or a liquid/gas mixture. The heat transfer apparatus 10 has a process fluid outlet 36 for returning process fluid to the industrial process, or to a downstream heat transfer apparatus. The heat transfer apparatus 10 may be operated to cool or heat the process fluid received at the process fluid inlet 34 as desired for a particular embodiment.

The heat transfer apparatus 10 has a controller 40 with a memory 42 that is a non-transitory computer readable medium for storing instructions to operate the heat transfer apparatus 10. The controller 40 has a processor 44 to perform the instructions stored in the memory 42 and control the heat transfer apparatus 10. The controller 40 further includes a communication circuitry 46 for communicating with a remote device, such as a HVAC system controller of a building. The communication circuitry 46 receives a process fluid variable, such as at least one of temperature, pressure, and flow rate, that the remote device has requested the heat apparatus 10 to provide. The processor 44 stores the process fluid variable in a memory 42 and operates the heat transfer apparatus 10 to provide process fluid at the process fluid outlet 36 that satisfies the process fluid variable. The communication circuitry 46 may receive other data from the remote device as well as transmit data to the remote device, such as air temperature and/or pressure; process fluid temperature, flow rate, and/or pressure; and/or component status data.

The adiabatic precooler 20 includes an evaporative liquid distribution system 50 configured to distribute evaporative liquid, such as water, onto the precooling pad 22. The evaporative liquid distribution system 50 includes a sump 52 to collect evaporative liquid from the precooling pad 22 and a pump 54 to pump evaporative liquid from the sump 52 to a liquid distributor, such as a spray nozzle, of the evaporative liquid distribution system 50 to distribute evaporative liquid onto the precooling pad 22. The evaporative liquid distribution system 50 further includes a makeup valve 56 to permit water to be added to the sump 52 to compensate for evaporation of evaporative liquid, a liquid level sensor 58 to detect the level of the evaporative liquid in the sump 52, a drain valve 60 for draining the sump 52, and a conductivity sensor 62 for monitoring one or more variables of the evaporative liquid in the sump 54.

The chiller 28 may take different forms, such as a refrigerant-based chiller, a solid state chiller (e.g., electrocaloric, magnetocaloric, thermoelastic), or a gas-based chiller (reverse Brayton cycle) as some examples. In the embodiment of FIG. 2, the chiller 28 is refrigerant-based chiller and includes a condenser 64, an evaporator 66, a compressor 68, and an expansion valve 70.

The heat transfer apparatus 10 has a process fluid distribution system 80 for directing the flow of process fluid between the components of the heat transfer apparatus 10. The process fluid distribution system 80 may include one or more bypass pump(s) 82, throttling valve(s) 84, and bypass valve(s) 86. A given valve may function either as a bypass valve or a throttling valve depending on the mode of the heat transfer apparatus 10, as discussed in greater detail below.

The PCM tank 26 includes a phase change material 90, such as ice or another phase change material having a melting temperature above 32° F. and a heat exchanger 92 for exchanging heat between the phase change material 90 and the process fluid. The phase change material 90 may include ice, paraffin waxes, non-paraffin organics, hydrated salts, or metallics as some examples. The PCM tank 26 further includes a drain valve 94 for emptying the PCM tank 26, a flow valve 96 to fill the PCM tank 26, an air pressure sensor 98 for detecting air pressure in the PCM tank 26, an air release valve 100 to release air pressure from the PCM tank 26 when the air pressure exceeds a predetermined threshold, and a PCM charge sensor 102. An example of the PCM charge sensor 102 is a liquid level sensor for PCM having different solid and liquid densities. Another example of the PCM charge sensor 102 is one or more temperature probes at different locations on the PCM tank 26. The PCM tank 26 further includes a humidity control system 104 for detecting humidity within the PCM tank 26. The humidity control system 104 may include a relative humidity sensor 106 and a humidity control device 108 such as a dehumidifier.

The PCM tank 26 has an air distribution system 101 for blowing air into the PCM tank 26 to agitate the liquid PCM and promote faster and more even melting and/or freezing of the PCM. The air distribution system 101 directs air into the PCM at the bottom of the PCM tank 26 and the air agitates the PCM as the air rises in the PCM tank 26. To provide this functionality, the air distribution system 101 may include an air pump, check valve, relative humidity sensor, and a humidity control device such as a vent as shown in FIG. 2.

The heat transfer apparatus 10 of the first approach may take various forms. With reference to FIG. 3, a heat transfer apparatus 110 is provided that is a first example of the heat transfer apparatus 10. The heat transfer apparatus 110 includes a process fluid heat exchange circuit 111 operable to receive a process fluid from a cooling load 136, cool the process fluid to achieve a requested process fluid variable such as a process fluid set temperature, and direct the cooled process fluid back to the cooling load 136. The heat transfer apparatus 110 has a controller 113 for operating the components of the process fluid heat exchange circuit 111.

The process fluid heat exchange circuit 111 includes a heat exchanger 112 having an adiabatic precooler 114 and an indirect heat exchanger such as a fluid cooling coil 116. The adiabatic precooler 114 has a precooling pad 118 and an evaporative liquid distribution system 120 for distributing evaporative liquid onto the precooling pad 118. The evaporative liquid distribution system 120 includes a sump 121 for collecting evaporative liquid from the precooling pad 118 and a sump pump 122 operable to pump the evaporative liquid from the sump 120 to the precooling pad 118.

The heat transfer apparatus 110 includes a fan 124 to generate air flow across the precooling pad 118 and the fluid cooling coil 116. The adiabatic precooler 114 reduces the dry bulb temperature of the air before the air reaches the fluid cooling coil 116 which improves the efficiency of heat transfer between the air and a fluid cooling coil 116. The heat transfer apparatus 110 further includes a chiller 130 having a condenser 132 and an evaporator 134 that are configured to transfer heat to or from a process fluid from the cooling load 136. The heat transfer apparatus 110 has a PCM tank 138 and a closed-loop pump 140 that is used to recharge the PCM tank 138 as discussed in greater detail below. The heat transfer apparatus 110 is organized as a base module 142 that may be added to other base modules in series or parallel to provide a desired amount of cooling capacity for the cooling load 136. The components of the heat transfer apparatus 110 may be within a single outer structure or may be arranged in multiple outer structures as desired for a particular embodiment.

Figure 4A:
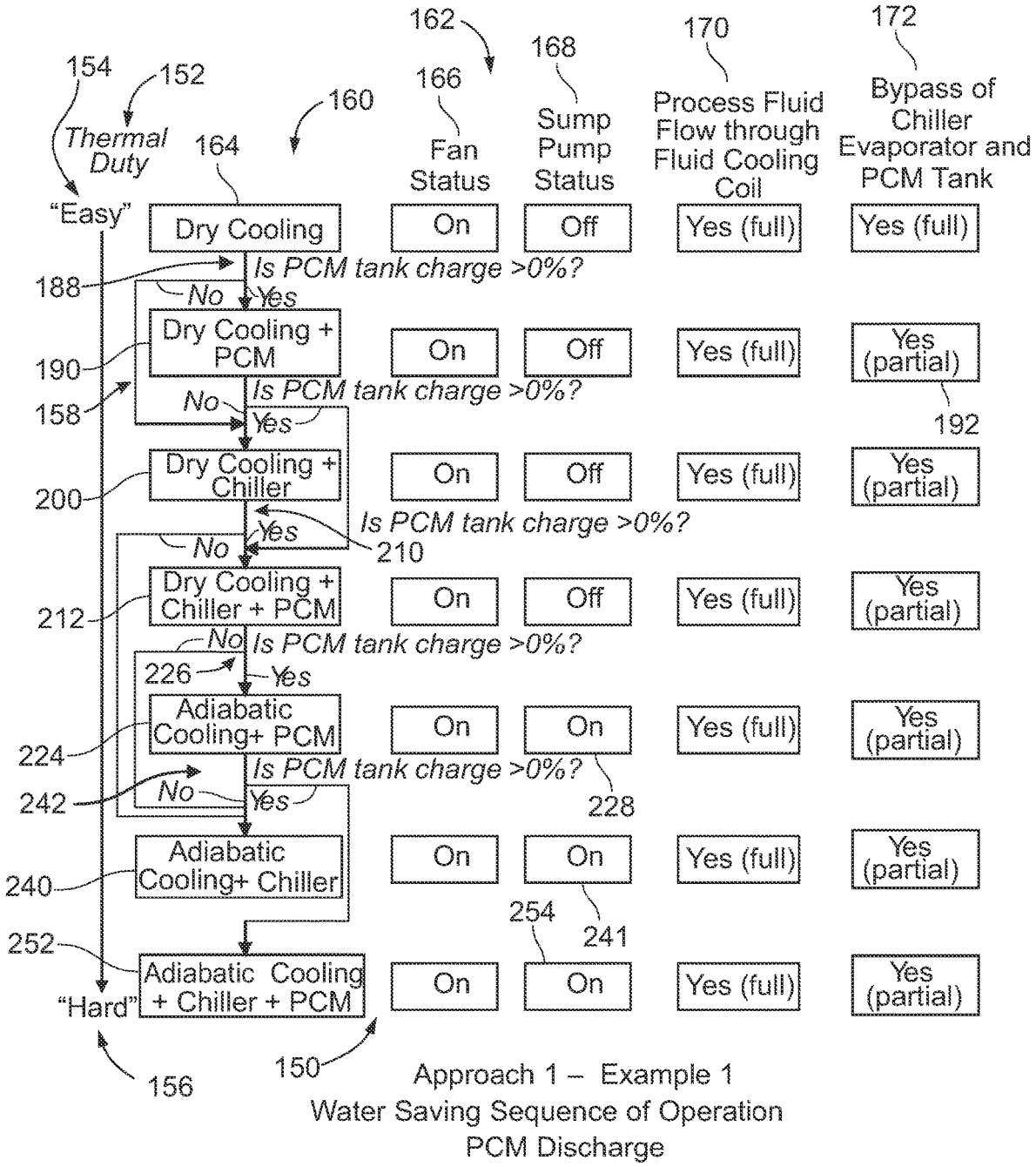

Regarding FIGS. 4A and 4B, a method 150 is provided for operating the heat transfer apparatus 110. The method 150 is provided as a chart organized by thermal duty 152 that increases from an easy 154 thermal duty to a hard 156 thermal duty. The thermal duty of the heat transfer apparatus 110 may be determined by one or variables, such as ambient air temperature (e.g., wet bulb and/or dry bulb), ambient air humidity, the temperature and/or humidity of air inside of the heat transfer apparatus 110, process fluid set temperature, process fluid pressure, process fluid flow rate, time of day, season, or a combination thereof. The method 150 has logic 158 that facilitates changing of the heat transfer apparatus 110 between operating modes 160 as the thermal duty 152 changes. In one embodiment, the controller 113 progresses from an "easier" operating mode 160 to a "harder" operating mode 160 in response to the heat transfer apparatus 110 in the "easier" operating mode 160 being unable to satisfy a process fluid set temperature requested by, for example, an HVAC system controller.

The method 150 further includes variables 162 of components of the heat transfer apparatus 110 that vary as the heat transfer apparatus 110 changes between the operating modes 160. In method 150, the controller 113 has received a request to minimize water consumption such that the method 150 is representative of a water saving sequence option. The request may be received from a remote device via the communication circuitry 46 or may be determined by the controller 113 based upon data available to the controller 113 such as an ambient air variable, a process fluid variable, a variable indicative of a state of a component of the heat transfer apparatus 110, or a combination thereof. Further, the PCM tank 138 is capable of discharging in the method 150.

More specifically, the operating modes 160 include a dry cooling mode 164 that may be the default mode that the controller 113 begins with in response to a request for the heat transfer apparatus 110 to provide a process fluid to the cooling load 136 at a process fluid set temperature. In the dry cooling mode 164, the variables 162 include a fan status 166, a sump pump status 168, a status 170 of whether process fluid is flowing through the fluid cooling coil 116, a status 172 of whether the evaporator 134 and PCM tank 138 are bypassed, a status 174 of the chiller 130, a status 176 of the closed-loop pump 140, and a status 178 of whether process fluid is flowing through the condenser 132 of the chiller 130. The variables 162 further include a status 180 of whether the process fluid is flowing through the evaporator 134 of the chiller 130, a status 182 of whether the process fluid is flowing through the PCM tank 138, a status 184 of the charge of the PCM tank 138, and a status 186 regarding the mode of the PCM tank 138. The status 186 indicates whether the PCM tank 138 is available to discharge or charge during the different operating modes 160 of the method 150.

In the dry cooling mode 164, the fan 124 is on, the sump pump 122 is off, the process fluid flows through the fluid cooling coil 116, and the evaporator 134 of the chiller 130 and the PCM tank 138 are fully bypassed. Further, in the dry cooling mode 164, the chiller 130 is off, the closed-loop pump 140 is off, the process fluid bypasses the condenser 132 of the chiller 130, and the process fluid is unable to flow through the evaporator 134 of the chiller 130. Still further, in the dry cooling mode 164, the process fluid bypasses the PCM tank 138 and the PCM tank 138 has a charge of greater than or equal to 0%.

As the thermal duty 152 gets harder or the thermal load increases, the controller 113 changes from the dry cooling mode 164 to another operating mode 160 based upon a determination 188 of whether the PCM tank 138 has a charge of greater than a predetermined minimum threshold such as 10%, 5%, or 0%. In the method 150, the predetermined minimum threshold is 0%.

If the PCM tank 138 has a charge of greater than the predetermined minimum threshold, the controller 113 enters a dry cooling and phase change material mode 190. In the dry cooling and phase change material mode 190, a portion of the process fluid enters the evaporator 134 of the chiller 130 and the PCM tank 138 and a portion of the process fluid bypasses the evaporator 134 and the PCM tank 138 as indicated by reference numerals 192 and 194 in method 150. Further, in the dry cooling and phase change material mode 190, the PCM tank 138 is in a discharge mode as indicated by reference numeral 196.

If, however, the controller 113 determines 188 that the PCM tank charge is not greater than the predetermined minimum threshold, the controller 113 may skip the dry cooling and PCM mode 190 and advance to a dry cooling chiller mode 200. The dry cooling and chiller mode 200 permits greater cooling capacity than the dry cooling mode 164. In the dry cooling and chiller mode 200, a portion of the process fluid flows through the condenser 132 and the evaporator 134 of the chiller 130 as shown by reference numerals 202, 204 and the chiller 130 is on as shown by reference numeral 206. Because the PCM tank 138 has a charge of 0%, the process fluid does not flow through the PCM tank 138 as shown by reference numeral 208.

If the thermal duty 152 continues to increase when the heat transfer apparatus 110 is in the dry cooling and chiller mode 200, the controller 113 determines 210 whether the PCM tank charge is greater than 0%. If the PCM tank charge is greater than 0%, the controller 113 changes the heat transfer apparatus 110 to the dry cooling, chiller, and PCM mode 212 to accommodate the increase in thermal duty 152. As shown in FIGS. 4A and 4B, the controller 113 may enter the dry cooling, chiller, and PCM mode 212 after being in the dry cooling and chiller mode 200 from the dry cooling and chiller mode 200 when the tank charge is 0% or, alternatively, the controller 113 may enter the dry cooling, chiller, and PCM mode 212 from the dry cooling and PCM mode 190 if the charge of the PCM tank 138 is greater than zero. In the dry cooling, chiller, and PCM mode 212, a portion of the process fluid flows through the chiller condenser 132 and chiller evaporator 134 as shown by reference numerals 214, 216 and the chiller 130 is on as shown by reference numeral 218. Because the PCM tank 138 has a charge greater than zero, the process fluid is directed through the PCM tank 138 as shown by reference numeral 220 which cools the process fluid and the PCM tank 138 is in a discharge mode as shown by reference numeral 222.

The controller 113 may change the operation of the heat transfer apparatus 110 from the dry cooling, chiller, and PCM mode 212 to an adiabatic cooling and PCM mode 224 upon the controller 113 determining 226 that the PCM tank charge is greater than 0% and the thermal duty 152 continuing to increase. In the adiabatic cooling and PCM mode 224, the sump pump 122 is on as shown by reference numeral 228 to pump the evaporative liquid to the precooling pad 118. In the adiabatic cooling PCM mode 224, the chiller 130 is off as shown by reference numeral 230 and the process fluid does not flow through the chiller condenser 132 or the chiller evaporator 134 as shown by reference numerals 232, 234. The process fluid flows through the PCM tank 138 as shown by reference numeral 236 and the PCM tank 138 is in the discharge mode 238 to remove heat from the process fluid.

The method 150 includes the controller 113 changing the heat transfer apparatus 110 from the adiabatic cooling and PCM mode 224 to an adiabatic cooling and chiller mode 240 in response to the controller 113 determining 242 the PCM tank 138 has a charge greater than 0% and the thermal duty 152 continuing to increase. In the adiabatic cooling and chiller mode 240, the sump pump 122 is on as shown by reference numeral 241 to wet the precooling pad 118 and decrease the dry bulb temperature of air in the heat transfer apparatus 110 before the air reaches the fluid cooling coil 116. The chiller 130 is on and at least a portion of the process fluid flows through the chiller condenser 132 and chiller evaporator 134 as shown by reference numerals 244, 246, 248. Because the PCM tank 138 has a charge of 0% at step 242, the process fluid does not flow through the PCM tank 138 in the adiabatic cooling and chiller mode 240 as shown by reference numeral 250.

The heat transfer apparatus 110 may enter the adiabatic cooling and chiller mode 240 from the adiabatic cooling and PCM mode 224 if the PCM tank has a charge of 0%. Alternatively, the heat transfer apparatus 110 may enter the adiabatic cooling and chiller mode 240 from the dry cooling and chiller mode 200 or dry cooling, chiller, and PCM mode 212 if the controller 113 determines the PCM tank 138 has a charge of 0% either at step 210 or 226, and the thermal duty 152 continues to increase.

The controller 113 may reconfigure the heat transfer apparatus 110 from the adiabatic cooling and PCM mode 224 to an adiabatic cooling, chiller, and PCM mode 252 in response to the controller 113 determining 242 that the PCM tank 138 has a charge greater than 0% and the thermal duty 152 increasing to the hard 156 level. In the adiabatic cooling, chiller, and PCM mode 252, the sump pump 122 is on as shown by reference numeral 254, the chiller 130 is on as shown by reference numeral 256, at least a portion of the process fluid flows through the chiller condenser 132 and the chiller evaporator 134 as shown by reference numerals 258, 260, and the process fluid flows through the PCM tank 130 as shown by reference numeral 262. The PCM tank 138 is in a discharge mode as shown by reference numeral 264 and removes heat from the process fluid.

The controller 113 may advance through the operating modes 160 according to the logic 158 as the thermal duty 152 increases or decreases. Alternatively, the controller 113 may hop from one operating mode 160 to another operating mode (e.g., mode 164 to mode 252 or vice versa) in response to a sudden change in the thermal duty 152 placed on the heat transfer apparatus 110.

With reference to FIGS. 5A and 5B, the controller 113 may utilize a method 270 in response to receiving a request to minimize energy consumption and the PCM tank 138 being capable of discharging to provide trim cooling. The method 270 includes operating modes 272 that the controller 113 may advance through as a thermal duty 274 changes from an initial or easy 276 level to a maximum or hard 278 level. The method 270 is similar in many respects to the method 150. One difference is that the method 270 utilizes adiabatic cooling during modes 280, 282, 284, 286 to limit energy consumption.

With reference to FIGS. 6A and 6B, the controller may utilize a method 300 in response to the controller 113 receiving a request to minimize water consumption and the PCM tank 138 is capable of being charged. The method 300 includes operating modes 302 that the controller 113 progresses through as the thermal duty 304 changes. The method 300 is similar in many respects to the method 150 discussed above and includes variables 306 that vary as the controller 113 progresses through the modes 302. One difference between methods 150 and 300 is that the modes 302 include a dry cooling closed-loop chiller mode 310 wherein the process fluid does not flow through the chiller evaporator 134 or the PCM tank 138 as shown by reference numerals 312, 314. Instead, a secondary process fluid, which may be the same or different than the process fluid flowing through the fluid cooling coil 116, is circulated by the closed-loop pump 140 as shown by the reference numeral 316. The closed-loop pump 140 pumps the secondary process fluid between the chiller evaporator 134, which cools the secondary process fluid, to the PCM tank 138 to cool the phase change material in the PCM tank 138 and charge the PCM tank 138. The process fluid flows through the fluid cooling coil 116 during operating mode 310 to satisfy the thermal load placed on the heat transfer apparatus 110.

Likewise, in the adiabatic cooling and closed loop chiller mode 316, the process fluid does not flow through the chiller evaporator 134 and PCM tank 138 as shown by reference numerals 318, 320. Instead, a secondary process fluid is circulated by the closed-loop pump 140 to permit the chiller evaporator 134 and the secondary process fluid to remove heat from the PCM tank 138 and charge the PCM tank 138. In the adiabatic cooling and closed loop chiller mode 316, the process fluid is cooled via the fluid cooling coil 116 and the adiabatic precooler 114 precooling the air upstream of the fluid cooling coil 116.

The operating modes 302 of method 300 include a dry cooling and chiller mode 309 wherein the chiller 130 operates and process fluid flows through the chiller evaporator 134 to be cooled as shown by reference numeral 311. Further, in dry cooling and chiller mode 309, a portion of the cooled process fluid flows through the PCM tank 138 to charge the PCM tank 138 as shown by reference numeral 313.

The operating modes 302 include an adiabatic cooling mode 317 wherein the chiller 130 is off. However, in the adiabatic cooling mode 317, process fluid cooled by the fluid cooling coil 116 flows to the PCM tank 138 to charge the PCM tank 138 as shown by reference numeral 319. The operating modes 302 further include an adiabatic cooling and chiller mode 321 wherein process fluid cooled by the fluid cooling coil 116 and the chiller evaporator 134 is routed to the PCM tank 138 to charge the PCM tank 138 as shown by reference numeral 323.

With reference to FIGS. 7A and 7B, the controller 113 may utilize a method 330 in response to receiving a request to minimize energy consumption and the PCM tank 138 is capable of being charged. The method 330 includes operating modes 332 that the controller 113 progresses through in response to a thermal duty 334 for the heat transfer apparatus 110 increasing.

With reference to FIG. 8, a heat transfer apparatus 350 is provided that is a second example of the heat transfer apparatus 10 discussed above. The heat transfer apparatus 350 has a process fluid heat exchange circuit 351 that receives process fluid from a cooling load 353 at an elevated temperature and cools the process fluid so that the process fluid heat exchange circuit 351 can return cooled process fluid to the cooling load 353 at a process fluid set temperature, for example. The heat transfer apparatus 350 is similar in many respects to the heat transfer apparatus 110 except that the heat transfer apparatus 350 lacks a closed-loop pump and associated valving for circulating a secondary process fluid in a closed-loop to recharge a PCM tank 368. The heat transfer apparatus 350 includes an adiabatic precooler 352 having an evaporative liquid distribution system 354 for distributing evaporative liquid onto a precooling pad 356 and a pump 358 of a sump 360 to pump collected evaporative liquid to the precooling pad 356. The heat transfer apparatus 350 further includes a fluid cooling coil 362, a fan 364, a chiller 366, and a PCM tank 368.

Regarding FIGS. 9A and 9B, a method 380 is provided that a controller 370 of the heat transfer apparatus 350 may use in response to receiving a request to minimize water consumption and the PCM tank 368 being capable of discharging. The method 380 includes modes 382 that the controller 370 progresses through according to logic 384 as a thermal duty 386 varies between an initial or easy 388 level and a maximum or hard 390 level. The method 380 includes variables 392 indicative of the state of the components of the heat transfer apparatus 350 that change throughout the different modes 382.

Regarding FIGS. 10A and 10B, a method 400 is provided that the controller 370 may implement in response to receiving a request to minimize energy consumption and the PCM tank 368 being capable of discharging. The method 400 includes modes 402 that the controller 370 progresses through according to logic 404 as a thermal duty 406 of the heat transfer apparatus 350 changes. The method 400 includes variables 403 for the components of the heat transfer apparatus 350 that vary according to the different operating modes 402.

With reference to FIGS. 11 and 11B, a method 410 is provided that the controller 370 may utilize in response to receiving a request to minimize water consumption and the PCM tank 368 being capable of being charged. The method 410 has modes 412 that the controller 370 progresses through as a thermal duty 414 of the heat transfer apparatus 350 changes. The method 410 has variables 415 of components of the heat transfer apparatus 350 that vary according to the different modes 412. One difference between the methods 300 and 410 is that the method 410 charges the PCM tank 368 using the process fluid that is received from a cooling load 353 rather than utilizing a closed-loop circulation of secondary process fluid. In this manner, the cooling provided by the fluid cooling coil 362 and/or chiller 366 is used to both cool the process fluid and to charge the PCM tank 368. The difference in operation is due to the lack of the closed-loop pump in the heat transfer apparatus 350.

Regarding FIGS. 12A and 12B, a method 420 is provided that the controller 370 may implement in response to receiving a request to minimize energy consumption and the PCM tank 368 being capable of being charged. The method 420 includes operating modes 422 that the controller 370 switches between as a thermal duty 424 of the heat transfer apparatus 350 changes. The method 420 includes variables 426 of the components of the heat transfer apparatus 350 that vary according to the different modes 422. In the method 420, the PCM tank 368 is charged using the process fluid communicated with the cooling load 353 rather than a closed-loop charging operation as in the method 330 discussed above.

With reference to FIG. 13, a heat transfer apparatus 430 is provided that is a third example of the heat transfer apparatus 10 discussed above. The heat transfer apparatus 430 is similar in many respects to the heat transfer apparatus 110 discussed above. The heat transfer apparatus 430 has a process fluid heat exchange circuit 431 that is operable in different modes to cool process fluid from a cooling load 433 and provide a supply of process fluid to the cooling load 433 at a requested process fluid set temperature, for example.

The heat transfer apparatus 430 has a secondary closed-loop pump 432 and valves 434, 436 to facilitate charging of a PCM tank 438 as discussed in greater detail below. The heat transfer apparatus 430 includes an adiabatic precooler 440 having a precooling pad 442, a sump 444 and a pump 446 to pump collected evaporative liquid to the precooling pad 442. The heat transfer apparatus 430 further includes a fluid cooling coil 448, a fan 450, and a chiller 452 having a condenser 454 and an evaporator 456. The fan 450 is operable to draw air 458 across a precooling pad 442 and the fluid cooling coil 448. The heat transfer apparatus 430 includes a primary closed-loop pump 460 and valves 462, 464. The heat transfer apparatus 430 has a controller 466 for operating the components of the heat transfer apparatus 430 in different modes.

Figure 14:
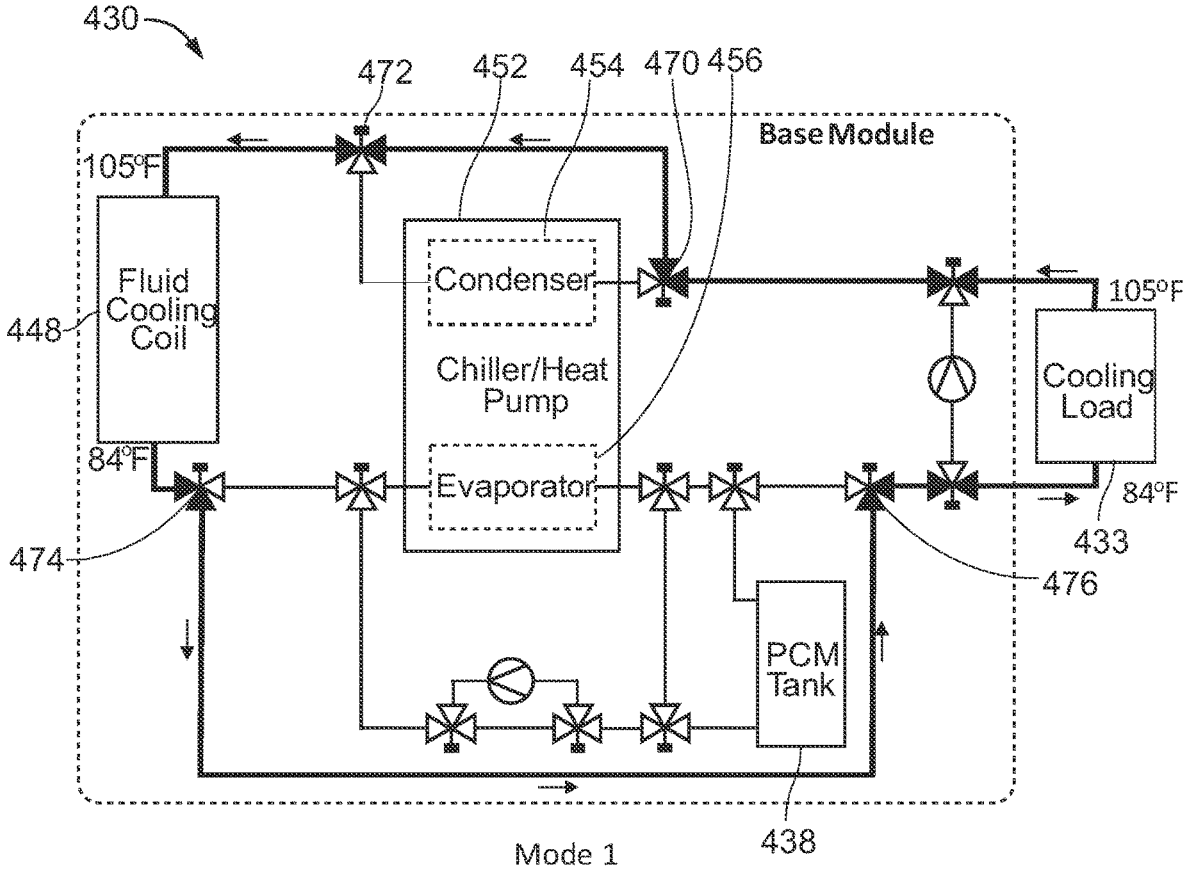

For example, the controller 466 may operate the heat transfer apparatus 430 in Mode 1 as shown in FIG. 14. The adiabatic precooler 440 is not shown in FIG. 14 to provide a less obstructed view. In Mode 1, the controller 466 operates valves 470, 472, 474, 476 of the process fluid heat exchange circuit 431 to bypass the chiller 452 and the PCM tank 438. In Mode 1, the process fluid from the cooling load 433 is cooled only by the heat exchange between air flow across the fluid cooling coil 448 by the fan 450. In Mode 1, the adiabatic precooler 440 may be operated as needed to provide adiabatic cooling by decreasing the dry bulb temperature of the air upstream of the fluid cooling coil 448.

Figure 15:
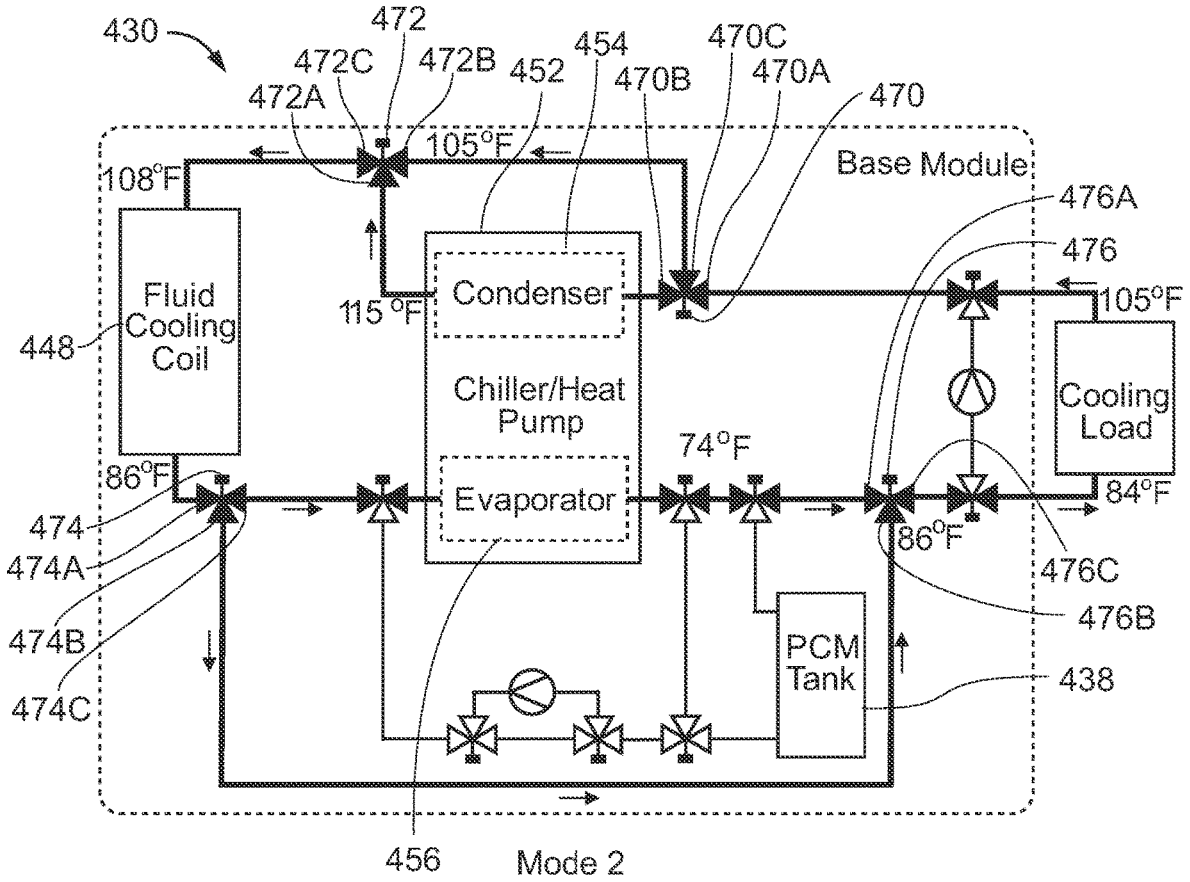

The heat transfer apparatus 430 has a Mode 2 as shown in FIG. 15. In Mode 2, the valve 470 receives process fluid at inlet 470A and modulates the flow or process fluid through the valve 470 so that a portion of the process fluid is directed to the condenser 454 of the chiller 452 and the remaining process fluid is bypassed around the condenser 454. The valve 472 receives heated process fluid at inlet 472A from the condenser 454 and process fluid from the cooling load 433 at inlet 472B. The valve 472 combines the flows of process fluid at an outlet 472C that provides the mixed process fluid to the fluid cooling coil 448. The valve 470 may be adjusted to direct more or less process fluid to the condenser 454 as needed to facilitate sufficient cooling by the evaporator 456 of the chiller 452.

The adiabatic precooler 440 may be operated as needed to reduce the dry bulb temperature of the air upstream of the fluid cooling coil 448. The fluid cooling coil 448 exchanges heat between the process fluid and airflow to provide the cooled process fluid to a valve 474. The valve 474 modulates the flow of process fluid between outlets 474B, 474C. The outlet 474C directs the cooled process fluid to the evaporator 456 of the chiller 452 which further cools process fluid. The process fluid from outlet 474B bypasses the evaporator 456 and the PCM tank 438 before reaching the valve 476. The valve 476 combines the process fluid flows received at inlets 476A, 476B into a flow that travels from an outlet 476C of the valve 476 to the cooling load 433. In this manner, a portion of the cooling load is handled by the fluid cooling coil 448 (and adiabatic precooler 440 as needed) and a portion of the cooling load is handled by the chiller 452. Mode 2 may be used during high load or high ambient air temperature conditions, and/or when the PCM tank 438 is fully discharged, as a way to meet the cooling duty required for the heat transfer apparatus 430. Mode 2 may also be used to save water by using the chiller 452 to provide cooling capacity which reduces the cooling load required of the adiabatic precooler 440 and fluid cooling coil 448. More specifically, Mode 2 permits the speed of the fan 450 to be reduced which reduces a water evaporation rate from the pad or other adiabatic medium of the adiabatic precooler 440.

Figure 16:
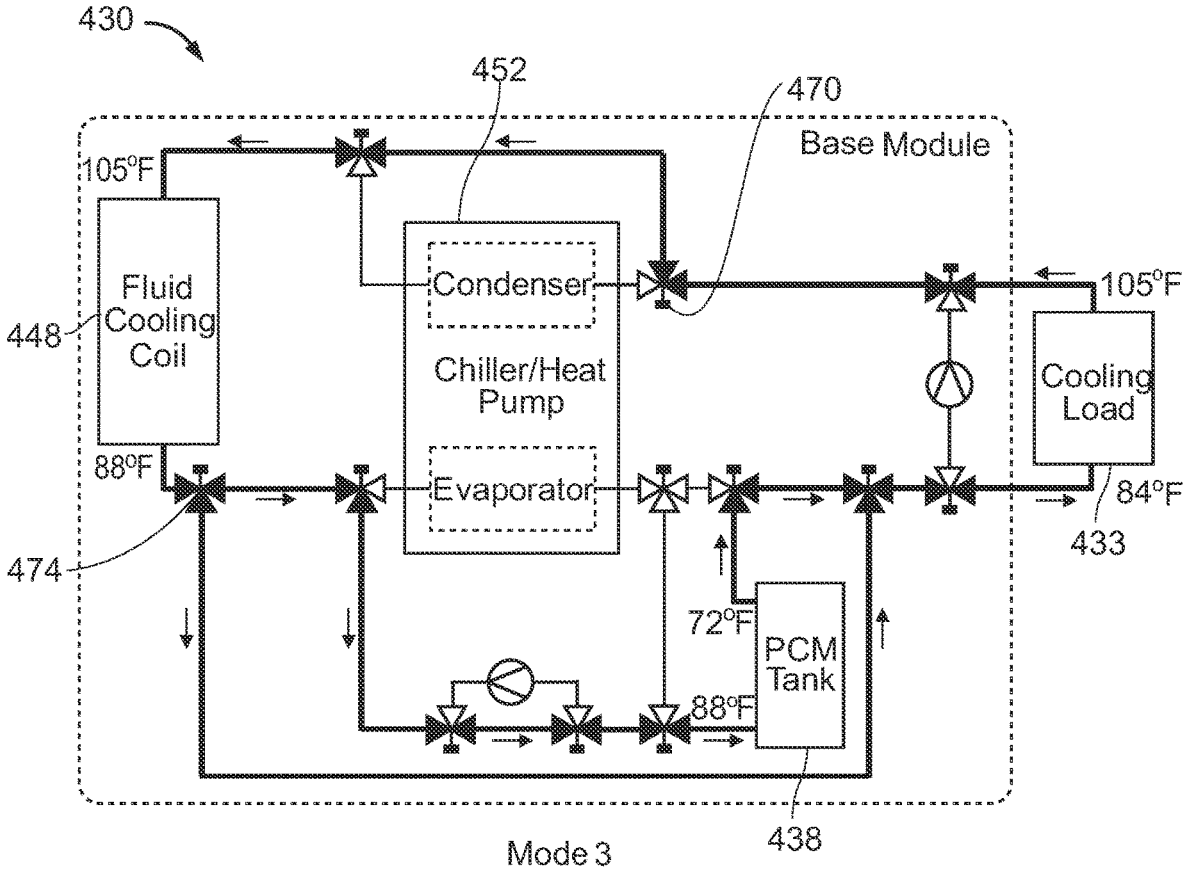

Regarding FIG. 16, the controller 466 may operate the heat transfer apparatus 430 in Mode 3 wherein valves 470, 480 bypass flow of process fluid around the chiller 452. The valve 474 directs a portion of the process fluid from the fluid cooling coil 448 toward the PCM tank 438 and the remaining portion of the process fluid bypasses the PCM tank 438. In this manner, in Mode 3, part of the cooling load 433 is handled by the fluid cooling coil 448 and adiabatic precooler 440 as needed and part of the cooling load 433 is handled by discharging of the PCM tank 438. Mode 3 may be used during very high cooling load situations, high ambient air temperature situations, and/or may be used to save energy and/or water by reducing the load on the fluid cooling coil 448, fan 450, and adiabatic precooler 440.

Figure 17:
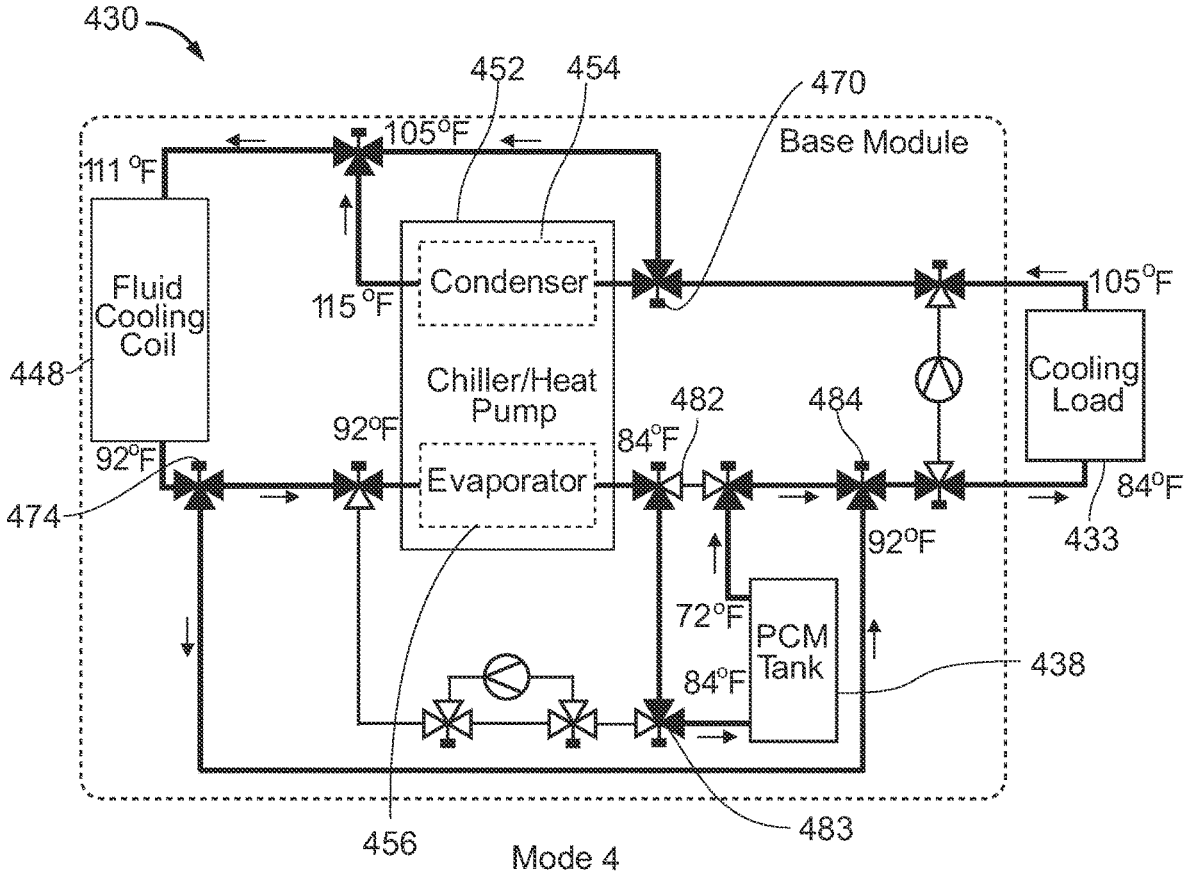

Regarding FIG. 17, the controller 466 may operate in Mode 4 wherein the valve 470 directs at least a portion of the process fluid from the cooling load 433 to the condenser 454 of the chiller 452. The valve 474 modulates the flow of process fluid so that a portion of the process fluid flows to the evaporator 456 of the chiller 452 and the remaining process fluid bypasses the chiller 452 and the PCM tank 438. Further, the valves 482, 483 direct the process fluid from the evaporator 456 to the PCM tank 438 and the valve 484 combines the cooled process fluid from the PCM tank 438 and the process fluid from the fluid cooling coil 448. In Mode 4, part of the cooling load is handled by the fluid cooling coil 448 and optionally the adiabatic precooler 440, part of the cooling load is handled by the chiller 452, and part of the cooling load is handled by the PCM tank 438. Mode 4 may be used during high cooling load situations, high ambient air temperature conditions, as a way to satisfy a cooling duty requirement, and/or may be used to save water by reducing the load on the fluid cooling coil 448, adiabatic precooler 440 or save energy by reducing the load on the fan 450.

Figure 18:
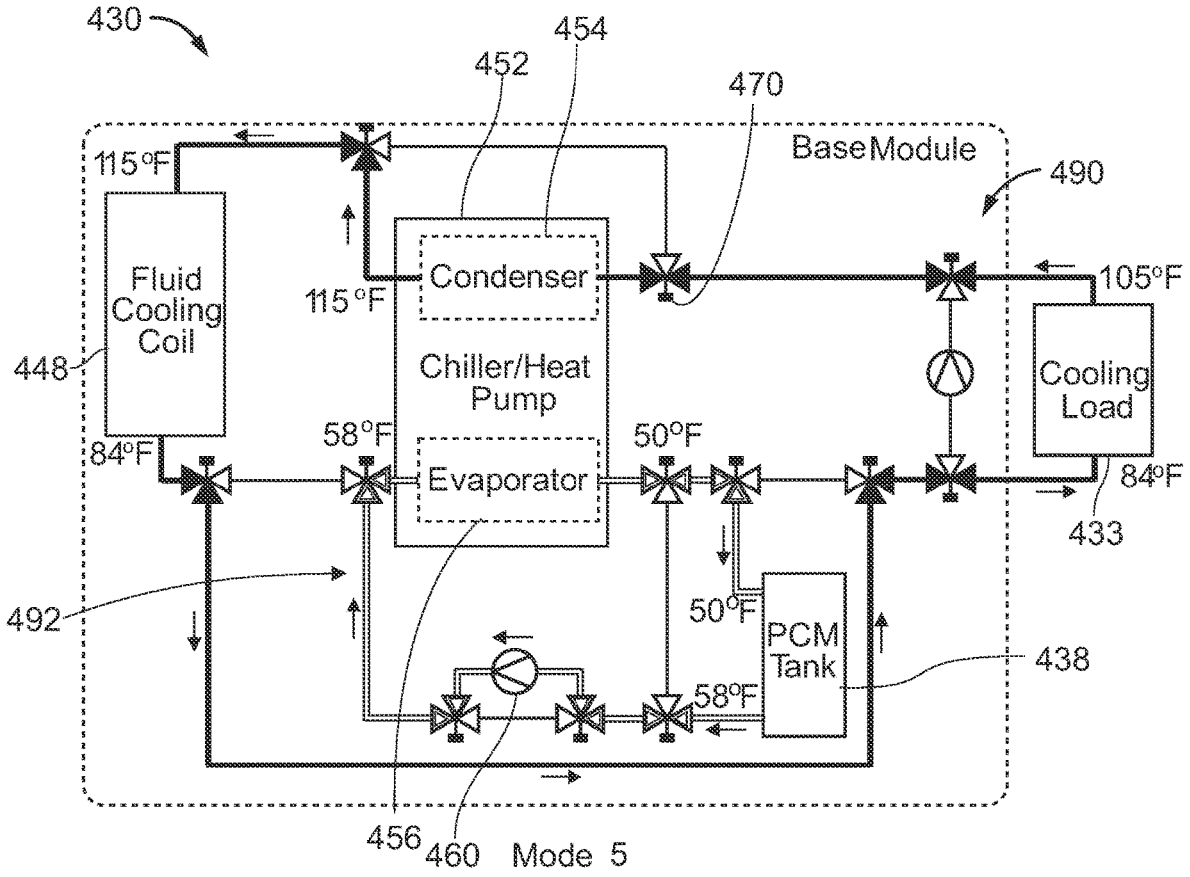

Regarding FIG. 18, the controller 466 may operate the heat transfer apparatus 430 in Mode 5 wherein there is a first loop 490 of process fluid traveling between the cooling load 433 and the fluid cooling coil 448 and a second loop 492 of closed-loop process fluid circulated between the evaporator 456 of the chiller 452 and the PCM tank 438 via the primary closed-loop pump 460. The valve 470 directs the process fluid from the cooling load 433 through the condenser 454 such that the process fluid absorbs heat from the condenser 454 before traveling to the fluid cooling coil 448. The fluid cooling coil 448 is used to absorb heat from both the cooling load 433 and the process of recharging the PCM tank 438. The adiabatic precooler 440 may be turned on in Mode 5 to increase the cooling capacity of the fluid cooling coil 448 as needed. Mode 5 may be used to charge a fully or partially depleted PCM tank 438 while continuing to reject heat from the cooling load 433.

Figure 19:
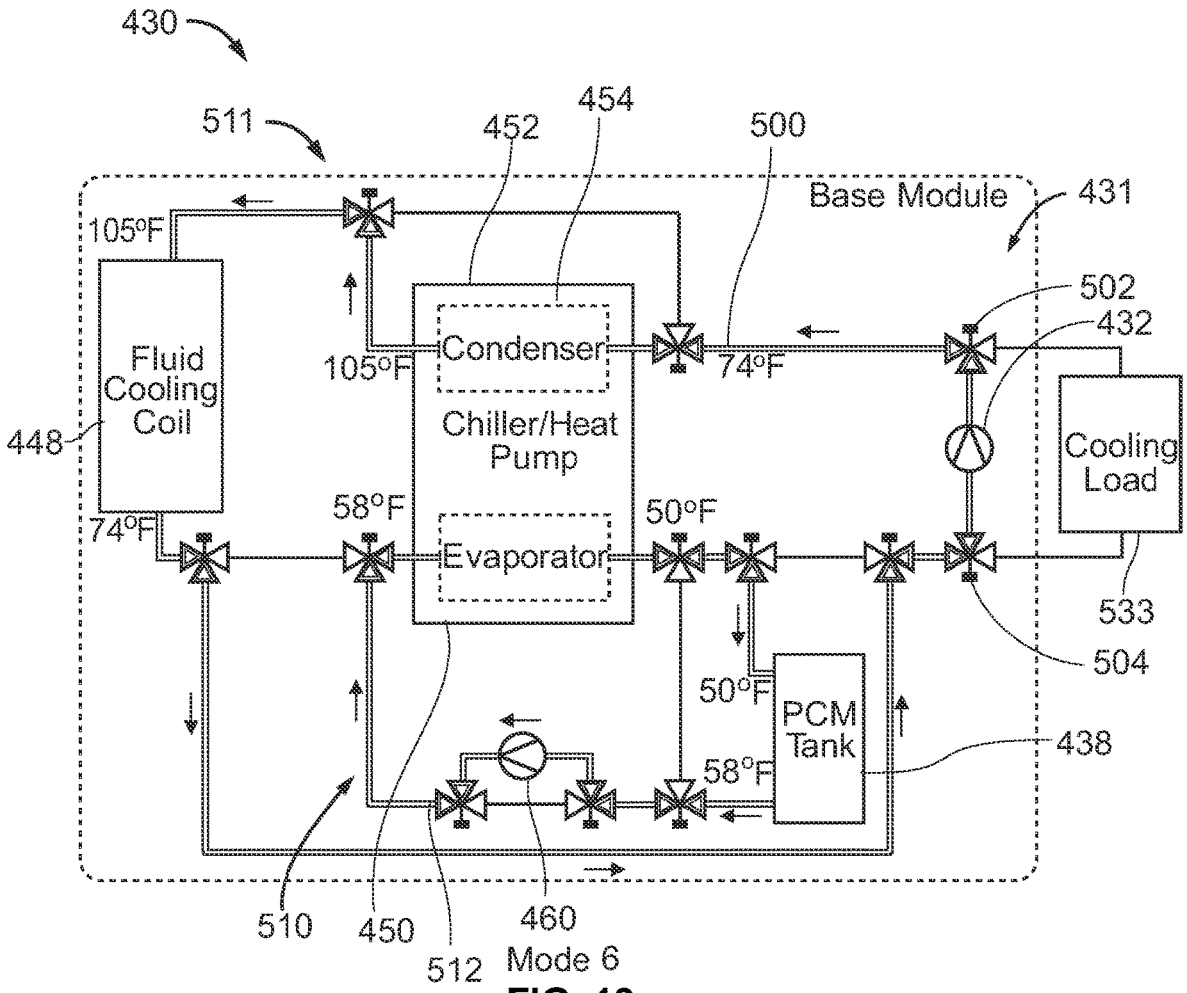

Regarding FIG. 19, the controller 466 may operate the heat transfer apparatus 430 in Mode 6 wherein the process fluid heat exchange circuit 431 has a primary closed loop 510 similar to the closed loop 492 in FIG. 18 and a secondary closed loop 511. More specifically, the valves 502, 504 are closed to the cooling load 433 and the secondary closed-loop pump 432 circulates the secondary closed-loop process fluid 500 between the condenser 454 of the chiller 452 and the fluid cooling coil 448 such that the fluid cooling coil 448 removes heat added to the secondary closed-loop process fluid 500 by the condenser 454.

In Mode 6, the primary closed-loop pump 460 circulates a secondary process fluid 512 between the evaporator 450 and the PCM tank 438 throughout the primary closed loop 510. In this manner, the evaporator 450 removes heat from the primary closed-loop process fluid which is then used to charge the PCM tank 438. Mode 6 may be used to recharge a fully or partially depleted PCM tank 438 when the heat transfer apparatus 430 is not required to satisfy the cooling load 433, such as during evening hours. The adiabatic precooler 440 may be operated to provide increased cooling capacity as needed.

With reference to FIGS. 20A and 20B, the controller 466 may utilize a method 520 in response to receiving a request to minimize water consumption and the PCM tank 438 being capable of discharging. The method 520 includes operating modes 522 and logic 524 that the controller 466 utilizes to advance through the operating modes 522 in response to changes of a thermal duty 526 of the heat transfer apparatus 430 as determined by the controller 466. The method 520 has variables 528 of the components of the heat transfer apparatus 430 that change as the heat transfer apparatus 430 changes between the modes 522.

Regarding FIGS. 21A and 21B, the controller 466 may utilize a method 530 in response to receiving a request to minimize energy consumption and the PCM tank 438 being capable of discharging. The method 530 includes operating modes 532 and logic 534 the controller 466 utilizes to advance through the operating modes 532 as a thermal duty 536 of the heat transfer apparatus 430.

Regarding FIGS. 22A and 22B, the controller 466 may utilize a method 540 in response to receiving a request to minimize water consumption and the PCM tank 438 is capable of being charged. The method 540 includes operating modes 542 that the controller 466 may advance through as a thermal duty 544 of the heat transfer apparatus 430 varies. The method 540 has variables 545 of the components of the heat transfer apparatus 530 that vary as the heat transfer apparatus 530 changes between the modes 542. The modes 542 include a closed-loop dry cooling mode 546 in accordance with Mode 6 of FIG. 19 when the adiabatic precooler 440 is not operating. In one embodiment, the heat transfer apparatus 430 includes an actuator to move the adiabatic precooler 440 from an operating position wherein a pad of the adiabatic precooler 440 is in a path of airflow through the heat transfer apparatus 430 to a bypass position wherein the pad is out of the path of the airflow. When the pad is in the bypass position, the energy consumption of the fan 450 may be reduced. The operating modes 542 further include a closed-loop adiabatic cooling mode 548 that corresponds to Mode 6 in FIG. 19 when the adiabatic precooler 440 is operating. In either mode 546, 548, the heat transfer apparatus 430 is closed off from the cooling load 433 and is able to charge the PCM tank 438.

Regarding FIGS. 23A and 23B, the controller 466 may utilize a method 550 in response to receiving a request to minimize energy consumption and the PCM tank 438 is capable of being charged. The method 550 includes modes 552 that the controller 466 advances through as the thermal duty 554 of the heat transfer apparatus 430 varies. The method 550 includes variables 556 of the components of the heat transfer apparatus 430 that change as the heat transfer apparatus 430 is reconfigured between the operating modes 552. The operating modes 552 include a closed-loop adiabatic cooling mode 558 that corresponds generally to Mode 6 in FIG. 19 and the adiabatic precooler is operated to improve the efficiency of the fluid cooling coil 448.

Regarding FIG. 24, heat transfer apparatus 560 is a fourth example of the heat transfer apparatus 10 of FIG. 1. The heat transfer apparatus 560 is similar in structure and operation to the heat transfer apparatus 350 discussed above. One difference is that the heat transfer apparatus 560 has a heat exchanger 562 that includes a direct heat exchanger 564 having an evaporative liquid distribution system 566 that distributes evaporative liquid onto the fill 568, a sump 570 to collect the evaporative liquid, and a pump 572 to pump the collected evaporative liquid back to fill 568. The heat transfer apparatus 560 has a fan 574 that generates air flow 576 relative to the direct heat exchanger 554 such that the evaporative liquid is cooled as the evaporative liquid travels along the fill 568 and is as contacted by the air flow 576. The pump 572 transfers cooled evaporative liquid from the sump 570 to an indirect heat exchanger 580 of the heat exchanger 562. The indirect heat exchanger 580 transfer heat between the evaporative liquid and a process fluid 582 that is received from a cooling load 584.

Regarding FIG. 25, a heat transfer apparatus 590 is provided that is a fifth example of the heat transfer apparatus 10 discussed above. The heat transfer apparatus 590 is similar to the heat transfer apparatus 560 discussed above. One difference between the heat transfer apparatuses 560, 590 is that the heat transfer apparatus 590 has a direct heat exchanger 592 that transfers heat directly from a process fluid 594 received from a cooling load 596 to an airflow 598 generated by a fan 600. The direct heat exchanger 592 may include, for example, fill sheets and/or fill blocks. Trickle fill, splash fill, or fill-less approaches may be used.

With respect to FIG. 26, a heat transfer apparatus 610 in accordance with a second approach is provided. The heat transfer apparatus 610 includes a heat exchanger 612 having an adiabatic precooler 614 with an adiabatic pad 616 and an indirect heat exchanger such as a fluid cooling coil 618. The heat transfer assembly 610 further includes a thermal energy storage such as a PCM tank 620 to provide trim chilling as needed for the heat transfer apparatus 610 to satisfy a thermal load on the heat transfer apparatus 610. The heat transfer apparatus 610 has one or more air inlets 622, one or more air outlets 624, and a fan 626 operable to cause movement of air from the air inlets 622 to the air outlets 624 across the precooling pad 616 and the fluid cooling coil 618.

Regarding FIG. 27, a more detailed schematic representation of the heat transfer apparatus 610 is provided. The heat transfer apparatus 610 is similar in many respects to the heat transfer apparatus 10 discussed above except that the heat transfer apparatus 610 lacks the chiller 28. The heat transfer apparatus 610 includes an outer structure such as a housing 630 that contains the heat exchanger 612, a process fluid distribution system 632, a controller 634, and a PCM tank 620. The PCM tank 620 contains a phase change material having a melting temperature of, for example greater than 65° F. The heat transfer apparatus 610 has a process fluid inlet 636 to receive a heated process fluid from a cooling load and a process fluid outlet 638 to return cooled process fluid to the cooling load.

Regarding FIG. 28, a heat transfer apparatus 640 is a first example of the heat transfer apparatus 610 of FIG. 26. The heat transfer apparatus 640 has a process fluid heat exchange circuit 641 for receiving heated process fluid from a cooling load 654 and returning cooled process fluid to the cooling load 654. The process fluid heat exchange circuit 641 includes an adiabatic precooler 642, fluid cooling coil 644, a closed-loop pump 646, a PCM tank 648, and a controller 650. Because the heat transfer apparatus 640 lacks a chiller like the chiller 452 of FIG. 13, the heat transfer apparatus 640 utilizes the adiabatic precooler 642 and the fluid cooling coil 644 to provide cooling for the process fluid from a cooling load 654 as well as recharging the PCM tank 648.

Figure 29:
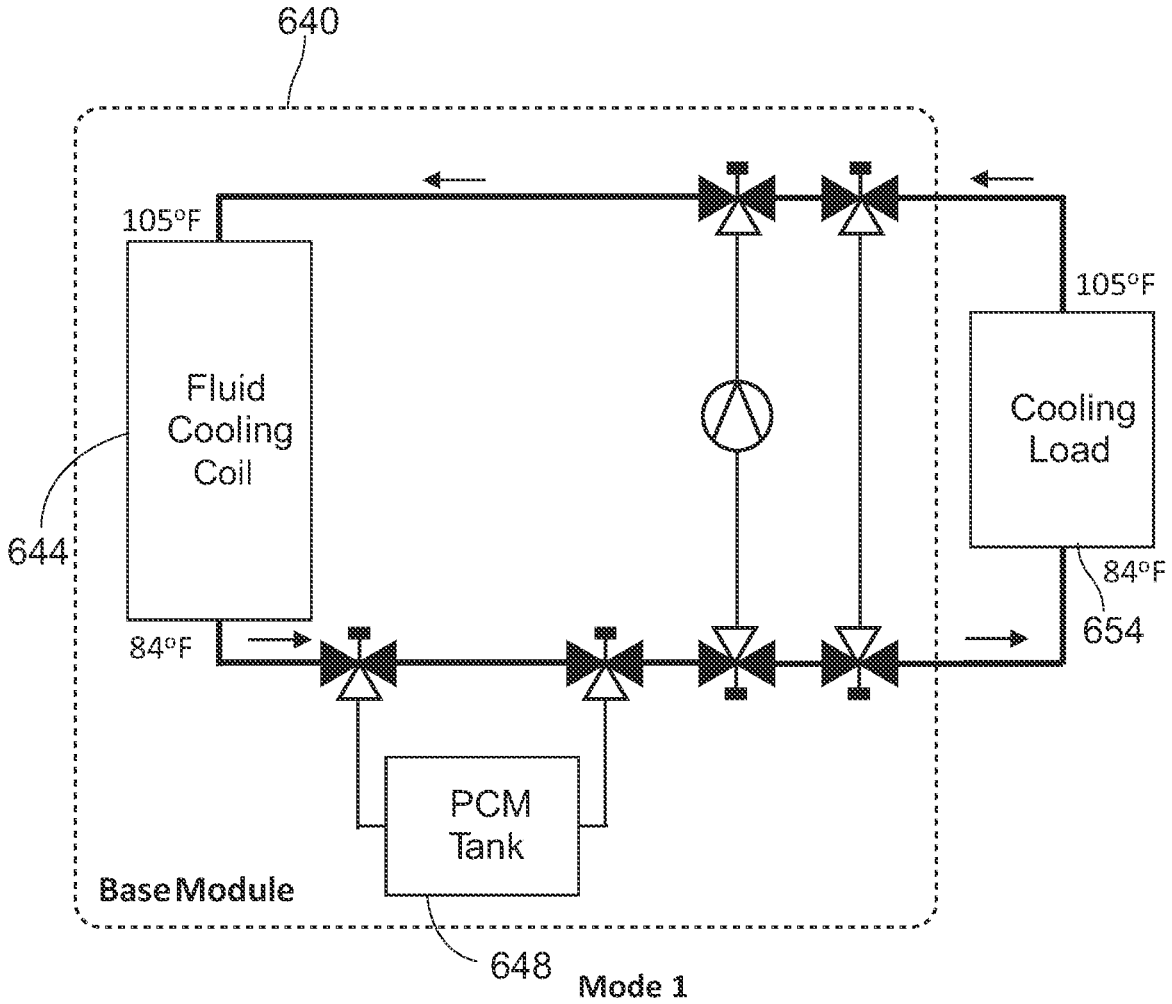

Regarding FIG. 29, the heat transfer apparatus 640 has a Mode 1 wherein the controller 650 operates the heat transfer apparatus 640 such that the heated process fluid from the cooling load 654 travels to the fluid cooling coil 644 and is returned to the cooling load 654 while bypassing the PCM tank 648. The adiabatic precooler 642 may be operated to lower the dry bulb temperature of air contacting the fluid cooling coil 644 to provide an increased cooling capacity for the heat transfer apparatus 640 when the controller 650 is in Mode 1.

Figure 30:
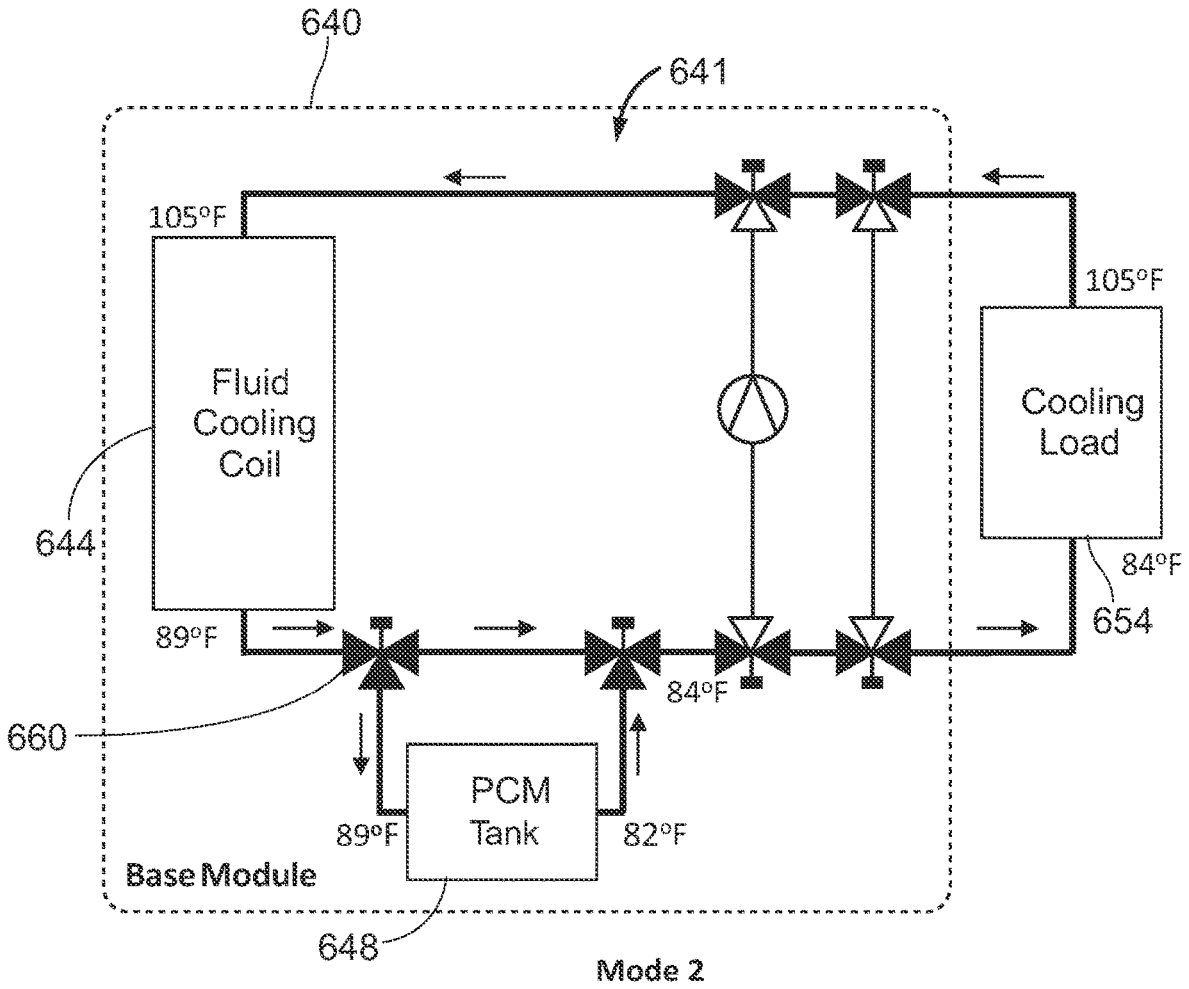

Regarding FIG. 30, the heat transfer apparatus 640 has a Mode 2 wherein both the fluid cooling coil 644 and the PCM tank 648 handle the cooling load 654. The process fluid heat exchange circuit 641 includes a valve 660 that modulates the process fluid flow from the fluid cooling coil 644 so that a portion of the process fluid travels to the PCM tank 648 and is cooled as the PCM tank 648 discharges. In this manner, the PCM tank 648 may be discharged during peak thermal loads to supplement cooling provided by the fluid cooling coil 644. The adiabatic precooler 642 may be operated to lower the dry bulb temperature of air contacting the fluid cooling coil 644 to provide an increased cooling capacity for the heat transfer apparatus 640 when the controller 650 is in Mode 2.

Figure 31:
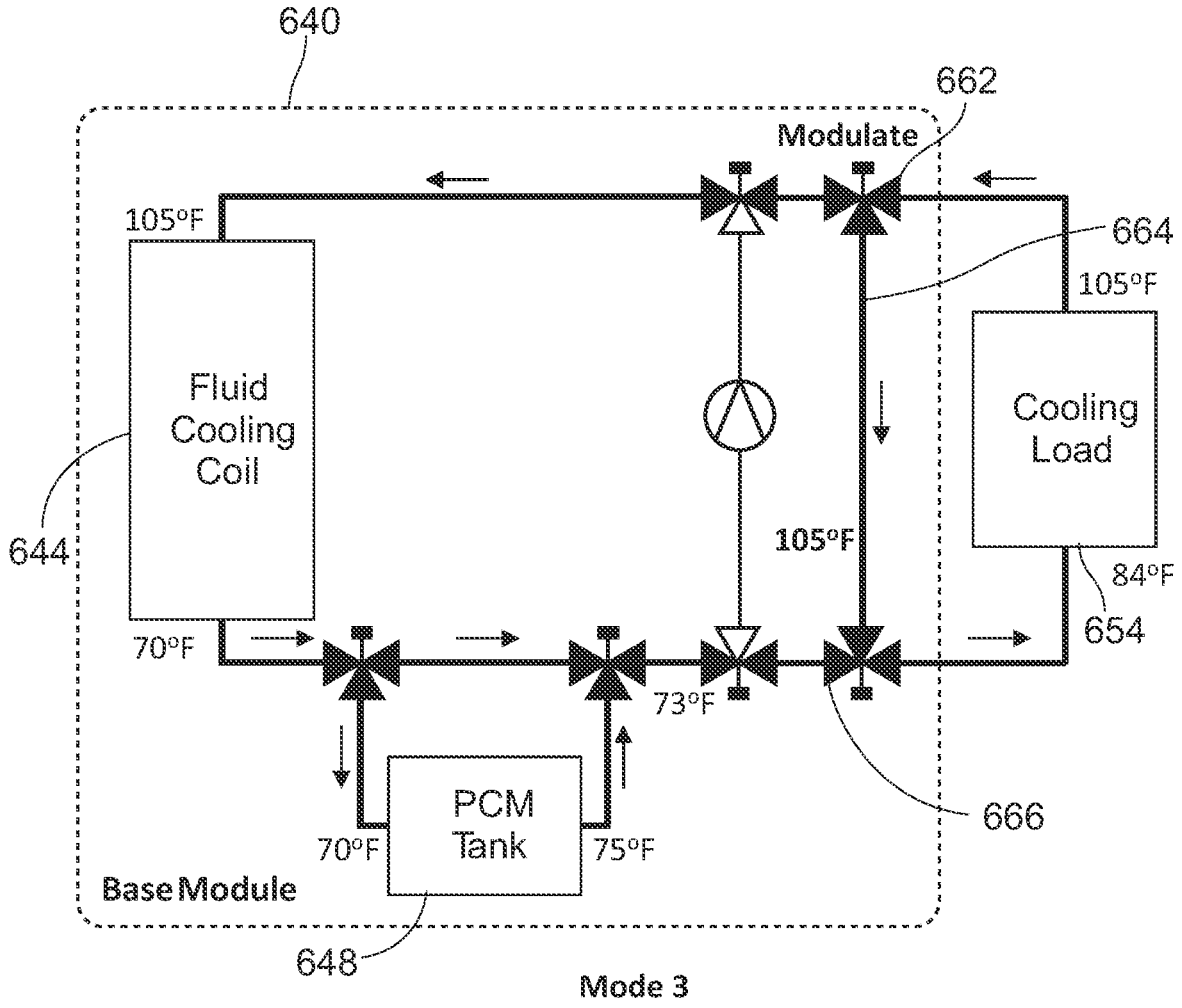

Regarding FIG. 31, the heat transfer apparatus 640 has a Mode 3 wherein a valve 662 modulates the flow of process fluid from the cooling load 654 so that a portion 664 of the process fluid from the cooling load 654 is directed to a valve 666 for mixing with process fluid from the fluid cooling coil 644 and the PCM tank 648. In Mode 3, the adiabatic precooler 642 may be utilized which decreases the temperature of the process fluid leaving the fluid cooling coil 644. Due to the lower process fluid temperature from the fluid cooling coil 644, the PCM tank 648 can be charged. The process fluid leaving the fluid cooling coil 644 and the PCM tank 648 is combined with the circulated process fluid 664 via valve 666 so that the process fluid returned to the cooling load 654 still has the same return temperature as in Mode 2. Mode 3 may be utilized when ambient and load conditions allow for the fluid cooling coil 644 to significantly cool the process fluid. The recirculated portion 664 of the process fluid is used to raise the temperature of the process fluid from the fluid cooling coil 664 and PCM tank 648 and ensure the process fluid is returned to the cooling load 654 at the requested process fluid set temperature.

Figure 32:
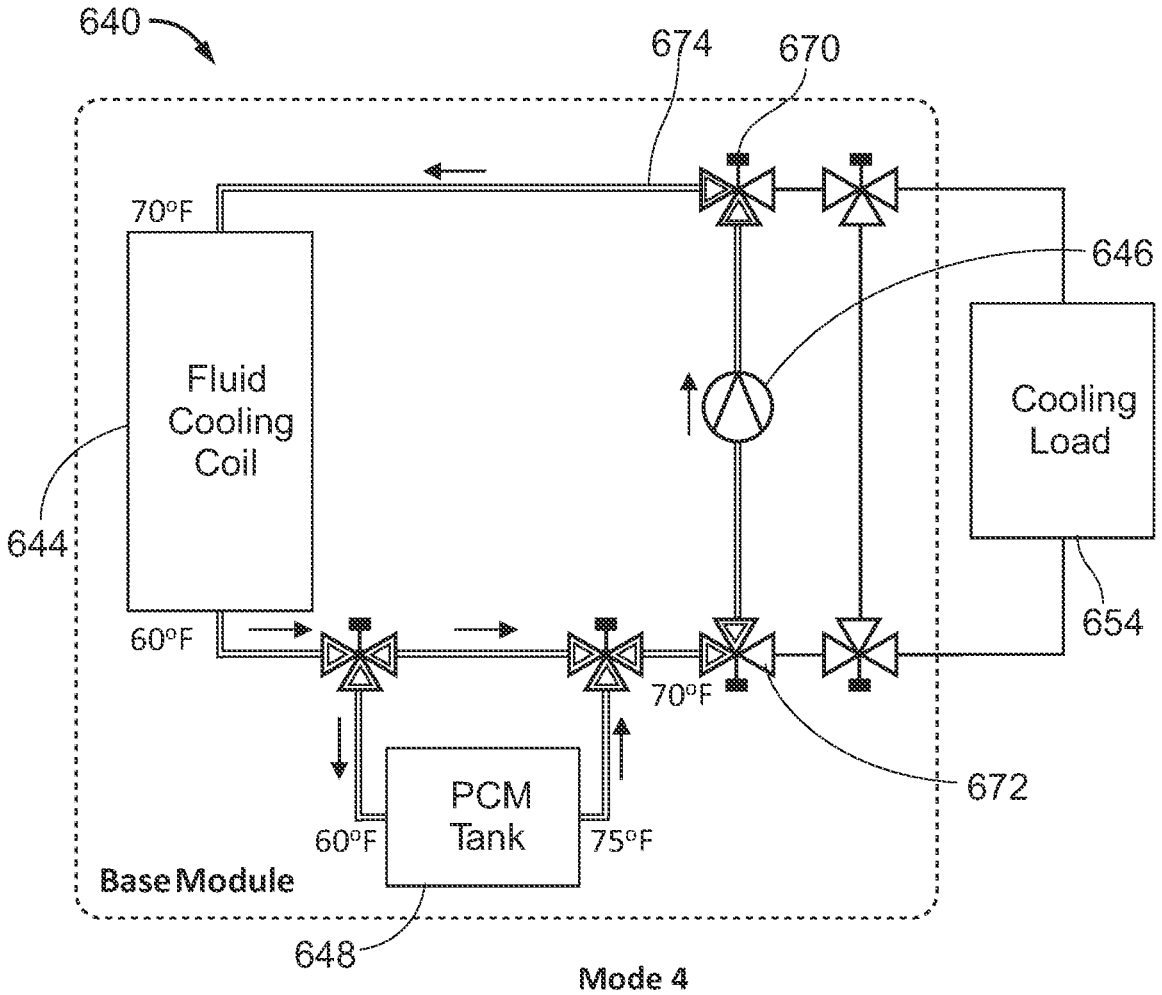

Regarding FIG. 32, the heat transfer apparatus 640 has a Mode 4 wherein valves 670, 672 are closed to the cooling load 654 and the closed-loop pump 646 is operated to circulate a closed-loop fluid 674 between the fluid cooling coil 644 and the PCM tank 648 to recharge the PCM tank 648. The adiabatic precooler 642 may be operating or non-operating as needed for a particular situation. By not operating the adiabatic precooler 642, the controller 650 reduces water consumption of the heat transfer apparatus 640. By operating the adiabatic precooler 642 during Mode 4, the controller 650 may minimize energy consumption of the heat transfer apparatus 640.

Regarding FIG. 33, the controller 650 may utilize a method 690 in response to receiving a request to minimize water consumption and the PCM tank 648 is capable of discharging. The controller 650 changes between operating modes 692 using logic 694 as the thermal duty 696 of the heat transfer apparatus 640 varies. The method 690 includes variables 698 of the components of the heat transfer apparatus 640 that change as the controller 650 changes between different modes 692.

Regarding FIG. 34, the controller 650 may utilize a method 700 in response to receiving a request to minimize energy consumption and the PCM tank 648 being capable of discharging. The method 700 includes operating modes 702 and logic 704 that the controller 650 utilizes to change between the modes 702 as a thermal duty 706 of the heat transfer apparatus 640 varies. The method 700 includes variables 708 of the heat transfer apparatus 640 that change as the controller 650 changes between the modes 702.

Regarding FIG. 35, the controller 650 may utilize a method 710 in response to receiving a request to minimize water consumption and the PCM tank 648 is capable of being charged. The method 710 includes modes 712 that the controller 650 may change between as a thermal load 714 of the heat transfer apparatus 640 changes. The modes 712 include a closed-loop dry cooling mode 716 that is similar to Mode 4 shown in FIG. 32 wherein the closed-loop pump 646 operates and a closed-loop fluid is circulated between the fluid cooling coil 644 and the PCM tank 648 to recharge the PCM tank 648. In the closed-loop dry cooling mode 716, the adiabatic precooler 742 is off. By contrast, the operating modes 712 include a closed-loop adiabatic cooling mode 718 similar to Mode 4 of FIG. 32 wherein the adiabatic precooler 642 is operating.

Regarding FIG. 36, the controller 650 may utilize a method 720 in response to receiving a request to minimize energy consumption and the PCM tank 648 being capable of being charged. The method 720 includes operating modes 722 that the controller 650 may change between in response to changes of a thermal duty 724 of the heat transfer apparatus 640. The method 720 includes variables 726 of the heat transfer apparatus 640 that change as the heat transfer apparatus 640 changes between the modes 722.

Regarding FIG. 37, a heat transfer apparatus 730 is provided that is a second example of the heat transfer apparatus 610 discussed above. The heat transfer apparatus 730 is similar in many respects to the heat transfer apparatus 640 except that the heat transfer apparatus 730 lacks the closed-loop pump 646. The heat transfer apparatus 730 includes a process fluid heat exchange circuit 731 including an adiabatic precooler 732, a fluid cooling coil 734, a fan 736, and a PCM tank 741. The heat transfer apparatus 730 has a controller 738 that operates the process fluid heat exchange circuit 731 to return process fluid to the cooling load 740 with a particular process fluid variable, such as temperature, flow rate, pressure, or a combination thereof. The PCM tank 741 removes heat from the process fluid when the PCM tank 741 is operated to satisfy maximum thermal load conditions, to reduce water consumption, or reduce energy consumption as appropriate.

Regarding FIG. 38, the processor 738 may utilize a method 750 in response to receiving a request to minimize water consumption and the PCM tank 740 being capable of discharging. The method 750 includes modes 752 and logic 754 that the controller 738 utilizes to change between the modes 752 as a thermal duty 756 of the heat transfer apparatus 730 changes. The method 750 includes variables 760 of the components of the heat transfer apparatus 730 that change as the heat transfer apparatus 730 changes between modes 752.

Regarding FIG. 39, the controller 738 may utilize a method 770 in response to receiving a request to minimize energy consumption and the PCM tank 741 being capable of discharging. The method 770 includes operating modes 772 of the heat transfer apparatus 730 and logic 774 that the controller 738 utilizes to change between the operating modes 772 as a thermal duty 776 of the heat transfer apparatus 730 changes. The method 770 includes variables 778 of the components of the heat transfer apparatus 730 that change as the controller 738 changes between the modes 772.

Regarding FIG. 40, the controller 738 may utilize a method 780 in response to receiving a request to minimize water consumption and the PCM tank 741 being capable of being charged. The method 780 includes operating modes 782 that the controller 738 changes between as a thermal duty 784 of the heat transfer apparatus 730 changes. The method 780 includes variables 786 of the components of the heat transfer apparatus 730 that change as the heat transfer apparatus 730 changes between modes 782.

Regarding FIG. 41, the controller 738 may utilize a method 790 in response to receiving a request to minimize energy consumption and the PCM tank 748 being capable of being charged. The method 790 includes the controller 738 having an adiabatic cooling mode 792 wherein a sump pump 794 (see FIG. 37) of the adiabatic precooler 732 is on and a valve 796 directs at least a portion of the cooler process fluid to the PCM tank 741 to charge the PCM tank 741.

Regarding FIG. 42, heat transfer apparatus 800 is a third example of the heat transfer apparatus 610 discussed above. The heat transfer apparatus 800 is similar to the heat transfer apparatus 640 discussed above except that the heat transfer apparatus 800 has a direct heat exchanger 802 to transfer heat between air flow 804 generated by a fan 806 and evaporative liquid. The evaporative liquid is collected and directed through an indirect heat exchanger 808 to transfer heat between process fluid received from a cooling load 810 and the evaporative fluid of the direct heat exchanger 802.

Regarding FIG. 43, heat transfer apparatus 810 is a fourth example of the heat transfer apparatus 610 discussed above. The heat transfer apparatus 810 is similar to the heat transfer apparatus 640 except that the heat transfer apparatus 810 has a direct heat exchanger 812 for transferring heat between air flow 814 generated by a fan 816 and process fluid received from a cooling load 818.

Regarding FIG. 44, a heat transfer apparatus 850 is provided in accordance with a third approach of the present disclosure. The heat transfer apparatus 850 includes a housing 851 having one or more air inlets 854, one or more air outlets 857, and one or more fans 859 for generating an airflow 859 from the air inlet 854 to the air outlet 856. The air inlets 854 include primary louvers 856 and secondary louvers 858 that are selectively closable to restrict the path of air flow through the heat transfer apparatus 850. For example, the primary louvers 856 may be closed and the secondary louvers 858 may be opened to bypass air around the membrane vacuum dehumidification system 860.

The heat transfer apparatus 850 has one or more dehumidifiers, such as a membrane vacuum dehumidification system 860 to remove water from the air flow in an area 862 upstream of an adiabatic precooler 864 having a precooling pad 866. The heat transfer apparatus 850 has a heat exchanger such as fluid cooling coil 868 downstream of the precooling pad 866. The membrane vacuum dehumidification system 860 removes water from the air and decreases the air wet bulb temperature. The precooling pad 866 cools the air upstream of the fluid cooling coil 868 and decreases the air dry bulb temperature to be very close to the air wet bulb temperature. The dry and cooled air contacting the fluid cooling coil 868 provides more efficient heat transfer between the air flow 859 and the fluid cooling coil 868.

Regarding FIG. 45, heat transfer apparatus 880 is a first example of the heat transfer apparatus 850 of FIG. 44. The heat transfer apparatus 880 includes primary louvers 882, secondary louvers 884, and a process fluid cooling system 881. The process fluid cooling system 881 includes a membrane vacuum dehumidification system 886, an adiabatic precooler 888, a fluid cooling coil 890, and a fan 892. The heat transfer apparatus 880 further includes a vacuum pump 894 of the membrane vacuum dehumidification system 886 and a controller 896 for controlling operation of the heat transfer apparatus 880. The adiabatic precooler 888 includes a precooling pad 900, an evaporative liquid distribution system 902, a sump 904, and a sump pump 906. The heat transfer apparatus 880 includes a water collection system 910 having a condensed water pump 912 that directs water collected and condensed from the membrane vacuum dehumidification system 886 to the sump 904. In this manner, the heat transfer apparatus 880 may utilize at least a portion of the water collected from the membrane vacuum dehumidification system 886 as makeup water for the sump 904 which may decrease the water consumption of the heat transfer apparatus 880. The fluid cooling coil 890 receives hot process fluid from a cooling load 916 and returns cooled process fluid to the cooling load 916. The fan 892 is operable to direct air along a first path 920 when the primary louvers 882 are open and the secondary louvers 884 are closed. When the primary louvers 882 are closed and the secondary louvers 884 are open, operating the fan 892 causes air to enter through secondary louvers 884 along a second path 922. The membrane vacuum dehumidification system 886 and the adiabatic precooler 888 may be selectively operated to increase efficiency of heat transfer between the fluid cooling coil 890 and the air flow through the heat transfer apparatus 880.

Regarding FIGS. 46-50, the heat transfer apparatus 880 is shown in different modes to illustrate the different cooling capacities of the heat transfer apparatus 880 in the different modes. Regarding FIG. 46, the heat transfer apparatus 880 is in Mode 1 wherein the primary louvers 882 are open, the secondary louvers 920 are closed, the membrane vacuum dehumidification system 886 is operating, the adiabatic precooler 888 is operating, and the fluid cooling coil 890 is transferring heat between the air flow and the process fluid from the cooling load 916.

Figure 47:
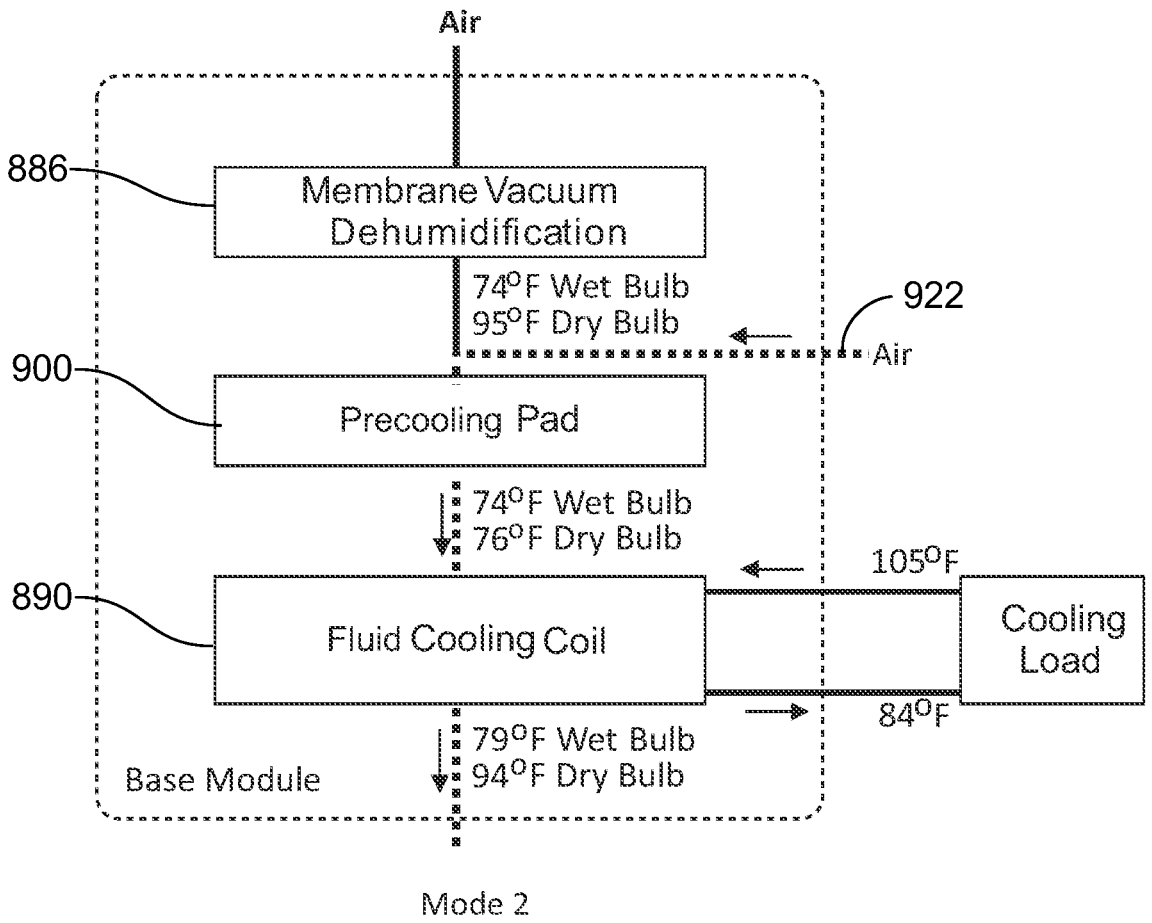

Regarding FIG. 47, the heat transfer apparatus 880 is in Mode 2 wherein the primary louvers 882 are closed and the secondary louvers 884 are open such that air flow bypasses the membrane vacuum dehumidification system 886. The air travels along the second flow path 922 through the precooling pad 900 and to the fluid cooling coil 890. In Mode 2, the adiabatic precooler 888 is operating such that the precooling pad 900 decreases the dry bulb temperature of the air flow upstream of the fluid cooling coil 890.

Figure 48:
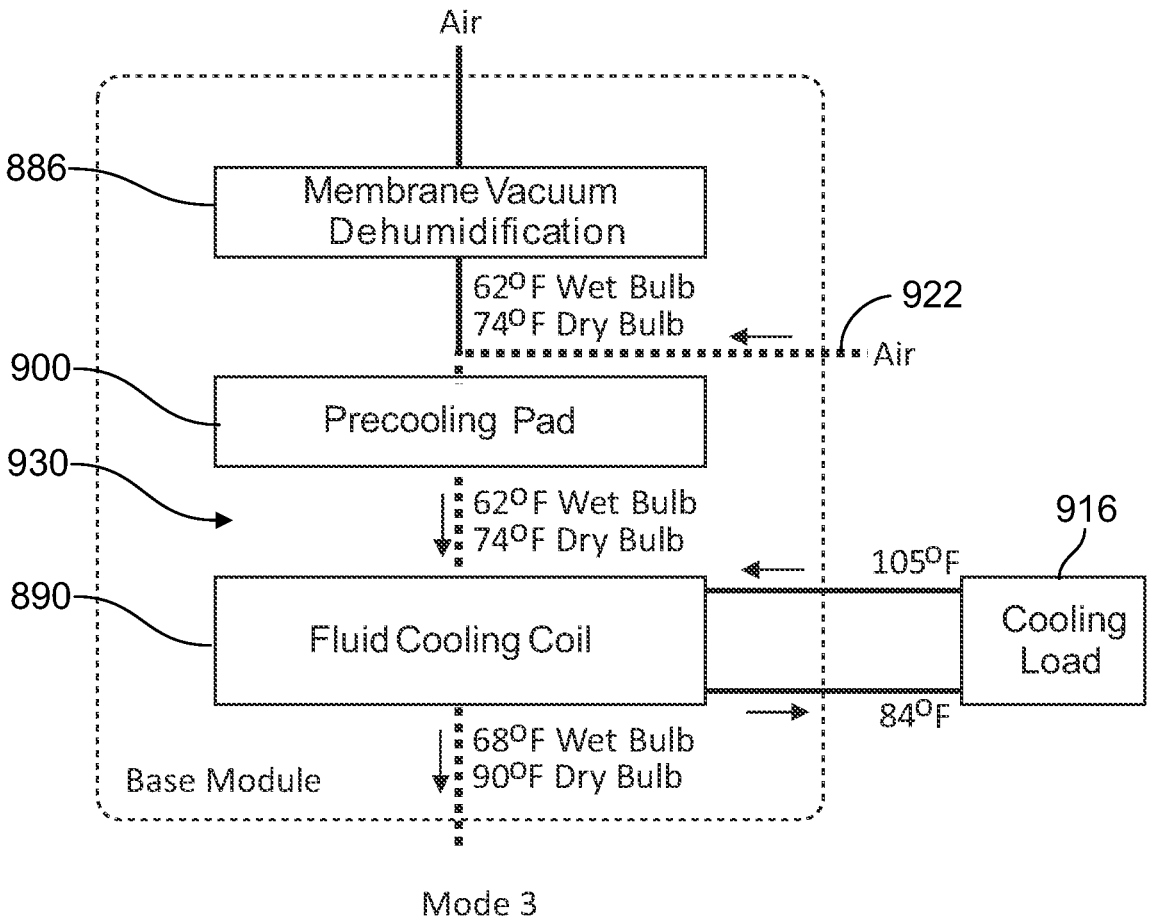

Regarding FIG. 48, the heat transfer apparatus 880 is in Mode 3 wherein the primary louvers 882 are closed, the secondary louvers 884 are open, and air enters the heat transfer apparatus 880 around the second flow path 922 and bypasses the membrane vacuum dehumidification system 886. In Mode 3, the sump pump 906 is off such that the evaporative liquid distribution system 902 is not directing liquid onto the precooling pad 900. In this manner, the air in an area 930 upstream of the fluid cooling coil 890 is the same wet bulb and dry bulb temperatures as the ambient air. Mode 3 may be utilized when there is a low cooling load on the heat transfer apparatus 880 or when the heat transfer apparatus 880 is being operated to minimize energy consumption.

Figure 49:
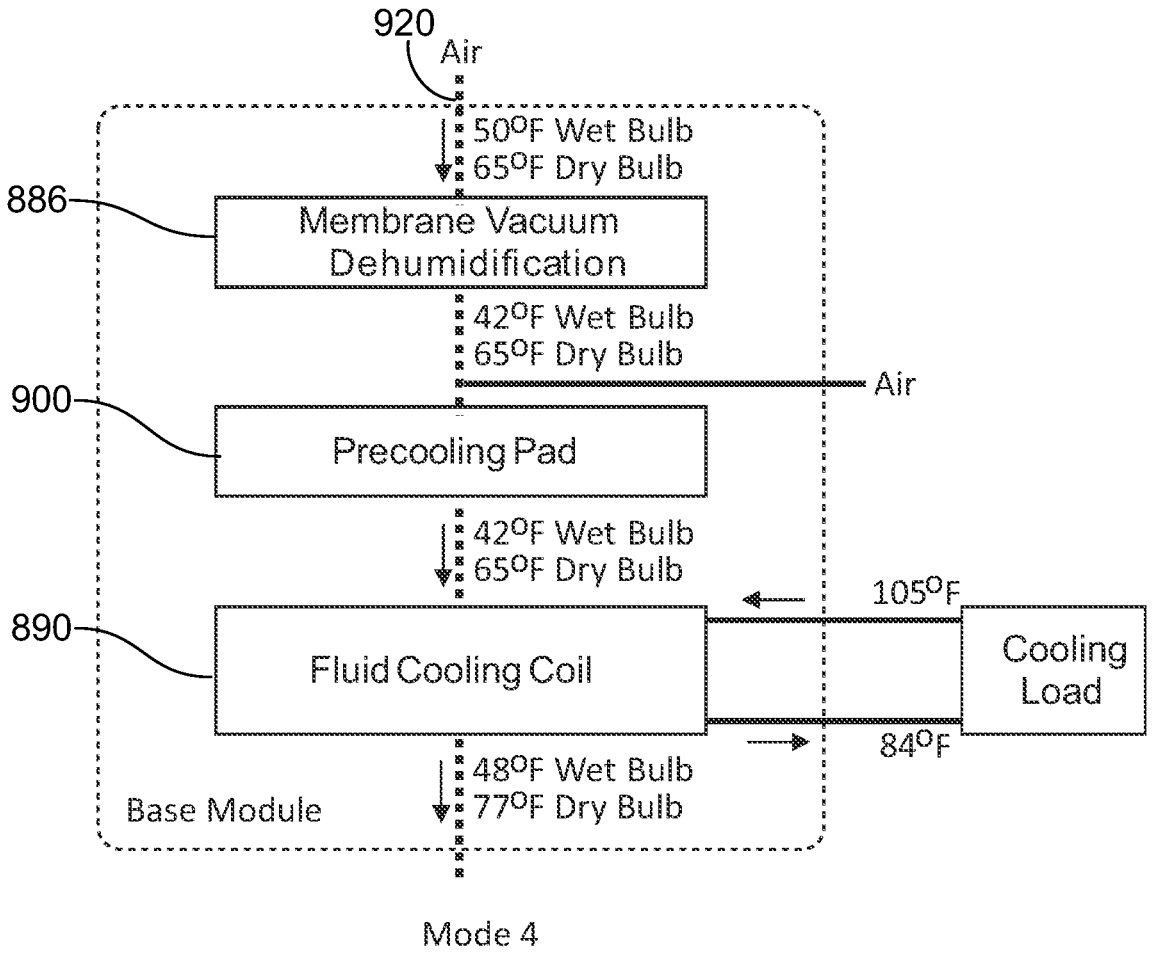

Regarding FIG. 49, the heat transfer apparatus 880 is in Mode 4 wherein the primary louvers 882 are open and the secondary louvers 884 are closed. The fan 892 draws air into the heat transfer apparatus 880 along the first flow path 920. The membrane vacuum dehumidification system 886 is operating to reduce the humidity of air upstream of the precooling pad 900. The adiabatic precooler 888 is off so that the air flow has similar wet bulb and dry bulb temperatures before and after the precooling pad 900. Thus, in Mode 4, the heat transfer apparatus 880 utilizes the membrane vacuum dehumidification system 886 to dry the air upstream of the fluid cooling coil 890. Mode 4 may be utilized when the heat transfer apparatus 880 is operated to minimize water consumption.

Regarding FIG. 50, the controller 896 may utilize a method 940 in response to receiving a request to minimize energy consumption. The heat transfer apparatus 880 may switch between operating modes 942 as a thermal duty 944 required by the heat transfer apparatus 880 varies. The method 940 has variables 946 of the components of the heat transfer apparatus 880 that vary as the controller 896 changes between operating modes 942. The variables 946 may include a variable 947 indicative of the operation of the condensed water pump 912. In operating modes 942, the condensed water pump 912 is off to save energy.

Regarding FIG. 51, the controller 896 may perform a method 950 in response to receiving a request to minimize water consumption. The heat transfer apparatus 880 switches between operating modes 952 as a thermal duty 954 of the heat transfer apparatus 880 varies. The method 950 includes variables 956 that vary as the heat transfer apparatus 880 changes between operating modes 952.

In the method 950, the sump pump 906 is off when the heat transfer apparatus 880 is in a dry cooling mode 958 to conserve water. However, when the thermal duty increases and the controller 896 changes to an adiabatic cooling and membrane vacuum dehumidification mode 960, the sump pump 906 operates to provide additional adiabatic cooling to the air and increase the cooling capacity of the heat transfer apparatus 880.

Regarding FIG. 52, the controller 896 may perform a method 960 in response to receiving a request to generate water via the membrane vacuum dehumidification system 886. The method 960 includes modes 962 that the controller 896 varies between as a thermal duty 964 of the heat transfer apparatus 880 varies. The method 960 includes variables 966 representative of the status of components of the heat transfer apparatus 880 that change as the heat transfer apparatus 880 changes between operating modes 962. The variables 966 include a variable 968 indicative of whether the condensed water pump 912 is operating. Because the controller 896 has received a request to generate water, the condensed water pump 912 is operating in both operating modes 962.

Regarding FIG. 53, heat transfer apparatus 980 is a second example of a heat transfer apparatus 850 discussed above. The heat transfer apparatus 980 includes primary louvers 982, secondary louvers 984, and tertiary louvers 986 that are selectively operable to bypass a membrane vacuum dehumidification system 988, an adiabatic precooler 990, or both as desired for picking an operating mode. The membrane vacuum dehumidification system 988 includes a vacuum pump 992 to facilitate dehumidification of the air and a condensed water pump 994 for pumping condensed and collected water from the membrane vacuum dehumidification system 988 to a sump 996 of the adiabatic precooler 990. The adiabatic precooler 990 includes a liquid distribution system 998, a precooling pad 1000, and a sump pump 1002. The heat transfer apparatus 980 further includes a controller 1004, a fan 1006, and a fluid cooling coil 1008 that receives process fluid from a cooling load 1010.

Regarding FIG. 54, the controller 1004 may perform a method 1020 in response to receiving a request to minimize energy consumption. The method 1020 includes operating modes 1022 that the heat transfer apparatus 980 may switch between as a thermal duty 1024 of the heat transfer apparatus 980 varies. The method 1020 includes variables 1026 indicative of the status of components of the heat transfer apparatus 980 that vary as the heat transfer apparatus 980 changes between the modes 1022. The variables 1026 include a variable 1028 representative of whether the tertiary louvers 986 are open or closed. In the method 1020, the tertiary louvers 986 are closed when the controller 1004 is in either of the operating modes 1022.

Regarding FIG. 55, the controller 1004 may perform a method 1030 in response to receiving a request to minimize water consumption. The method 1030 includes operating modes 1032 that the heat transfer apparatus 980 may change between as the thermal duty 1034 varies. The method 1030 includes variables 1034 of the heat transfer apparatus 980 that change as the controller 1004 changes between the operating modes 1032. The operating modes 1032 include a dry cooling operating mode 1036 wherein the primary louvers 982 and secondary louvers 984 are closed and the tertiary louvers 986 are open as indicated by variables 1038, 1040, 1042. By closing the primary and secondary louvers 982, 984, the air may bypass the membrane vacuum dehumidification system 988 and the adiabatic precooler 990 and instead contact the fluid cooling coil 1008 to remove heat from the process fluid from the cooling load 1010.

Regarding FIG. 56, the controller 1004 may perform a method 1050 in response to receiving a request to generate water from the membrane vacuum dehumidification system 988. The method 1050 includes operating modes 1052, 1054 with variables 1056 that change as the controller 1004 switches between the operating modes 1052, 1054. As indicated by variable 1058, the condensed water pump 994 is operated in either operating mode 1052, 1054.

Regarding FIG. 57, heat transfer apparatus 1070 is a third example of the heat transfer apparatus 850 discussed above. The heat transfer apparatus 1070 is similar in many respects to the heat transfer apparatuses 880, 980 discussed above. The heat transfer apparatus 1070 includes primary and secondary louvers 1072, 1074 and a fan 1076 that generates airflow in the heat transfer apparatus 1070. The heat transfer apparatus 1070 further includes a membrane vacuum dehumidification system 1078, an indirect heat exchanger 1080 to transfer heat from process fluid received from a cooling load 1082, and a direct heat exchanger 1084. The direct heat exchanger 1084 includes fill 1086, a sump 1088, a liquid distribution system 1090, and a sump pump 1092. The sump pump 1092 circulates a secondary liquid to the indirect heat exchanger 1080 to receive heat from the process fluid of the cooling load 1082. The liquid distribution system 1090 distributes, such as sprays, the heated secondary liquid onto the fill 1086. The secondary liquid is cooled by the airflow as the secondary liquid travels along the direct heat exchanger 1084. The cooled secondary liquid is then pumped again from the sump 1088 to the indirect heat exchanger 1080.

Regarding FIG. 58, heat transfer apparatus 1100 is a fourth example of the heat transfer apparatus 850 discussed above. The heat transfer apparatus 1100 is similar in many respects to the heat transfer apparatus 1070 discussed above. One difference is that the heat transfer apparatus 1100 includes a direct heat exchanger 1102 that receives process fluid from a cooling load 1104. The direct heat exchanger 1102 includes a process fluid distribution system 1108 that distributes, such as sprays, the process fluid onto fill 1110. The process fluid is cooled by air flow through the direct heat exchanger 1102 and is collected in a sump 1106. The direct heat exchanger 1102 has a sump pump 1108 to direct the cooled process fluid back to the cooling load 1104. The heat transfer apparatus 1100 includes a fan 1120 that is operable to draw air through primary and secondary louvers 1122, 1124 that are selectively closable to control the flow of air through the heat transfer apparatus 1100.

With reference to FIGS. 59 and 60, a heat transfer apparatus 1150 is provided having a process fluid heat exchange circuit 1152 that receives process fluid from a cooling load 1154 and cools the process fluid to a requested temperature. The process fluid heat exchange circuit includes a chiller 1154 and a heat exchanger 1156. The heat exchanger exchanges heat between the process fluid and ambient air. The heat exchanger 1156 may include an adiabatic precooler and an indirect heat exchanger. The heat transfer apparatus 1150 has a chiller on mode as shown in FIG. 59 wherein a valve 1158 of the process fluid heat exchange circuit 1152 directs heat from the heat exchanger 1156 to the chiller 1154. The heat transfer apparatus 1150 further includes a chiller off mode as shown in FIG. 60. In the chiller off mode, the valve 1158 bypasses the process fluid around the chiller 1154. The chiller off mode of FIG. 60 may be used when there is a lower thermal load on the heat transfer apparatus 1150.

With reference to FIG. 61, the heat transfer apparatus 1170 includes a housing 1172 with an air inlet 1174, an air outlet 1176, and one or more fans 1178 for generating air flow therebetween. The heat transfer apparatus 1170 has an adiabatic precooler 1180 with a precooling pad 1182, a finned coil 1184, and a condenser coil 1186 of a chiller 1188. The condenser coil 1186 and the evaporator 1190 of the chiller 1188 are in an interior 1192 of the housing 1172, and the condenser coil 1186 in one embodiment is in the path of air traveling between the air inlet 1174 and air outlet 1176. In some embodiments, the condenser coil 1186 may eliminate plume by heating the moist air. Further, the heat transfer apparatus 1170 may have a compact configuration due to the condenser coil 1186 and the evaporator 1190 being in the interior 1192 of the housing 1172. The finned coil 1184 receives hot process fluid from a return 1194 and directs cooled process fluid to a valve 1196. The valve 1196 modulates the flow of cooled process fluid from the finned coil 1184 to the evaporator 1190. The evaporator 1190 further cools the process fluid and directs the cooled process fluid along a conduit 1198 to a cooled process fluid supply 1200. The valve 1196 may modulate the flow of the cooled process fluid from the finned coil 1184 so that some, all, or none of the cooled process fluid from the finned coil 1184 travels to the evaporator 1190. The chiller 1188 has an expansion valve 1202 and a compressor 1204 and utilizes a refrigerant to remove heat from the process fluid in the evaporator 1190 and transfer the heat to the air flow via the condenser coil 1186. The heat transfer apparatus 1170 lacks a thermal energy storage.

Regarding FIGS. 62 and 63, the heat transfer apparatus 1220 is provided that includes a chiller 1224 and a heat exchanger 1226 that operate to cool process fluid from a cooling load 1228. The chiller 1224 includes an evaporator 1230, a condenser 1240, a compressor 1242, and an expansion valve 1244. The heat transfer apparatus 1220 has a pump 1250 that circulates process fluid from a cooling load 1228, to the condenser 1240, to the heat exchanger 1226, to the evaporator 1230, and back to the cooling load 1228. The heat transfer apparatus 1220 has a chiller on mode as shown in FIG. 62 wherein the compressor 1242 circulates refrigerant between the evaporator 1230 and the condenser 1240 and facilitates heat transfer from the process fluid to the refrigerant at the evaporator 1230. In this manner, the chiller 1224 further reduces the temperature of the process fluid from the heat exchanger 1226. The heat transfer apparatus 1220 further includes a chiller off mode as shown in FIG. 63 wherein the compressor 1242 does not circulate refrigerant between the evaporator and the condenser 1240. However, the pump 1250 is still operable to direct the process fluid from the cooling load 1228 to the heat exchanger 1226 with the process fluid traveling through the condenser 1240 and the evaporator 1230.

With reference to FIGS. 64-67, the heat transfer apparatus 1300 is provided having a process fluid heat exchange circuit 1302 that includes a glycol chiller 1304, a pump 1306, a thermal energy storage such as an ice tank 1308, a heat exchanger 1310 such as a glycol/water heat exchanger, and a heat exchanger 1312 such as an air/water heat exchanger. The heat exchanger 1310 is part of a water loop 1305 that receives heated water from a cooling load 1314. The heat exchanger 1310 transfer heat from the water loop 1305 to a glycol loop 1303.

Figure 64:
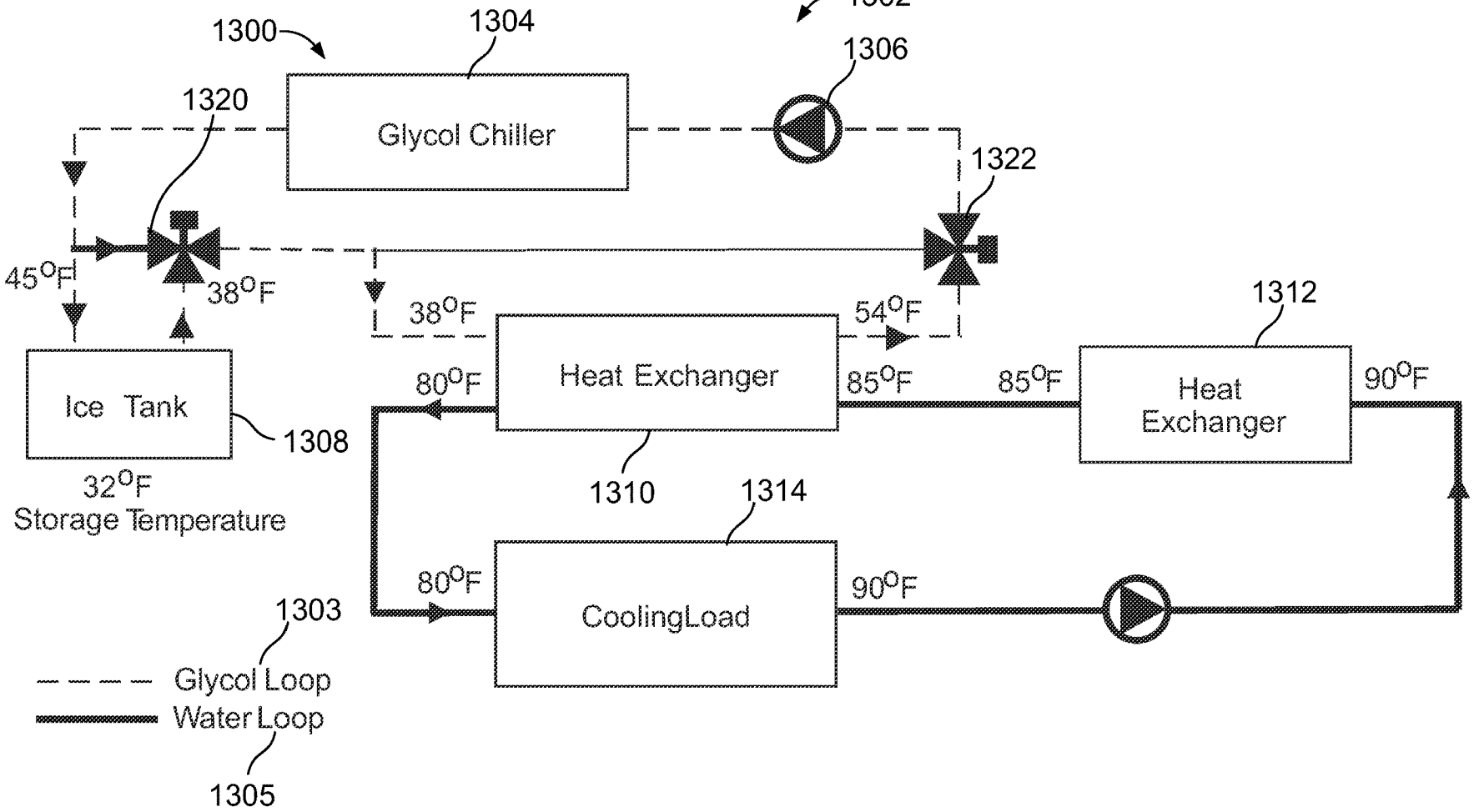

In FIG. 64, the heat transfer apparatus 1300 is shown in a cooling load with ice melt mode wherein a valve 1320 directs glycol from the glycol chiller 1304 through the ice tank 1308 and a valve 1322 directs the glycol from the ice tank 1308 to the glycol/water heat exchanger 1310. The glycol chiller 1304 and ice tank 1308 remove heat from the glycol circulating in the glycol loop 1303, which absorbs heat from the water in the water loop 1305 via the heat exchanger 1310.

Figure 65:
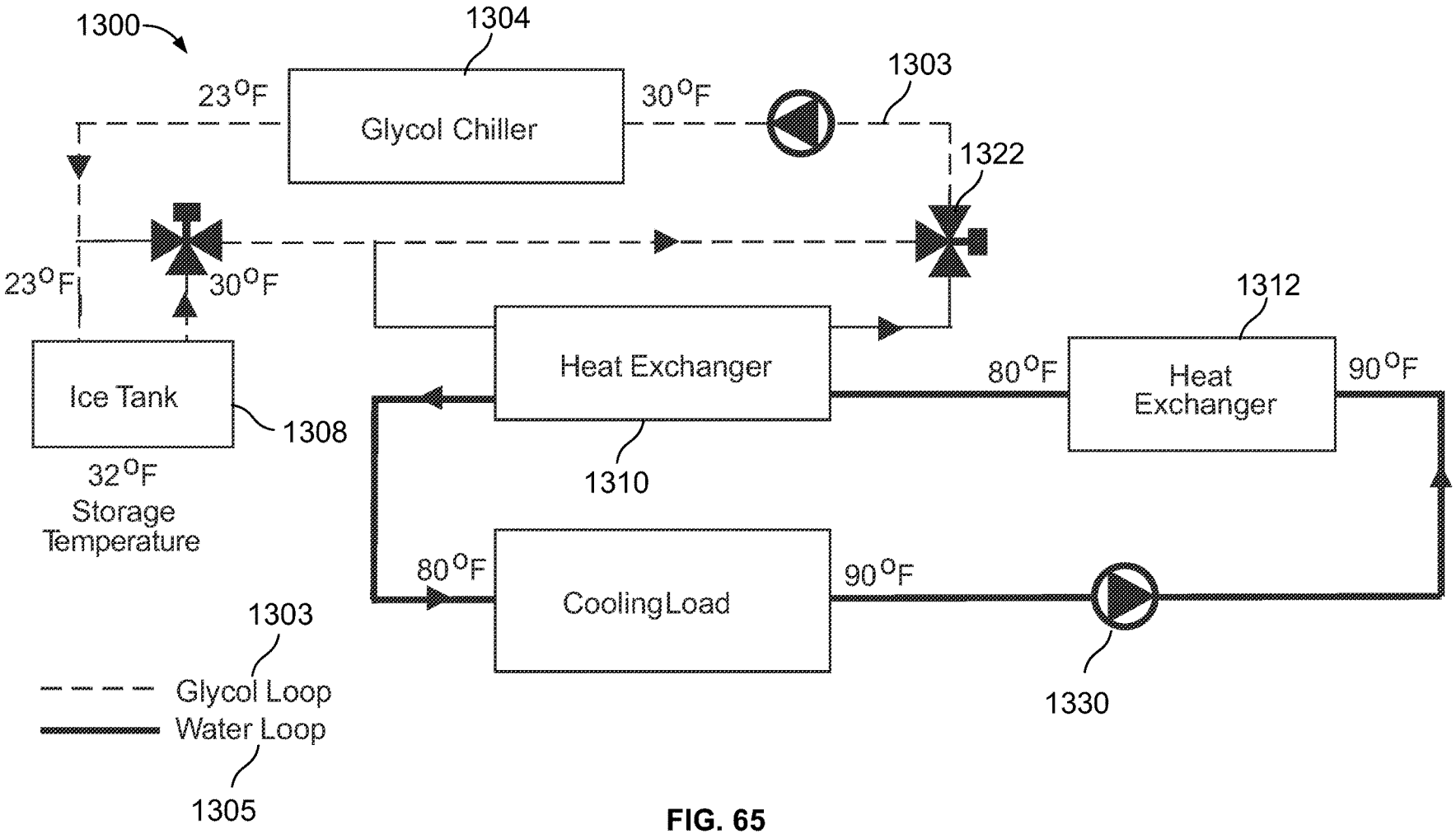

Regarding FIG. 65, the heat transfer apparatus 1300 is shown in a cooling load with ice build mode. More specifically, the valve 1322 inhibits the flow of glycol from the ice tank 1308 to the heat exchanger 1310 such that the glycol chiller 1304 removes heat from the glycol loop 1303 and returns chilled glycol to the ice tank 1308 at a temperature below the storage temperature of the ice tank 1308, such as 32° F., thereby building ice in the ice tank 1308. Conversely, the water loop 1305 includes a pump 1330 that permits the water from the cooling load 1314 to flow to the heat exchanger 1312 and be cooled. The cooling load with ice build mode of FIG. 65 may be utilized when there is a decreased thermal load on the heat transfer apparatus 1300 such as overnight.

Figure 66:
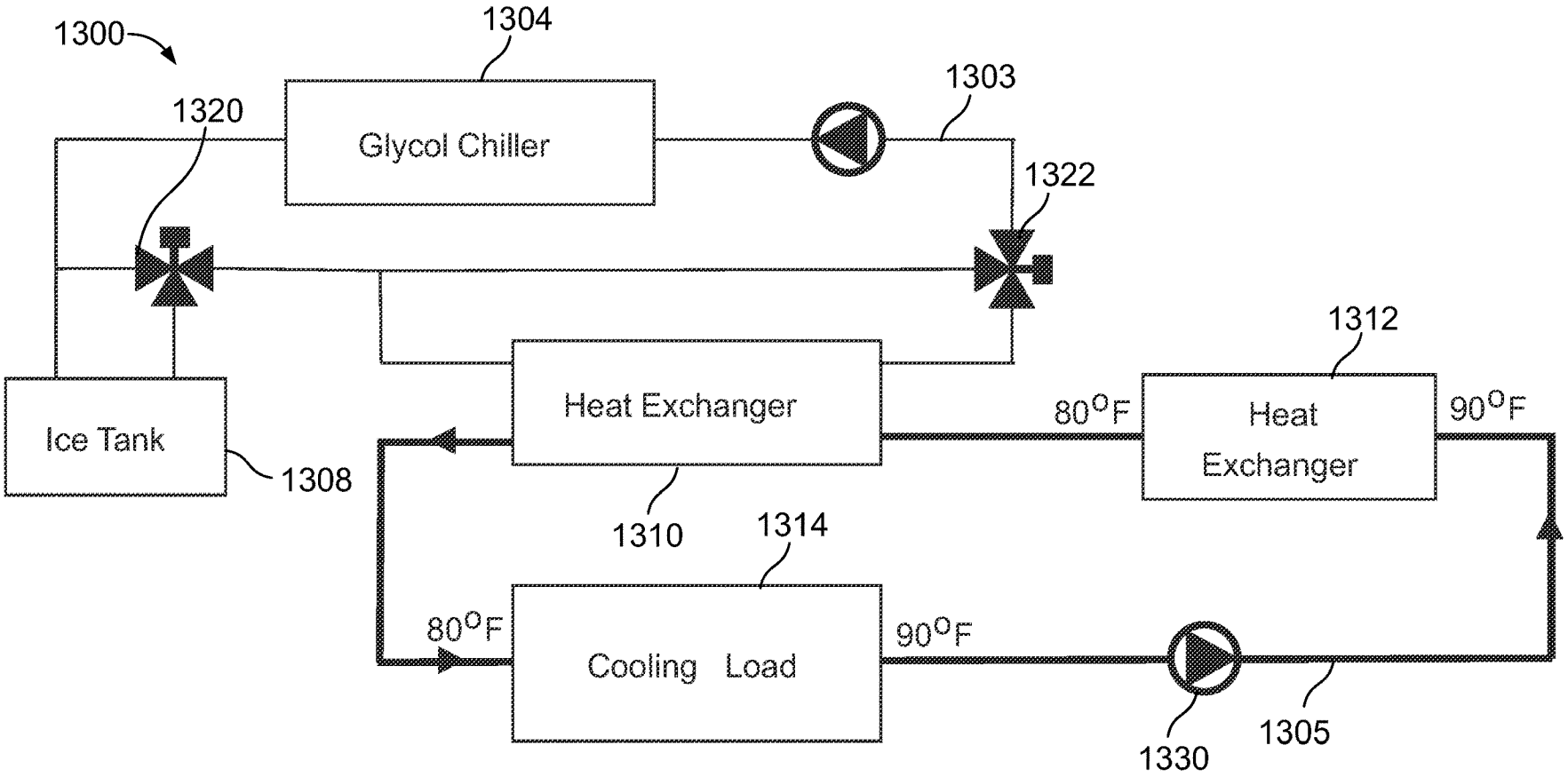

Regarding FIG. 66, the heat transfer apparatus 1300 is shown in a cooling load with chiller and ice tank bypass mode. The valves 1320, 1322 inhibit the flow of glycol through the glycol loop 1303. The pump 1330 circulates water between the cooling load 1314 and the heat exchanger 1312 to permit the heat exchanger 1312 to cool the water. The cooling load with chiller and ice tank bypass mode of FIG. 66 may be utilized to save energy or when the thermal load on the heat transfer apparatus 1300 is low.

Figure 67:
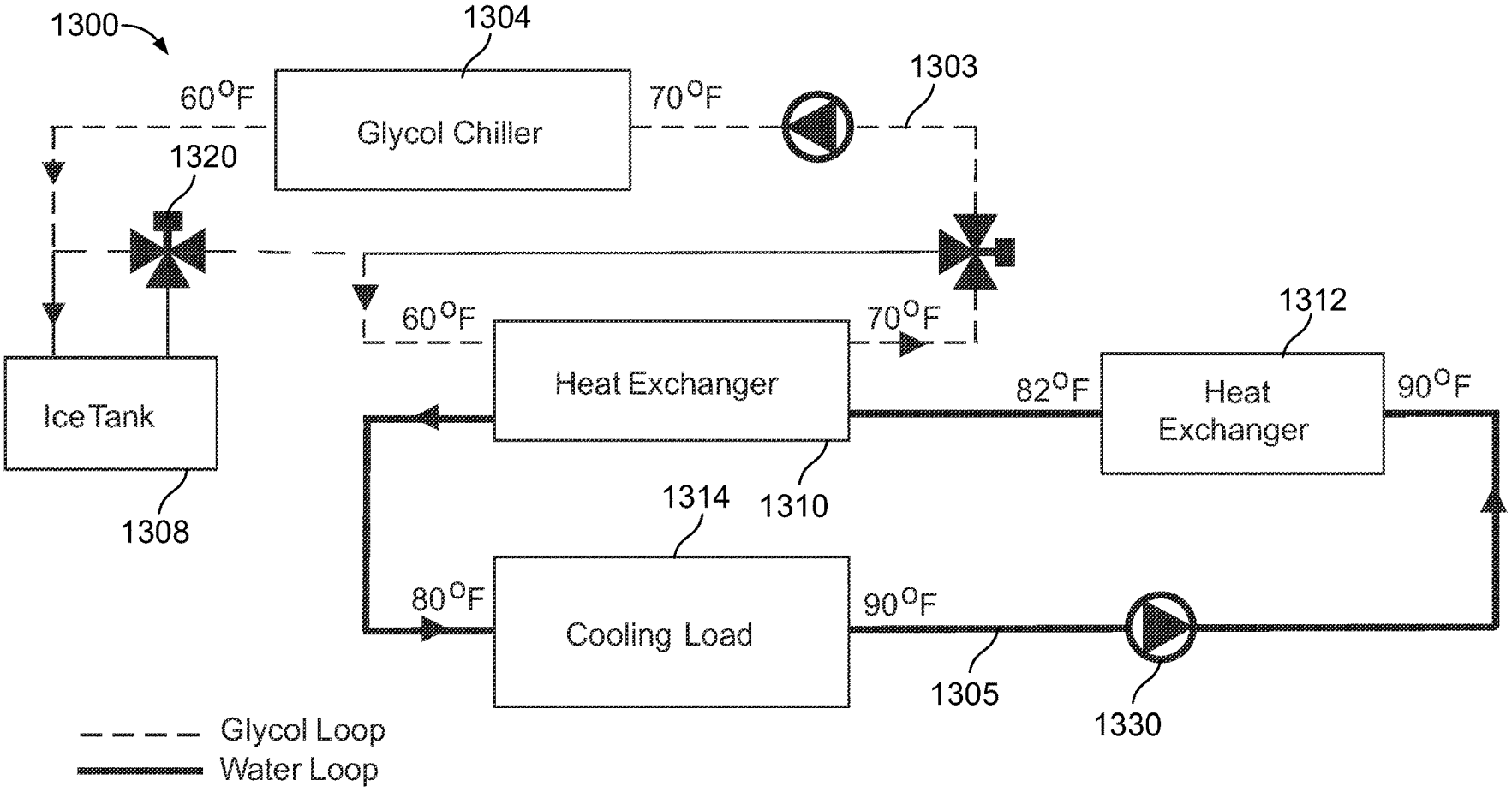

Regarding FIG. 67, the heat transfer apparatus 1300 is shown in a cooling load with ice tank bypass mode. More specifically, the valve 1320 inhibits the flow of glycol to the ice tank 1308. Instead, the glycol is circulated by a pump 1306 from the glycol chiller 1304 to the heat exchanger 1310. The cooling provided by the glycol chiller 1304 may thereby be utilized to cool water in the water loop 1305 as the water travels through the heat exchanger 1310.

Regarding FIGS. 68 and 69, a heat transfer apparatus 1350 is provided that is similar to the heat transfer apparatus 1170. The heat transfer apparatus 1350 includes a housing 1352, an adiabatic precooler 1353 including a precooling pad 1354, a finned coil 1356, and condenser coil 1358, and an evaporator 1360 of a chiller 1362. Regarding FIG. 69, the heat transfer apparatus 1350 is provided in a perspective view to show that the heat transfer apparatus 1350 includes a thermal energy storage, such as an ice tank 1370, side-by-side the evaporator 1360 of the chiller 1362.

Regarding FIGS. 70-73, a heat transfer apparatus 1390 is provided that has a chiller 1392, a thermal energy storage such as a PCM tank 1394, and a heat exchanger 1396 for cooling process fluid from a cooling load 1398. The PCM tank 1394 contains a phase change material having a storage temperature higher than 50° F., such as 65° F., so that the same process fluid can be used in first and second fluid loops 1411, 1413 of the heat transfer apparatus 1390 (see FIG. 71). The storage temperature may refer to the melting or freezing temperature of a phase change material. The melting and freezing temperatures may be the same or different depending on the phase change material. Examples of phase change materials that may be used include PureTemp 18 from PureTemp LLC and BioPCM®-Q18 from Phase Change Solutions, Inc.

Figure 70:
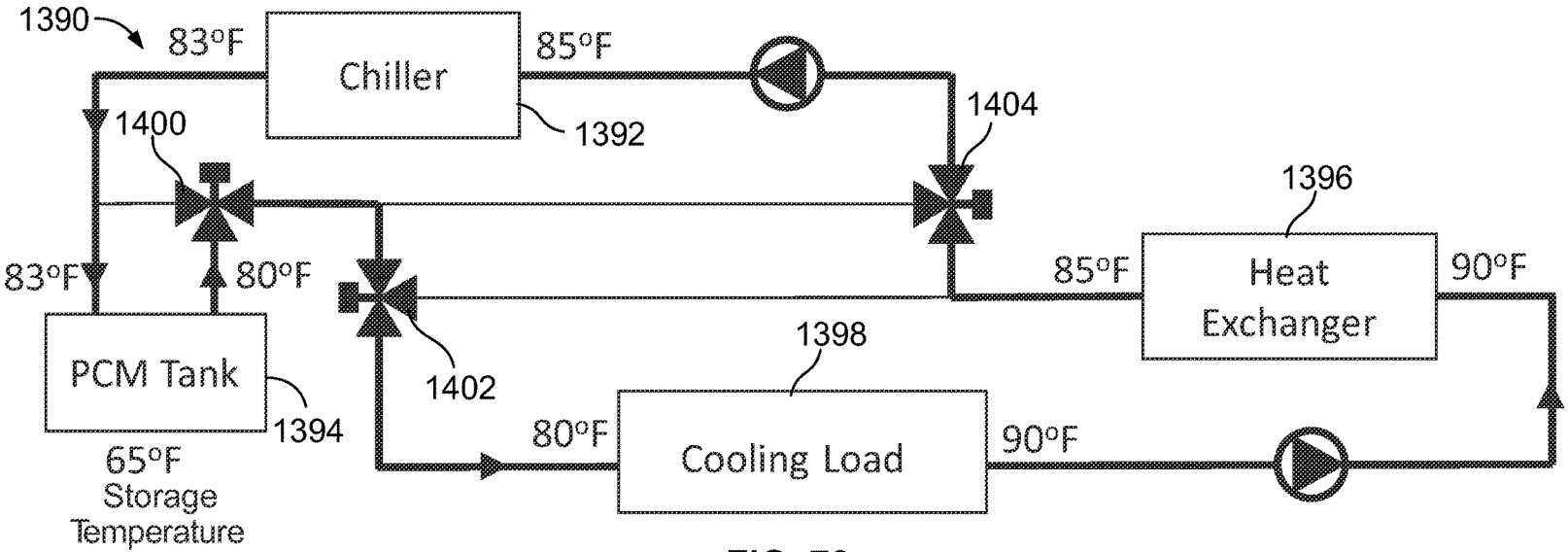

Regarding FIG. 70, the heat transfer apparatus 1390 is shown in a cooling load with PCM discharge mode wherein valve 1400 directs process fluid from the chiller 1392 through the PCM tank 1394 and a valve 1402 directs the cooled process fluid from the PCM tank 1394 to the cooling load 1398. The valve 1404 directs process fluid from the heat exchanger 1396 to the chiller 1392. In this manner, the chiller 1392 and the PCM tank 1394 cool the process fluid below the temperature of process fluid output from the heat exchanger 1396.

Figure 71:
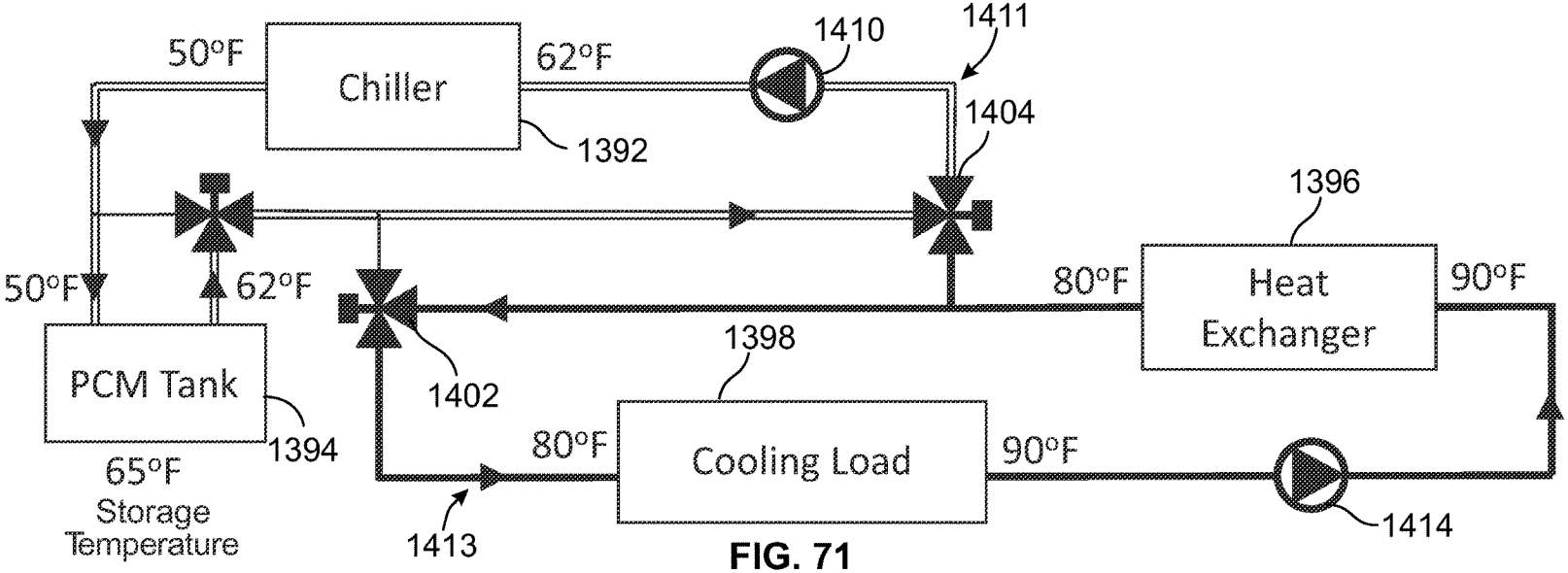

Regarding FIG. 71, the heat transfer apparatus 1390 is shown in a cooling load with a PCM charge mode. In this mode, the valves 1402, 1404 permit a pump 1410 to circulate a secondary process fluid between the chiller 1392 and PCM tank 1394 in the first fluid loop 1411. The chiller 1392 outputs the secondary process fluid at a temperature lower than the freezing temperature of the PCM in the PCM tank 1394 to recharge the PCM tank 1394. Further, in the cooling load with PCM charge mode of FIG. 71, the heat transfer apparatus 1390 is able to provide cooling capacity for the cooling load 1398 by way of a pump 1414 circulating a primary process fluid between the heat exchanger 1396 and the cooling load 1398 in the second fluid loop 1413.

Figure 72:
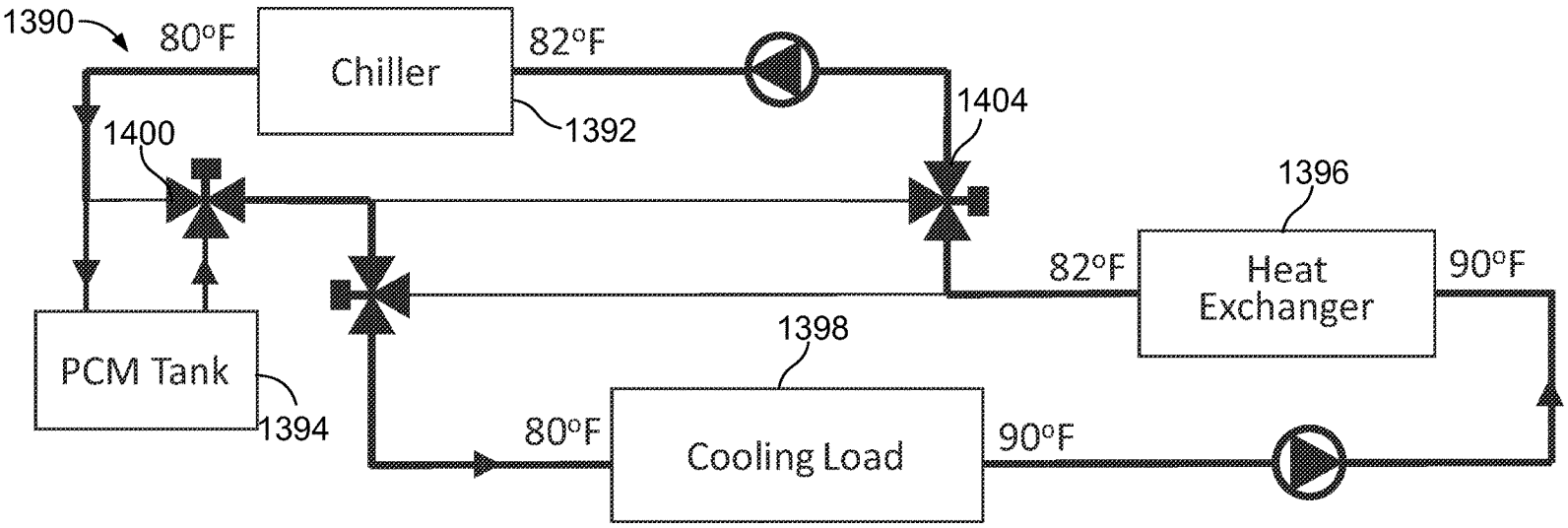

Regarding FIG. 72, the heat transfer apparatus 1390 is shown in a cooling load with PCM bypass tank mode. More specifically, the valve 1400 bypasses the process fluid received from the chiller 1392 around the PCM tank 1394 and directs the process fluid to the cooling load 1398. Further, the valve 1404 permits process fluid from a heat exchanger 1396 to travel to the chiller 1392.

Figure 73:
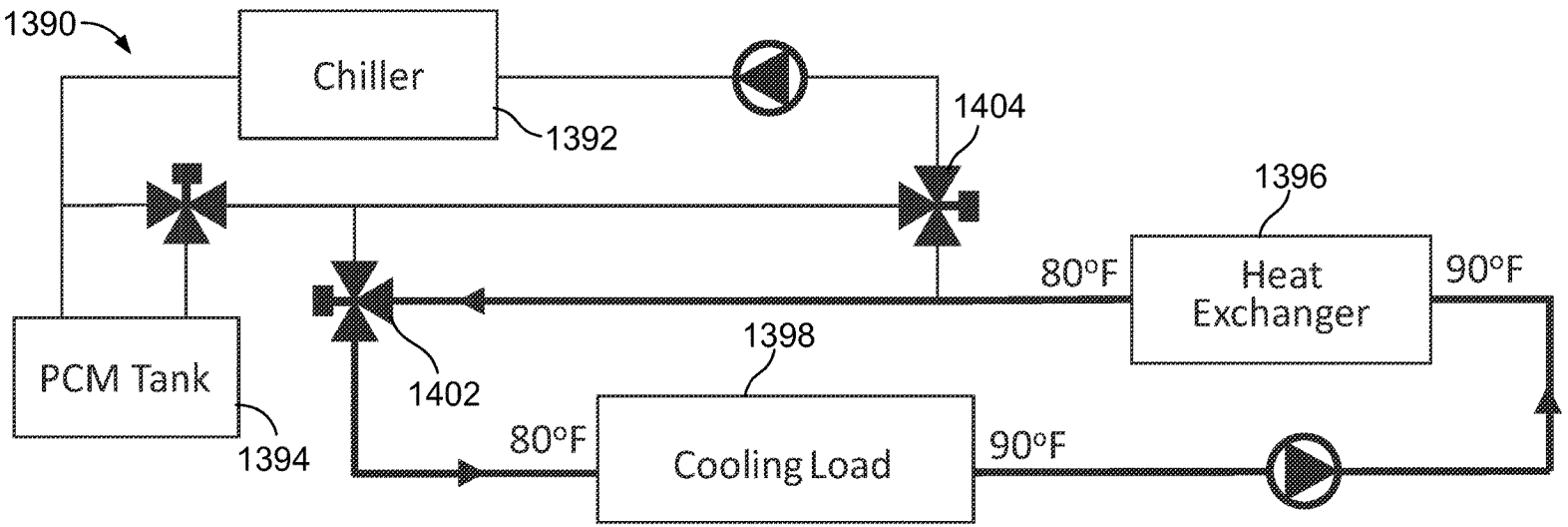

Regarding FIG. 73, the heat transfer apparatus 1390 is shown in a cooling load with chiller and PCM tank bypass mode. More specifically, in the mode of FIG. 73, the valves 1402, 1404 are closed to bypass the process fluid around the chiller 1392 and the PCM tank 1394.

Regarding FIGS. 74-76, a heat transfer apparatus 1430 is provided that is similar in many respects to the heat transfer apparatus 1150 discussed above. One difference between the heat transfer apparatuses 1150, 1430 is that the heat transfer apparatus 1430 has a valve 1432 between the heat exchanger 1434 and a cooling load 1436 as well as a valve 1438 between the heat exchanger 1434 and a PCM tank 1440. Another difference between the heat transfer apparatuses 1150, 1430 is that the heat transfer apparatus 1150 uses the trim chiller 1154 to provide trim cooling whereas heat transfer apparatus 1430 uses PCM tank 1440 to provide trim cooling.

The heat transfer apparatus 1430 has a cooling load with PCM discharge mode as shown in FIG. 74, a cooling load with PCM charge mode as shown in FIG. 75, and a cooling load with PCM tank bypass mode as shown in FIG. 76. In the mode of FIG. 75, the valve 1432 may modulate the flow of process fluid from the cooling load 1436 to direct some of the process fluid back to the cooling load 1436 and mix with the cooled process fluid from the PCM tank 1440. The PCM tank 1440 has a storage temperature higher than 70° F. such as 78° F. The mode of FIG. 75 uses recirculation of process fluid to raise the temperature of the process fluid before the process fluid is returned to the cooling load 1436.

The heat transfer apparatuses discussed herein may take various shapes. In some embodiments, the components of the heat transfer apparatus are packed in a single housing. In other embodiments, the components may be standalone structures that are operably connected. For example, a heat transfer apparatus 1450 is provided in FIG. 77 that includes two stacked air/process fluid heat exchangers 1452, 1454 and a separate thermal energy storage 1456.

Regarding FIG. 78, a heat transfer apparatus 1460 is provided that includes a housing 1462 having an air inlet 1464, an air outlet 1466, and one or more fans 1468 operable to generate air flow between the air inlet 1464 and the air outlet 1466. The heat transfer apparatus 1460 includes an adiabatic precooler 1470 having a precooling pad 1472 and an indirect heat exchanger such as a finned coil 1474. The finned coil 1474 receives hot process fluid via a return 1476. The heat transfer apparatus 1460 includes a valve 1480 that modulates flow of cooled process fluid from the finned coil 1474 to a thermal energy storage such as a PCM tank 1482. The process fluid may travel from the valve 1480, to the PCM tank 1482, and then be returned to the cooled process fluid supply 1484 downstream of the valve 1480. The PCM tank 1482 is in an interior 1486 of the housing 1462 which may be advantageous in some embodiments to permit airflow generated by the one or more fans 1468 to cool the PCM tank 1482.

Regarding FIG. 79, a heat transfer apparatus 1500 is provided having a process fluid heat exchange circuit 1502 that includes a dehumidifier such as a membrane mass exchanger 1504, a heat exchanger 1506 such as an air/process fluid heat exchanger, and a pump 1508. The membrane mass heat exchanger 1504 receives air 1510 and reduces the wet bulb temperature of the air before the air reaches the heat exchanger 1506. The heat exchanger 1506 receives process fluid from a cooling load 1512. By dehumidifying the air upstream of the heat exchanger 1506, the efficiency of operation of the heat exchanger 1506 can be increased.

Regarding FIG. 80, a heat transfer apparatus 1530 is provided that includes a housing 1532, a primary air inlet 1534 with a primary louver 1536, a secondary air inlet 1538 with a secondary louver 1540, and an air outlet 1542. The heat transfer apparatus 1530 further includes a membrane mass exchanger 1550, an adiabatic precooler 1552 with a precooling pad 1554, and an indirect heat exchanger such as a finned coil 1556. The membrane mass exchanger 1550 may include tubular or sheet membranes that permit water vapor to pass therethrough for collection and removal from the air stream which dehumidifies the air upstream of the precooling pad 1554. In a first mode, the secondary louvers 1540 may be closed and the primary louvers 1536 opened so that air flows through the membrane mass exchanger 1550 to the precooling pad 1554 and the finned coil 1556. Further, the heat transfer apparatus 1530 has a second mode wherein the primary louvers 1536 are closed and the secondary louvers 1538 are opened so that air may travel through the secondary air inlet 1538 to the precooling pad 1554 bypassing the membrane mass exchanger 1550. The finned coil 1556 receives hot process fluid from a return 1570 and directs cooled process fluid to a supply 1572 that directs process fluid back to the cooling load.

Regarding FIG. 81, a membrane mass exchanger 1660 is provided as an example of the membrane mass exchanger 1550 discussed above. The membrane mass exchanger 1660 includes an array of air passageways 1662, sheet membranes 1664 and permeate passageways 1666. Air travels in direction 1670 into air inlets 1669, travels along the air passageways 1662 while contacting the sheet membranes 1664, and exits the air passages 1662 via outlets 1672. The membrane mass exchanger 1660 includes a compressor or vacuum pump 1682 that operates to create a vacuum in the permeate passageways 1666. The presence of the vacuum in the permeate passageways 1666 on the side of the sheet membrane 1664 opposite the air passageway 1662 draws water vapor in the airflow through the sheet membrane 1664 and into the permeate passageway 1666. Water vapor collected in the permeate passageways 1666 travels through conduit 1680, to the vacuum pump 1682, and to a water output 1684. The water output 1684 may include, for example, an air and water separator and a condenser to condense collected water vapor into liquid water for pumping to the adiabatic precooler 1552 or another process. The condenser may include, for example, a cooled metallic surface.

With reference to FIG. 82, a heat transfer apparatus 1700 is provided that includes an air inlet 1702, a dehumidifier 1704 such as a membrane mass exchanger 1706, an adiabatic precooler 1708 that includes precooling pads 1710, an indirect heat exchanger such as a tube and fin heat exchanger 1712, a direct heat exchanger such as fill 1714, a plenum 1716, and an air outlet 1718 with a fan 1720. The fan 1720 generates airflow from the air inlet 1702 to the air outlet 1718. The dehumidifier 1704 includes a liquid desiccant supply 1730 having a pump 1732 that pumps liquid desiccant collected from a sump 1734 to the membrane mass exchanger 1706. Ambient air enters the air inlet 1702 such that the liquid desiccant in the membrane mass exchanger 1706 removes water vapor from the air. This decreases the wet bulb temperature of the air at region B.

Next, the air travels through the precooling pad 1710 that is wetted by a water from a liquid supply 1750 having a pump 1754 that pumps water from a sump 1752. The water on the precooling pad 1710 reduces the dry bulb temperature at region C.

The dehumidified, dry air next travels across the tube and fin heat exchanger 1712 and transfers heat to a process fluid that enters an inlet 1760 of the tube and fin heat exchanger 1712 at an elevated temperature and leaves an outlet 1762 of the tube and fin heat exchanger at a reduced temperature.

The liquid desiccant supply 1730 includes a liquid desiccant sump 1770 with an electric heater that heats the liquid desiccant to recharge the liquid desiccant that has collected water vapor at the membrane mass exchanger 1706. Alternatively or additionally, the liquid desiccant sump 1770 may utilize waste heat, such as from a manufacturing operation, to heat the liquid desiccant. The liquid desiccant supply 1730 further includes a pump 1780 to direct liquid desiccant to a spray 1788 onto the fill 1714. The air travels from region D to region E and absorbs heat from the liquid desiccant. The cooled liquid desiccant is then returned to the membrane mass exchanger 1706 by the pump 1732.

With reference to FIG. 83, a heat transfer apparatus 1800 is shown that has a process fluid heat exchange circuit 1802 including an indirect heat exchanger such as a fluid cooling coil 1804, a thermoelastic chiller such as a shape memory alloy (SMA) cooler 1806, and a thermal energy storage such as PCM tank 1808 that operate to provide a process fluid to a cooling load 1810 at a requested temperature, pressure, flow rate, or a combination thereof. The SMA cooler 1806 has a condenser side 1812 and an evaporator side 1814. The PCM tank 1808 has a storage temperature such as 65° F. The SMA cooler 1806 produces heat when deformed by compression and absorbs heat when the compression is released and the SMA returns to its original shape as shown by the phase diagram 1820 in FIG. 84. The SMA cooler 1806 may have a first plurality of cassettes of SMA alloys on the condenser side 1812 that are compressing to generate heat and a second plurality of cassettes of SMA alloys of the evaporator side 1814 that are expanding to absorb heat. The SMA cooler 1806 has valving that operatively flips the first and second plurality of cassettes of SMA alloy between the first plurality of cassettes on the condenser side 1812 and the second plurality of cassettes on the evaporator side 1814 once the SMA alloy of the first plurality of cassettes have fully compressed and the SMA alloy of the second plurality of cassettes have fully expanded. In this manner, the SMA cooler 1806 may be operated as a chiller to further reduce the temperature of the process fluid from the fluid cooling coil 1804 prior to the process fluid being directed to the PCM tank 1804. It will be appreciated that the SMA cooler 1806 may be utilized with the other embodiments discussed herein in place of or in addition to the refrigerant-based chillers discussed herein. The SMA cooler 1806 and the other chillers discussed herein may have their own embedded controller that communicates with the master controller of the heat transfer apparatus.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, it will be appreciated that numerous changes and modifications will occur to those skilled in the art, and it is intended for the present invention to cover all those changes and modifications which fall within the scope of the appended claims.

What is claimed is:

1. A heat transfer apparatus comprising:

an air inlet and an air outlet;

a process fluid inlet;

a process fluid outlet;

a process fluid heat exchange circuit connecting the process fluid inlet to the process fluid outlet, the process fluid heat exchange circuit configured to receive a process fluid at an initial temperature and return the process fluid via the process fluid outlet at a process fluid set temperature lower than the initial temperature, the process fluid heat exchange circuit comprising:

a heat exchanger;

an airflow generator operable to cause air to travel from the air inlet to the air outlet and contact the heat exchanger;

a thermal energy storage; and a mechanical cooler;

the process fluid heat exchange circuit having a plurality of modes including:

a first mode wherein the heat exchanger transfers heat between the process fluid and the air;

a second mode wherein the heat exchanger transfers heat between the process fluid and the air and the mechanical cooler removes heat from the process fluid; and a third mode wherein the heat exchanger transfers heat between the process fluid and the air and the thermal energy storage removes heat from the process fluid; and a fourth mode wherein the heat exchanger transfers heat between the process fluid and the air, the mechanical cooler removes heat from the process fluid, and the thermal energy storage removes heat from the process fluid;

a controller operatively connected to the process fluid heat exchange circuit, the controller configured to operate the process fluid heat exchange circuit in one of the plurality of modes based at least in part upon a determination of a thermal duty of the heat transfer apparatus.

2. The heat transfer apparatus of claim 1 wherein the controller is configured to determine a charge of the thermal energy storage; and wherein the controller is configured to operate the process fluid heat exchange circuit in one of the plurality of modes based at least in part upon the determination of the thermal duty of the heat transfer apparatus and the charge of the thermal energy storage.

3. The heat transfer apparatus of claim 1 wherein the controller is configured to receive a request to minimize either water consumption or energy consumption; and wherein the controller is configured to operate the process fluid heat exchange circuit in one of the plurality of modes based at least in part upon the determination of the thermal duty of the heat transfer apparatus and the request to minimize either water consumption or energy consumption.

4. The heat transfer apparatus of claim 1 wherein the controller is configured to determine whether the thermal energy storage has an adequate charge; and wherein the controller is configured to inhibit the process fluid heat exchange circuit from being in the third mode or the fourth mode in response to the thermal energy storage not having the adequate charge.

5. The heat transfer apparatus of claim 1 wherein the heat exchanger has a wet mode and a dry mode; and wherein the heat exchanger is operable in either the wet mode or the dry mode with the process fluid heat exchange circuit is in the first, second, third, and fourth modes.

6. The heat transfer apparatus of claim 1 wherein the process fluid heat exchange circuit is configured to direct the process fluid around the thermal energy storage with the process fluid heat exchange circuit in the first mode and the second mode.

7. The heat transfer apparatus of claim 1 wherein the process fluid heat exchange circuit is configured to direct the process fluid around the mechanical cooler with the process fluid heat exchange circuit in the first mode and the third mode.

8. The heat transfer apparatus of claim 1 wherein the mechanical cooler is off with the process fluid heat exchange circuit in the first mode and the third mode.

9. The heat transfer apparatus of claim 1 wherein the heat exchanger includes an indirect heat exchanger and an adiabatic precooler.

10. The heat transfer apparatus of claim 1 wherein, with the process fluid heat exchange circuit in the first mode, the mechanical cooler and the thermal energy storage are inoperable to remove heat from the process fluid.

11. The heat transfer apparatus of claim 1 wherein the mechanical cooler includes a condenser configured to be contacted by the airflow after the airflow has contacted the heat exchanger as the airflow travels from the air inlet to the air outlet.

12. The heat transfer apparatus of claim 1 further comprising an outer structure; and wherein the heat exchanger, mechanical cooler, and thermal energy storage are in the outer structure.

13. The heat transfer apparatus of claim 1 wherein the mechanical cooler comprises a shape memory alloy cooler.

14. The heat transfer apparatus of claim 1 wherein the process fluid heat exchange circuit has a fifth mode wherein:

the heat exchanger transfers heat between the process fluid and the air; and the mechanical cooler charges the thermal energy storage.

15. The heat transfer apparatus of claim 14 wherein the process fluid heat exchange circuit in the fifth mode is configured to direct a closed-loop process fluid between the mechanical cooler and the thermal energy storage.

16. The heat transfer apparatus of claim 14 wherein the mechanical cooler includes a condenser and an evaporator;

wherein the process fluid heat exchange circuit in the fifth mode includes:

a first process fluid closed loop including the evaporator of the mechanical cooler, the thermal energy storage, and a first closed loop pump to circulate a first process fluid between the evaporator and the thermal energy storage.

17. The heat transfer apparatus of claim 1 wherein the process fluid heat exchange circuit has a sixth mode wherein the heat exchanger and mechanical cooler charge the thermal energy storage.

18. A heat transfer apparatus comprising:

an air inlet and an air outlet;

a process fluid heat exchange circuit for receiving a process fluid, the process fluid heat exchange circuit comprising:

a heat exchanger;

an airflow generator operable to cause air to travel from the air inlet to the air outlet and contact the heat exchanger;

a thermal energy storage; and a mechanical cooler;

the process fluid heat exchange circuit having a plurality of modes including:

a first mode wherein the heat exchanger is operable to transfer heat between the process fluid and the air;

a second mode wherein the heat exchanger is operable to transfer heat between the process fluid and the air and the mechanical cooler is operable to remove heat from the process fluid; and a third mode wherein the heat exchanger is operable to transfer heat between the process fluid and the air and the thermal energy storage is operable to remove heat from the process fluid; and a fourth mode wherein the heat exchanger is operable to transfer heat between the process fluid and the air, the mechanical cooler is operable to remove heat from the process fluid, and the thermal energy storage is operable to remove heat from the process fluid;

a controller operatively connected to the process fluid heat exchange circuit, the controller configured to operate the process fluid heat exchange circuit in one of the plurality of modes based at least in part upon a determination of a thermal duty of the heat transfer apparatus;

wherein the process fluid heat exchange circuit has a sixth mode wherein the heat exchanger and mechanical cooler are operable to charge the thermal energy storage;

wherein the mechanical cooler includes a condenser and an evaporator; and wherein the process fluid heat exchange circuit in the sixth mode includes:

a first process fluid closed loop including the evaporator of the mechanical cooler, the thermal energy storage, and a first closed loop pump to circulate a first process fluid between the evaporator and the thermal energy storage; and a second process fluid closed loop including the condenser of the mechanical cooler, the heat exchanger, and a second closed loop pump to circulate a second process fluid between the condenser and the heat exchanger.

19. The heat transfer apparatus of claim 1 wherein the mechanical cooler includes a condenser, an evaporator, a compressor, and an expansion valve.

20. The heat transfer apparatus of claim 19 wherein the condenser and the evaporator are configured to receive the process fluid.

21. A method of operating a heat transfer apparatus including a process fluid heat exchange circuit connecting a process fluid inlet to a process fluid outlet, the process fluid heat exchange circuit comprising:

a heat exchanger;

a thermal energy storage; and a mechanical cooler;

the process fluid heat exchange circuit configured to receive a process fluid at an initial temperature and return the process fluid via the process fluid outlet at a process fluid set temperature lower than the initial temperature, the process fluid heat exchange circuit having a plurality of modes including:

a first mode wherein the heat exchanger transfers heat between a process fluid and air;

a second mode wherein the heat exchanger transfers heat between the process fluid and the air and the mechanical cooler removes heat from the process fluid;

a third mode wherein the heat exchanger transfers heat between the process fluid and the air and the thermal energy storage removes heat from the process fluid; and a fourth mode wherein the heat exchanger transfers heat between the process fluid and the air, the mechanical cooler removes heat from the process fluid, and the thermal energy storage removes heat from the process fluid;

the method comprising:

determining a thermal duty of the heat transfer apparatus; and operating the process fluid heat exchange circuit in one of the plurality of modes based at least in part upon the thermal duty of the heat transfer apparatus.

22. The method of claim 21 further comprising determining a charge of the thermal energy storage; and wherein operating the process fluid heat exchange circuit in one of the plurality of modes includes operating the process fluid heat exchange circuit in one of the plurality of modes based at least in part upon the thermal duty of the heat transfer apparatus and the charge of the thermal energy storage.

23. The method of claim 21 further comprising receiving a request to minimize either water consumption or energy consumption; and wherein operating the process fluid heat exchange circuit in one of the plurality of modes includes operating the process fluid heat exchange circuit in one of the plurality of modes based at least in part upon the thermal duty of the heat transfer apparatus and the request to minimize either water consumption or energy consumption.

24. The method of claim 21 further comprising operating the process fluid heat exchange circuit in a fifth mode wherein:

the heat exchanger transfers heat between the process fluid and the air; and the mechanical cooler charges the thermal energy storage.

25. The method of claim 21 further comprising determining a charge of the thermal energy storage; and wherein operating the process fluid heat exchange circuit in one of the plurality of modes includes not operating the thermal energy storage in the third mode or the fourth mode in response to the thermal energy storage not having an adequate charge.

26. The method of claim 21 wherein the heat exchanger has a wet mode and a dry mode; and wherein operating the process fluid heat exchange circuit in one of the plurality of modes includes operating the heat exchanger in either the wet mode or the dry mode.

* * * * *